US011773608B2

(12) United States Patent
Toluk et al.

(10) Patent No.: US 11,773,608 B2
(45) Date of Patent: Oct. 3, 2023

(54) SUPPORT STRUCTURE ASSEMBLY

(71) Applicant: CASTAWALL AUSTRALIA PTY LTD, Ascot (AU)

(72) Inventors: Mel Toluk, Ascot (AU); Berk Toluk, Ascot (AU); Alexander Stewart Richardson, Belrose (AU); Natasha Elizabeth Boyle, Belrose (AU)

(73) Assignee: Castawall Australia Pty Ltd, Ascot (AU)

( * ) Notice: Subject to any disclaimer, the term of this patent is extended or adjusted under 35 U.S.C. 154(b) by 0 days.

(21) Appl. No.: 17/257,454

(22) PCT Filed: Jul. 3, 2019

(86) PCT No.: PCT/AU2019/050703
§ 371 (c)(1),
(2) Date: Dec. 31, 2020

(87) PCT Pub. No.: WO2020/006602
PCT Pub. Date: Jan. 9, 2020

(65) Prior Publication Data

US 2021/0277667 A1 Sep. 9, 2021

(30) Foreign Application Priority Data

Jul. 3, 2018 (AU) ..... 2018902415

(51) Int. Cl.

| | |
|---|---|
| ***E04G 11/06*** | (2006.01) |
| ***E04G 17/14*** | (2006.01) |
| ***E04F 13/08*** | (2006.01) |
| ***E04B 2/86*** | (2006.01) |
| ***E04G 11/00*** | (2006.01) |

(52) U.S. Cl.
CPC ..... *E04G 17/14* (2013.01); *E04B 2/8635* (2013.01); *E04F 13/0821* (2013.01); *E04G 11/00* (2013.01); *E04G 11/06* (2013.01)

(58) Field of Classification Search
CPC .. E04F 13/0821; E04F 13/0803; E04G 17/02; E04G 17/14; E04G 11/06; E04G 9/06; E04G 2011/067; E04G 11/00; E04B 2/8635
See application file for complete search history.

(56) References Cited

U.S. PATENT DOCUMENTS 3,288,427 A * 11/1966 Pluckebaum ..... E04G 17/04 249/47
3,397,496 A 8/1968 Sohns
(Continued)

FOREIGN PATENT DOCUMENTS

AU 2013203587 A1 1/2014
CN 102345382 A 2/2012
(Continued)

*Primary Examiner* — Michael Safavi
(74) *Attorney, Agent, or Firm* — Thomas M. Joseph, Esq.

(57) ABSTRACT

In a first aspect there is disclosed a support structure assembly (10). The support structure assembly includes a first wall panel (12) operatively associated with an opposing, spaced apart second wall panel. The first wall panel (12) including a channel (14) having two spaced apart channel walls (16) connected via a transverse channel base (18). The channel (14) encloses a resilient body (20).

13 Claims, 46 Drawing Sheets

(56) References Cited

U.S. PATENT DOCUMENTS

| | | | |
|---|---|---|---|
| 5,740,648 | A | 4/1998 | Piccone |
| 6,167,669 | B1 | 1/2001 | Lane |
| 6,212,845 | B1 | 4/2001 | De Zen |
| 6,247,280 | B1 | 6/2001 | Grinshpun et al. |
| 6,352,237 | B1 | 3/2002 | Severino |
| 7,703,248 | B2 | 4/2010 | Dincel |
| 2005/0016103 | A1 | 1/2005 | Piccone |
| 2005/0217197 | A1 | 10/2005 | Peacock et al. |
| 2007/0193169 | A1 | 8/2007 | Emblin |
| 2011/0277410 | A1 | 11/2011 | Richardson et al. |
| 2015/0337547 | A1 | 11/2015 | Richardson et al. |

FOREIGN PATENT DOCUMENTS

| | | | | | |
|---|---|---|---|---|---|
| CN | 107060322 | A | * | 8/2017 | ..... E04G 11/06 |
| CN | 107386631 | A | * | 11/2017 | ..... E04G 17/02 |
| CN | 112376897 | A | * | 2/2021 | ..... E04G 9/06 |
| CN | 112854778 | A | * | 5/2021 | ..... E04G 9/06 |
| CN | 113417452 | A | * | 9/2021 | ..... E04G 11/06 |
| JP | H11-141033 | A | | 5/1999 | |
| JP | H11141033 | A | * | 5/1999 | |
| KR | 10-1261208 | B1 | | 5/2002 | |
| WO | 2003031740 | A1 | | 4/2003 | |
| WO | 2008128275 | A1 | | 10/2008 | |
| WO | 2014121337 | A1 | | 8/2014 | |
| WO | 2015066758 | A1 | | 5/2015 | |
| WO | 2018039731 | A1 | | 3/2018 | |
| WO | WO-2018039731 | A | * | 3/2018 | ..... E04B 2/8617 |

* cited by examiner

SUPPORT STRUCTURE ASSEMBLY

CROSS REFERENCE TO RELATED APPLICATIONS

The present application is a U.S. national stage application of PCT International Application No. PCT/AU2019/050703, filed on Jul. 3, 2019, and published as PCT Publication WO/2020/006602 on Jan. 9, 2020, which claims priority to Australian Application No. AU 2018902415, filed on Jul. 3, 2018. The disclosures of all the foregoing applications are hereby incorporated by reference in their entirety into the present application.

FIELD

The present invention relates to a support structure assembly, in particular but not exclusively, a support structure assembly for constructing formwork to receive poured concrete.

BACKGROUND

In architecture, the façade of a building plays an important design aspect as it sets the tone for the rest of the building. It is known to secure façade panels to concrete walls via C-shaped channels produced from metal. Typically, C-channels are bolted at regular intervals along a wall and the façade panels, in turn, bolted to the C-channels. Drawbacks associated with conventional bolt-on C-channel façade systems include that the channels are not encapsulated within the wall and thus exposed to the elements. As bolts are required to penetrate a concrete structure to secure a C-channel in position, bolt failure or concrete cancer may occur. Further, to ensure C-channels are accurately spaced apart in regular intervals, accurate measurements are required with the associated time required by tradespersons to make such measurements. Also, bolting C-channels onto a wall will increase wall thickness and reduce the floor space of a room or building.

Formwork is used for providing temporary or permanent moulds into which concrete or building materials are poured into during the construction of a building. Various formwork types are known. Such known formwork types include formwork built on site out of timber and plywood. Another known formwork comprises an engineered system built from prefabricated modules having a metal frame. Formwork can also be provided by re-usable interlocking modular plastic units or insulating concrete forms which are assembled on-site and will remain in place after the concrete has cured.

Modular plastic formwork units typically comprise two parallel, spaced apart wall panels held together with connectors which extend between the wall panels. The spaced apart wall panels define an interior space into which concrete is poured. Once the concrete has set the wall panels are removed. One such system is disclosed in WO 2014/121337 ("Permaform") which discloses a formwork system having two spaced apart wall members having opposed inner surfaces and connectors. The connectors are adapted to engage connecting elements integral with or mounted onto each wall member inwards of the outer surfaces of the wall members to hold and retain the wall members in a spaced apart configuration.

WO 03/031740 ("Dincel") describes an elongate building element to form a series of walls. The building elements each include longitudinally extending flanges that snap-engage with longitudinally extending grooves in the next adjacent element. A wall is constructed by joining the elements in a direction transverse to the general direction of extension. The wall is filled with concrete as required. WO 2015/066758 ("CSR"), in turn, concerns a building formwork component comprising first and second spaced apart sidewalls having one or more webs extending therebetween. Each sidewall comprises a flange extending inwardly along a first edge of the sidewall such that an outer surface of the flange forms a ramp surface and a groove extending along an opposing second edge of the sidewall. The component may be coupled to a like component by relative movement of the components towards each other whereby the flanges are received in respective grooves of the like component. The ramp surfaces facilitate coupling by engaging respective second edges of the like component to move the second edges and/or ramp surfaces for engagement of the flanges in the groove.

U.S. Pat. No. 3,397,496 ("Sohn") describes an interlocking panel unit for building a house. The panel comprises a low density plastic foam core sheet and resin reinforced glass fibre face skins on the inner and outer surface thereof to define a laminated panel unit having upper, lower and side edge surfaces. The interlocking panel further includes a mating panel side edge surface locking means for panel units in which each of the side edges has a resin reinforced glass fibre edge skin anchored to the inner surfaces of each of the face skins. One of the side edges comprises a female side edge and the other a male side edge. The female edge has an outwardly extending tongue means formed jointly of edge skin and the inner face skin and, on the outer face skin, a groove means extending parallel to and set back of the edge skin. The female edge further includes a trough means formed on the outer skin between the groove means and edge skin. The mail edge includes an outwardly extending generally flat planar locking arm member with a downwardly directed clip leg for engaging the groove on the female edge with the locking member passing over and covering the trough means.

U.S. Pat. No. 3,310,917 ("Simon") concerns a building structure formed of discrete panels, each having a rigid peripheral frame. The frame has longitudinal grooves extending inwardly from the outer peripheral face thereof. The grooves are arrow-shaped in cross-section and an apertured metal sheet, which spans the inner periphery of the frame intermediate the side faces of the frame, is rigidly secured to the frame. Lightweight insulating structural material is adhered to opposite sides of the sheet within the confines of the frame. The insulating material has outer surfaces spaced apart from the sheet at least as far as the outer edges of the frame. The outer surfaces are coated with a hard-adherent layer of weatherproof plastic material. Further means is provided to secure the panels in proper positions in the building structure. The means to secure comprises elongated connecting members having integral ribs fitting tightly with the arrow-shaped grooves. The ribs are fitted with outwardly expanding splines whereby the ribs are securely locked within the arrow-shaped grooves.

U.S. Pat. No. 2,326,361 ("Jacobsen") relates to a building construction comprising a wall formed of spaced apart flat blocks. Each block has a transverse flange at either end thereof and a similar flange intermediate the end thereof. Each block also has bevelled flanges adjacent to the first named flanges. The blocks on one side of the wall is staggered with relation to the blocks on the other side of the wall. Channel members are provided which extend across between the blocks and having their edges bevelled on one side only for engagement with the bevelled flanges. Concrete filling is located in spaces between adjacent channels for holding the bevelled edges of the channels in engagement with the bevelled flanges and locking together the flanges on the abutting ends of the blocks.

U.S. Pat. No. 4,180,956 ("Gross") discloses a wall tie for tying together spaced panel units on opposite sides of a wall. The wall tie comprises two elongated extremities to engage in guide grooves in the respective panel units. The extremities are interconnected by web portions having serrated edges and adapted to fit into complementary recesses in insulating elements to maintain the elements in position inside the wall against both vertical and horizontal displacement.

U.S. Pat. No. 5,740,648 ("Piccone") describes a modular assembly for creating formwork for casting vertical concrete structures. The modular assembly comprises elongated elements having a generally concave interior surface which are disposed in edge-to-edge relationship in two facing rows, and which are simultaneously retained in edge-to-edge relationship and in facing relationship by connecting members. The connecting members comprise an elongated wall with a central portion between two outer portions. The elements have two extensions which extend laterally along the plane of the middle side of the elements. By engaging a connecting member to an element, the outer side of the element, the extension of the element and the outer portion of the connecting member form a triangular space providing structural rigidity to the formwork.

OBJECT

It is an object of the present invention substantially to overcome the drawbacks associated with the conventional practice of securing façade panels with the use of C-channel sections bolted onto a concrete structure or to provide a useful alternative. It is a further objective of the invention to provide an alternative support structure assembly which can be employed as formwork.

SUMMARY

In a first aspect there is disclosed herein a support structure assembly including a first wall panel operatively associated with an opposing, spaced apart second wall panel, the first wall panel including a channel having two spaced apart channel walls connected via a transverse channel base, wherein the channel encloses a resilient body.

Preferably the resilient body is produced from a metal or a fibre reinforced polymer.

Preferably the channel has an open entry opposing the transverse channel base.

Preferably an inside surface of the channel walls and channel base define a channel enclosure.

Preferably the channel walls taper outwardly from the open entry to the channel base.

Preferably the channel includes a brace coupling formation outwardly extending from an outer surface of the channel.

Preferably the channel operatively includes a locking member movable between (i) a locked position wherein the locking member engages the channel walls and (ii) a release position in which the locking member is adapted to be removed from the channel.

Preferably the locking member is attached to an actuator for moving the locking member between the locked position and the release position.

Preferably the actuator is adapted to support a façade panel.

Preferably the first wall panel includes a panel coupling formation adapted to couple with a complemental panel coupling formation of an adjacent wall panel.

Preferably the panel coupling formation is adapted for snap-engagement with the complemental panel coupling formation of the adjacent wall panel.

Preferably the panel coupling formation is a hermaphrodite coupling formation adapted to couple with a complemental hermaphrodite coupling formation of the adjacent wall panel.

In a second aspect there is disclosed herein a support structure assembly including a first wall panel operatively associated with an opposing, spaced apart second wall panel, wherein the first wall panel includes a panel coupling formation adapted to couple with a complemental panel coupling formation of an adjacent wall panel.

Preferably the panel coupling formation is adapted for snap-engagement with the complemental panel coupling formation of the adjacent wall panel.

Preferably the panel coupling formation is a hermaphrodite coupling formation adapted to couple with a complemental hermaphrodite coupling formation of the adjacent wall panel.

Preferably each hermaphrodite coupling formation includes (i) an outwardly extending protrusion having a ramp surface, and (ii) a first and second outwardly extending leg, each leg having a leg coupling formation, wherein (i) the outwardly extending protrusion of the first wall panel is adapted to engage a leg coupling formation of the second leg of the adjacent wall, (ii) a leg coupling formation of the first leg of the first wall panel is adapted to engage a leg coupling formation of the first leg of the adjacent wall panel, and (iii) a leg coupling formation of the second leg of the first wall panel is adapted to engage the outwardly extending protrusion of the adjacent panel.

Preferably the first wall panel includes a panel coupling formation having two outwardly extending protrusions adapted for snap-engagement with two outwardly extending protrusions of a panel coupling formation of the adjacent wall panel.

Preferably the outwardly extending protrusions of the adjacent panel define a slot, wherein the first wall panel includes a central protrusion adapted to be located within the slot.

Preferably the panel coupling formations have a cover attached thereto, the cover adapted to seal the panel coupling formations against the ingress of moisture.

Preferably the cover includes a seal.

Preferably the first and second wall panels each have a single wall panel skin.

Preferably the first and second wall panels each includes two spaced apart wall panel skins.

Preferably where the first and second wall panels include two skins, the first and second wall panels include brace coupling recesses which hold brace coupling formations adapted to couple with complemental wall panel coupling formations on bracing components which operatively extend between the first and second wall panels.

Preferably the first wall panel and the adjacent wall panel each includes a weld flange which are operatively attached to each other by welding.

Preferably the support structure assembly includes a skin adapter operatively adapted to connect a first wall panel having a single skin to an adjacent wall panel having two skins.

Preferably the support structure assembly includes a thickness adapter operatively adapted to connect a first wall panel to an adjacent wall panel, wherein the thickness of the first wall panel is different to that of the adjacent wall.

Preferably the support structure assembly includes a material adapter having a material adapter body with a hermaphrodite panel coupling formation on one side for attachment to the first wall panel and on another side a protruding adapter tongue for location within an adapter groove of an adjacent wall panel.

Preferably the support structure assembly includes a material adapter having a material adapter body with a hermaphrodite panel coupling formation on one side for attachment to the first wall panel and on another side a protruding surface adapter tongue for location within an adapter rebate of an adjacent wall panel.

Preferably the first and second wall panels each include two spaced apart wall panel skins.

In a second aspect there is disclosed herein a support structure assembly including a first wall panel operatively associated with an opposing spaced apart second wall panel, the support structure assembly including a brace operatively adapted to couple the first wall panel to the second wall panel, wherein the first wall panel includes a brace coupling formation operatively adapted to couple with a first wall panel coupling formation of the brace.

Preferably the second wall panel includes a brace coupling formation operatively adapted to couple with a second wall panel coupling formation of the brace.

Preferably the first wall brace coupling formation includes (i) two outer protrusions adapted to snap-engage the brace coupling formation of the first wall panel, and (ii) two internal protrusions operatively adapted to snap-engage a central protrusion of the brace coupling formation of the first wall panel.

Preferably the brace includes a plurality of elongate, longitudinally extending brace members.

Preferably the brace members have holes to facilitate concrete flow through the brace members during concrete pouring.

Preferably the brace members include undulating surfaces operatively adapted to support reinforcing members.

Preferably the brace members support a cross-brace including a reinforcing body.

Preferably the brace includes a transverse strengthening rib.

Preferably the brace includes multiple transverse strengthening ribs.

Preferably the brace includes resilient retainer members for holding reinforcing members.

Preferably the brace has stabiliser holder holes for accepting side stabilisers operatively adapted to provide the brace with side stabilisation.

In a third aspect there is disclosed herein a formwork wall panel including a channel having two spaced apart channel walls connected via a transverse channel base, the channel walls and channel base encapsulating a resilient body.

In a fourth aspect there is disclosed herein a support structure assembly including a first wall panel operatively associated with an opposing spaced apart second wall panel, the first wall panel including a channel having two spaced apart channel walls connected via a transverse channel base, the channel walls and channel base encapsulating a resilient body, wherein an exterior brace is coupled to the channel.

BRIEF DESCRIPTION OF THE DRAWINGS

Preferred embodiments of the invention will be described hereinafter, by way of examples only, with reference to the accompanying drawings wherein:

FIG. 119 is a schematic top view of a fifty-second embodiment support structure assembly;

FIG. 120 is a schematic top view of a fifty-third embodiment support structure assembly; and FIG. 121 is a schematic top view of a fifty-fourth embodiment support structure assembly.

DESCRIPTION OF PREFERRED EMBODIMENTS

Figure 1:
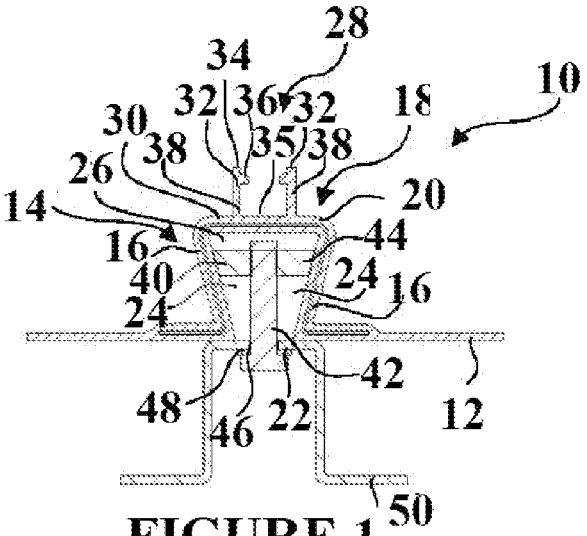
FIG. 1 is a schematic cross-sectional view of a portion of a first embodiment support structure assembly.
Figure 2:
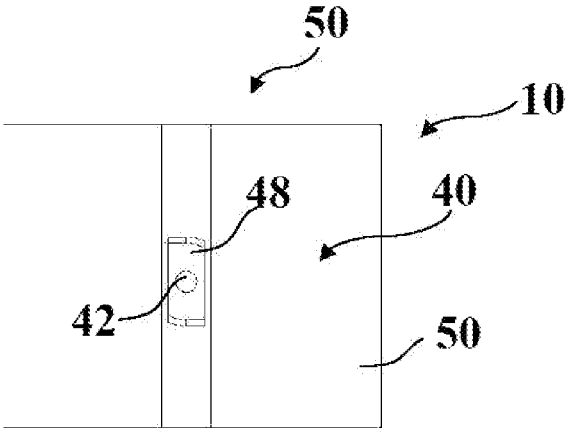
FIG. 2 is a schematic side view of a portion of the support structure assembly of FIG. 1.

FIGS. 1 and 2 show a portion of an embodiment support structure assembly, generally indicated with the reference numeral 10. In this embodiment the support structure assembly 10 is employed for constructing formwork to receive poured concrete during the construction of a building. The support structure assembly 10 includes a substantially planar, single skin polymer first wall panel 12. In use the first wall panel 12 is associated with a non-illustrated opposing, spaced apart second polymer wall panel. The first wall panel 12 includes a channel 14, here being of a substantially C-shaped configuration. The first wall panel 12 and channel 14 is of one-piece constructions having been co-extruded. It will of course be appreciated that the first wall panel 12 and channel 14 can be individual components which are connected for use. The channel 14 has two spaced apart channel walls 16 connected via a transverse channel base 18. The channel walls 16 and channel base 18 enclose/encapsulate a resilient body 20. In this embodiment the resilient body 20 is produced from roll formed sheet metal. It will of course be appreciated that the resilient body 20 could be produced from a range of materials.

In this embodiment the wall panel 12 is produced from polyvinylchloride (PVC). It will of course be appreciated that a range of other suitable polymers or materials could be employed. The first wall panel 12 is produced by co-extruding the PVC over the sheet metal body 20 of the channel 14. Having the resilient sheet metal body 20 in place assists in the channel 14 being firmly secured within concrete poured into a space defined between the first and second wall panels as discussed below.

Figure 3:
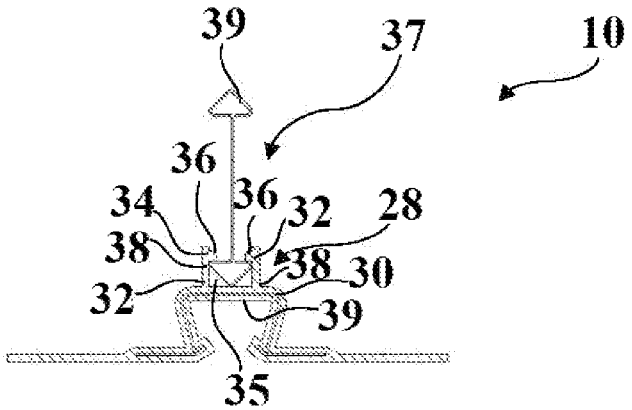
FIG. 3 is a schematic cross-sectional view of a second embodiment support structure assembly.

The channel 14 has an open entry 22 opposing the transverse channel base 18. An inside surface 24 of the channel walls 16 and channel base 18 define a channel enclosure 26. As shown in FIG. 1 the channel walls 16 taper outwardly from the open entry 22 to the channel base 18. The channel 14 further includes a brace coupling formation 28 outwardly extending from an outer surface 30 of the channel 14. Referring also to FIG. 3, the brace coupling formation 28 comprises two protrusions 32 outwardly extending from the outer surface 30. The protrusions 32 each includes a flange 34 which defines a holding position 35 for retraining a portion of a roll formed sheet metal brace 37. Each flange 34 defines (i) a ramp surface 36 to facilitate entry of an arrow shaped head 39 of the brace 37 into the holding position 35, and (ii) a capture surface 38 to deter removal of the brace 37 from the holding position 35 and, as a result, prevents detachment of the brace 37 from the wall panel 12. Although not illustrated the brace 37 has holes therein to facilitate concrete flow and reinforcement bar seating.

The channel 14 operatively includes a locking member 40. The locking member 40 is movable between (i) a locked position (shown in FIG. 1) wherein the locking member 40 engages the channel walls 16 and (ii) a non-illustrated release position in which the locking member 40 is adapted to be removed from the channel 14. The locking member 40 is attached to an actuator 42 for moving the locking member 40 between a locked position and the release position. In this embodiment the locking member 40 is a nut with a tapering side wall 44 which is parallel angled to the channel walls 16. The actuator 42, in turn, is provided in the form of a bolt which threadingly engages a complemental hole 46 in the locking member nut 40. The actuator 42 passes through a flat plate 48 which abuts a top hat section 50. Surface materials or a façade panel may be mounted to the top hat section 50.

Concrete poured into the space between the wall panels will prevent the channel 14 from opening and will provide structural strength to prevent the locking member nut 40 being pulled from the channel 14. By rotating the actuator bolt 42 the locking member nut 40 will self-seat into the channel 14. Continuous rotation of the actuator bolt 42 will pull the locking member nut 40 tightly up against the angled channel walls 16 so as to clamp the top hat section 50 securely to the channel 14. A preferred aspect of the support structure assembly 10 is that it provides for relative quick installation and for disassembly if required.

Figure 4:
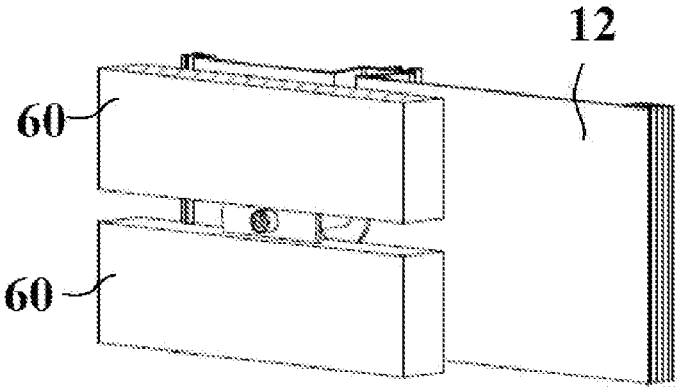
FIG. 4 is a schematic perspective view of a third embodiment support structure assembly.
Figure 5:
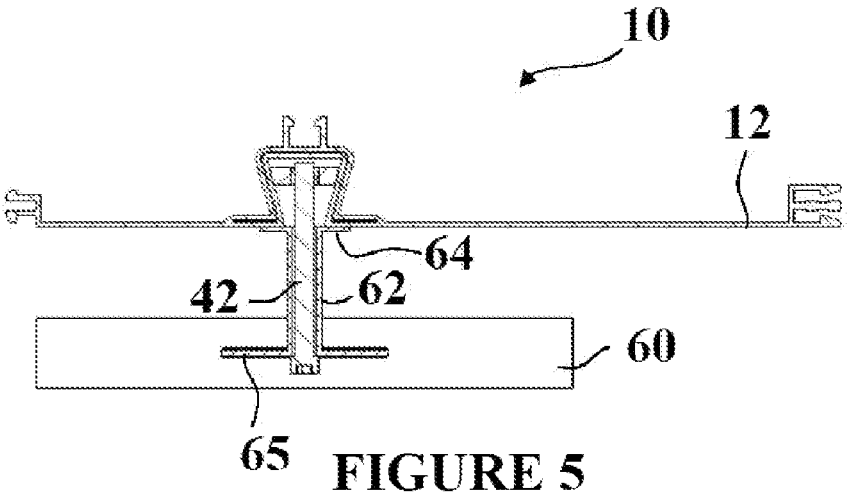
FIG. 5 is a schematic cross-sectional view of the support structure assembly of FIG. 4.
Figure 6:
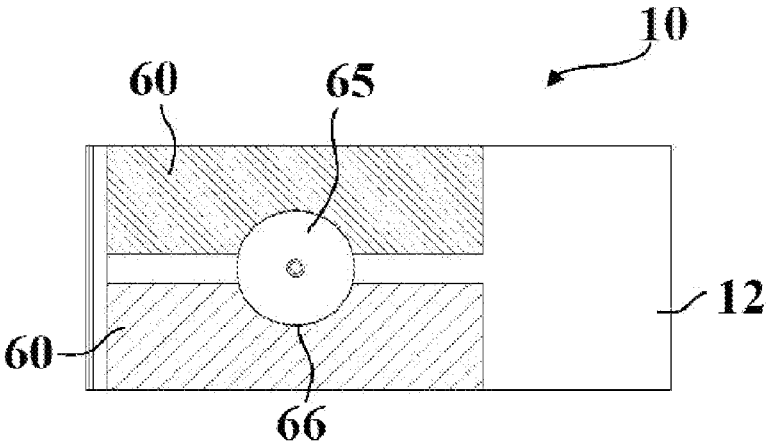
FIG. 6 is a further schematic cross-sectional view of the support structure assembly of FIG. 4.

FIGS. 4 to 6 show the support structure assembly 10 employed to secure façade panels, here in the form of stone wall finishing sheets 60, in position to the wall panel 12. A stand-off component 62 is mounted to the actuator bolt 42. The stand-off component 62 at one end includes a flange 64, which engages the wall panel 12, and towards its other end a disc-shaped coupling component 65 located within recesses 66 cut into the sheets 60. Although specific reference has been made to stone wall finishing sheets, it will be appreciated that a range of other finishing sheets could be employed.

The support structure assembly 10 can be used in conjunction with known formwork assemblies, for example the formwork system described in WO 2014/121337 ("Permaform"), the contents of which are herein incorporated by reference, and AU 2002328869 ("Dincel"), the contents of which are also incorporated herein by reference.

Figure 7:
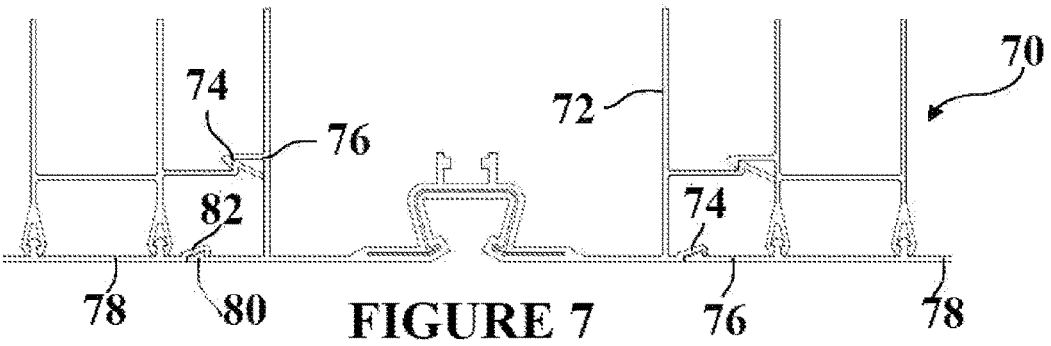
FIG. 7 is a schematic top view of a fourth embodiment support structure assembly.

FIG. 7 shows an embodiment support structure assembly 70 having connectors 72 which include resilient catch members 74 adapted to snap-engage corresponding catch members 76 of adjacent wall panels 78 in accordance with Permaform. The support structure assembly 70 also includes catch members 80 adapted to snap-engage resilient catch members 82 of the adjacent wall panels 78.

Figure 8:
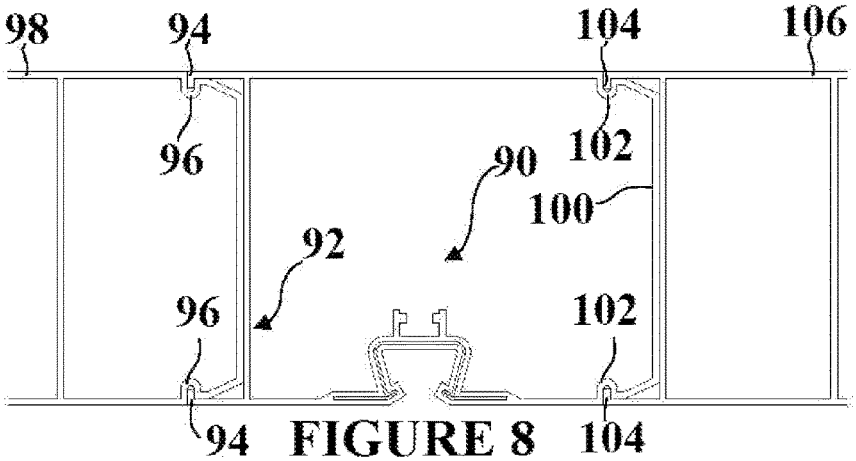
FIG. 8 is a schematic top view of a fifth embodiment support structure assembly.

FIG. 8 shows an embodiment support structure assembly 90 having a connector 92 which includes resilient catch members 94 adapted to snap-engage corresponding catch members 96 of adjacent wall panels 98 in accordance with the Dincel system. The support structure assembly 90 includes a further connector 100 having catch members 102. The catch members 102 are adapted to snap-engage resilient catch members 104 of another the adjacent Dincel wall panel 106.

Figure 9:
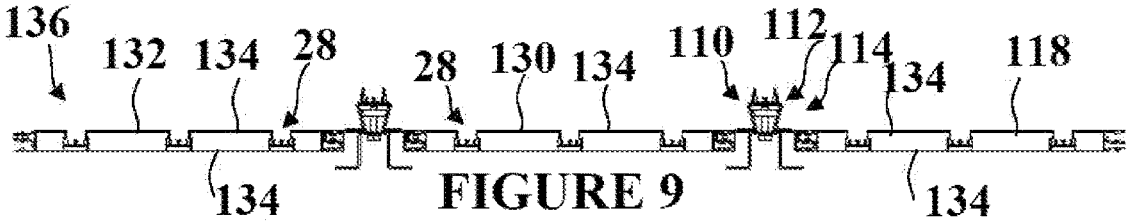
FIG. 9 is a schematic top view of a sixth embodiment support structure assembly.
Figure 10:
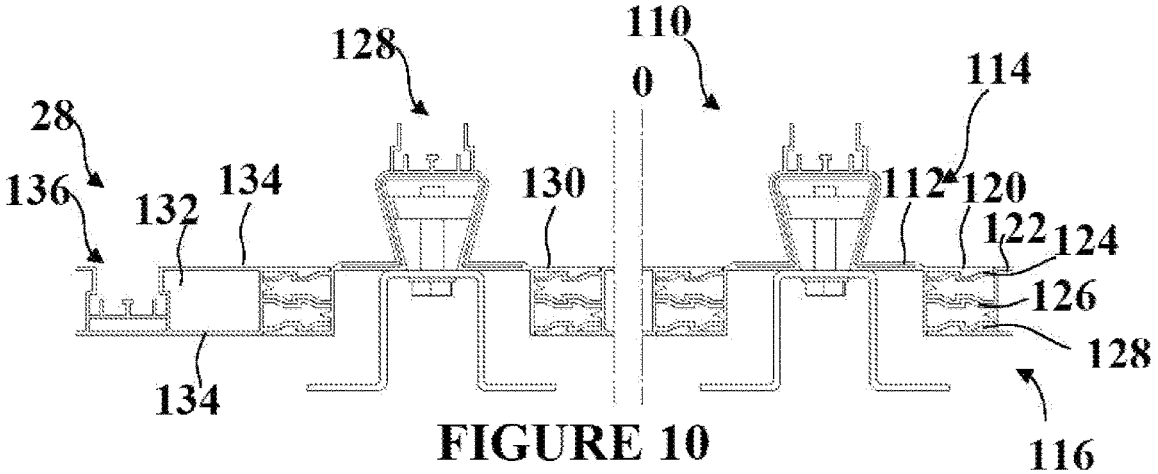
FIG. 10 is an enlarged schematic view of a portion of the support structure assembly of FIG. 9.

FIGS. 9 and 10 show an embodiment support structure assembly 110 comprising a first wall panel 112 including a panel coupling formation 114 adapted to couple with a complemental panel coupling formation 116 of an adjacent wall panel 118. In this embodiment the panel coupling formation 114 is adapted for snap-engagement with the complemental panel coupling formation 116 of the adjacent wall panel 118. In particular, the panel coupling formation 114 is a hermaphrodite coupling formation adapted to couple with a complemental hermaphrodite coupling formation 116 of the adjacent wall panel.

Each hermaphrodite coupling formation 114, 116 includes (i) an outwardly extending protrusion 120 having a ramp surface 122, and (ii) a first and second outwardly extending leg 124, 126 with each leg 124, 126 having a leg coupling formation 128. The outwardly extending protrusion 120 of the first wall panel 112 is adapted to engage a leg coupling formation 128 of the second leg 126 of the adjacent wall 118. The leg coupling formation 128 of the first leg 124 of the first wall panel 112 is adapted to engage the leg coupling formation 128 of the first leg of the adjacent wall panel 118. Finally, the leg coupling formation 128 of the second leg 126 of the first wall panel 112 is adapted to engage the outwardly extending protrusion 120 of the adjacent panel 118.

FIGS. 9 and 10 show that wall panels 118, 130, 132 each includes two opposing, co-extensive spaced-apart wall skins 134. Referring to FIG. 10, wall panels 118, 130, 132 each defines a brace coupling recess 136 which each holds a brace coupling formation 28 adapted to couple with complemental non-illustrated wall panel coupling formations on bracing components operatively extending from the wall panels 118, 130, 132.

It should be noted that the wall panel 112 is of single skin construction. The hermaphrodite panel coupling formations 114, 116 of the wall panels 112, 118 facilitate coupling between the single skin wall panel 112 and the double skin wall panel 118.

Figure 11:
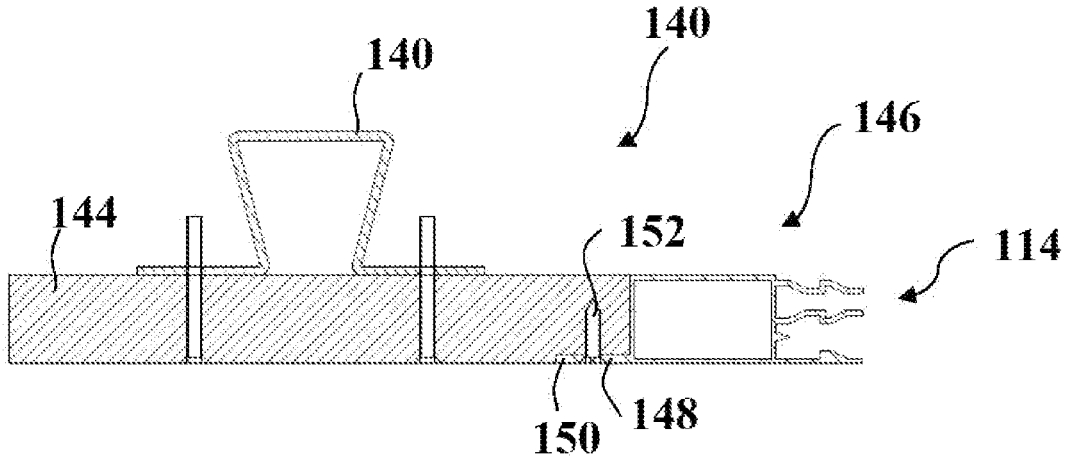
FIG. 11 is a schematic cross-sectional view of a seventh embodiment support structure assembly.

FIG. 11 shows an embodiment support structure assembly 140 having a C-channel bolted to a wall sheet material 144. The wall sheet material 144, in turn, is coupled to an adapter 146. The adapter 146 includes a flange 148 which is located within a rebate 150 of the wall sheet material 144 and secured in position with a fastener screw 152. To facilitate attachment and transition to a non-illustrated adjacent wall panel of an embodiment support structure assembly the adapter 146 includes a hermaphrodite panel coupling formation 114 which operates as discussed above.

Figure 12:
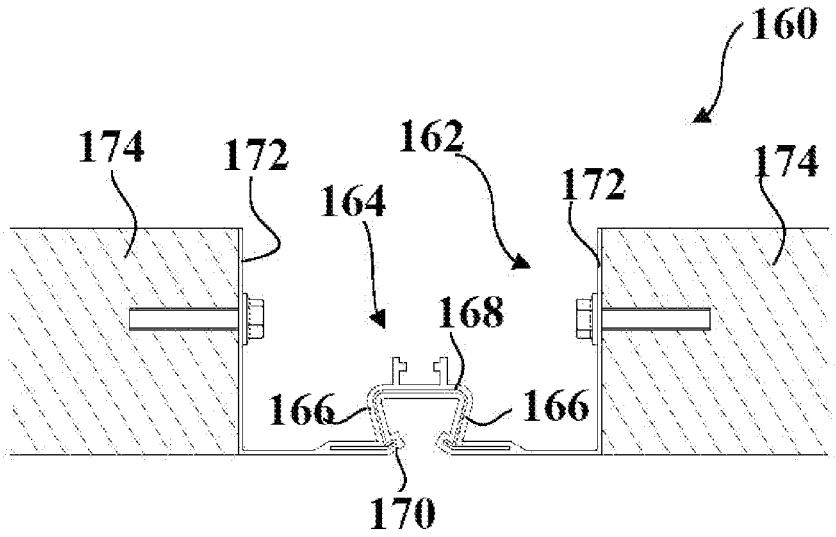
FIG. 12 is a schematic cross-sectional view of an eighth embodiment support structure assembly.

FIG. 12 shows an embodiment support structure assembly 160 which includes an embodiment wall panel 162 having a substantially C-shaped channel 164. The channel 164 has two spaced apart channel walls 166 connected via a transverse channel base 168. The channel walls 166 and channel base 168 encapsulate a resilient body 170 produced from roll formed sheet metal. The support structure assembly 160 further includes two spaced apart co-extensive and substantially parallel anchoring returns 172. The anchoring returns 172 are bolted to wall sheet materials 174 as shown. That method of assembly allows for the support structure assembly 160 to be installed at selected locations independent of the nature of the concrete formwork employed.

Figure 13:
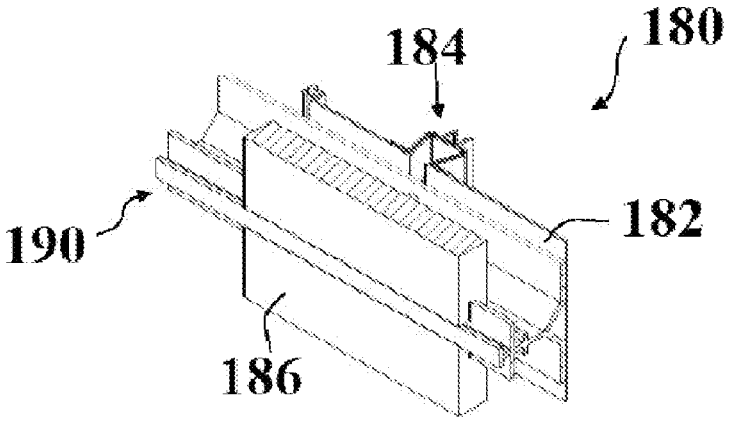
FIG. 13 is a schematic cross-sectional view of a ninth embodiment support structure assembly.
Figure 14:
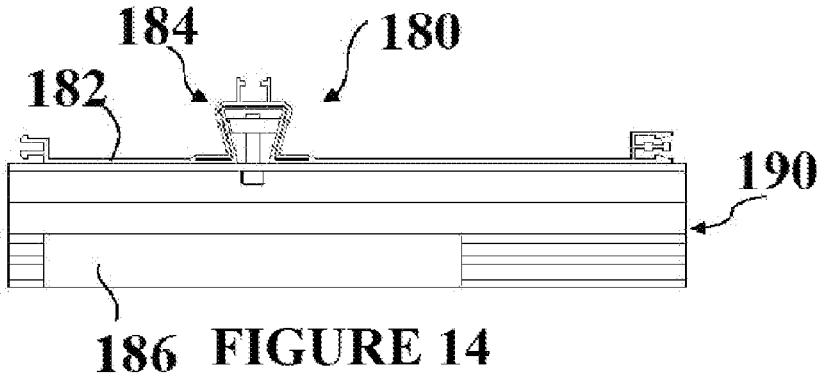
FIG. 14 is a schematic top view of the support structure assembly of FIG. 13.
Figure 15:
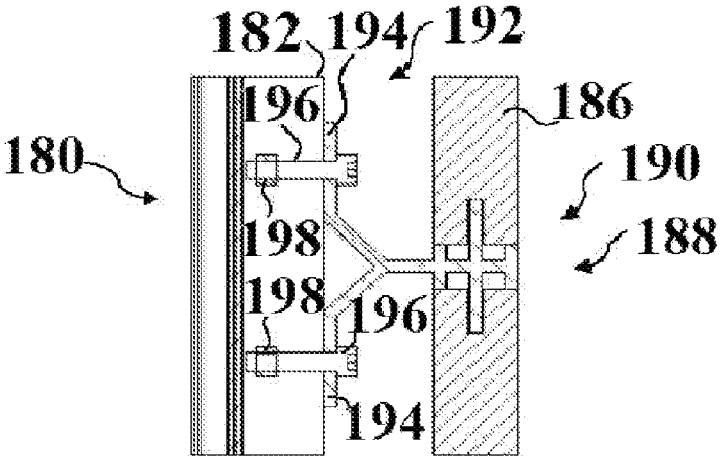
FIG. 15 is a schematic cross-sectional view of the support structure assembly of FIG. 13.
Figure 16:
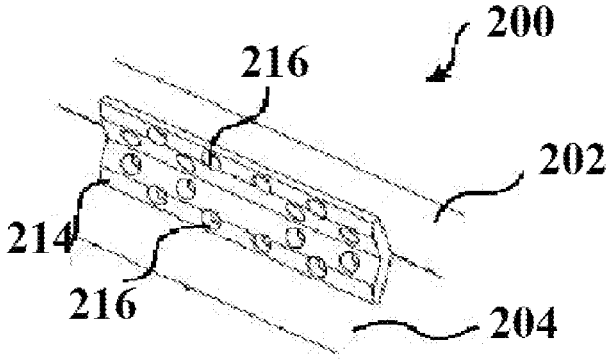
FIG. 16 is a schematic perspective view of a tenth embodiment support structure assembly.
Figure 17:
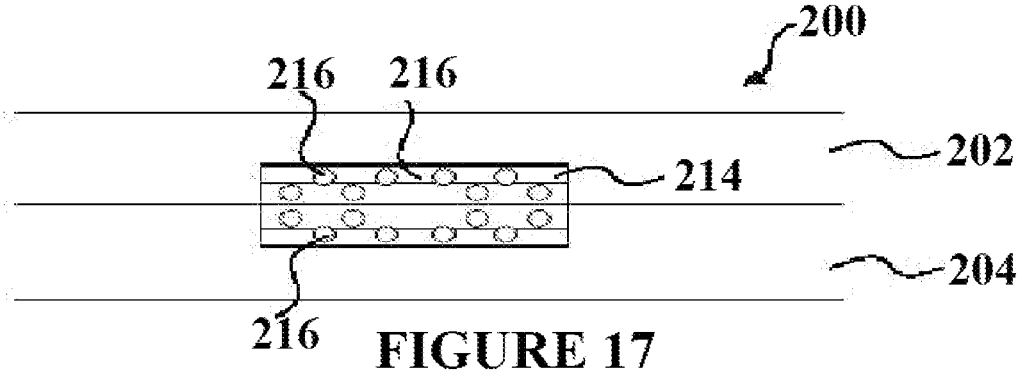
FIG. 17 is a schematic front view of the support structure assembly of FIG. 16.
Figure 18:
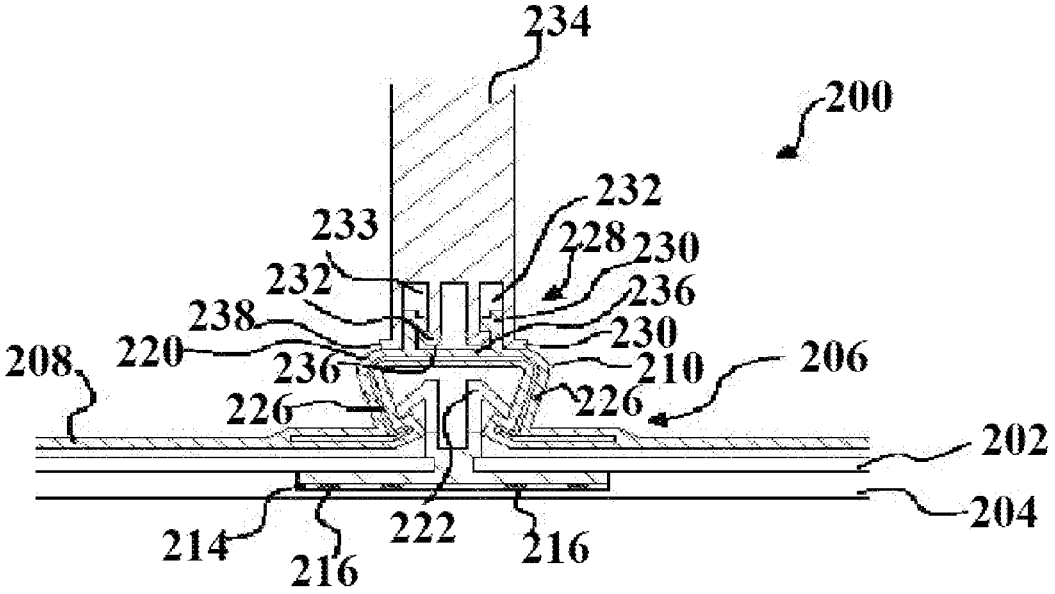
FIG. 18 is a schematic cross-sectional view of the support structure assembly of FIG. 16.
Figure 19:
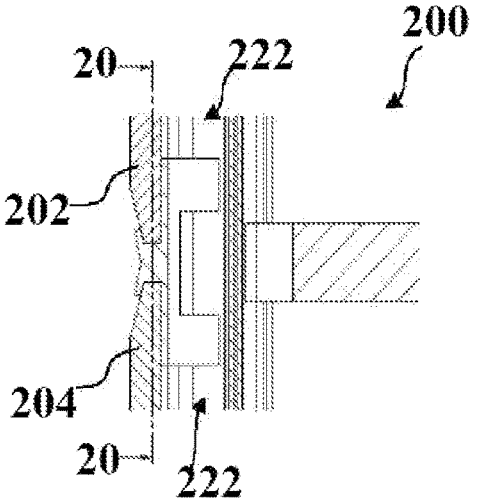
FIG. 19 is a further schematic cross-sectional view of the support structure assembly of FIG. 16.
Figure 20:
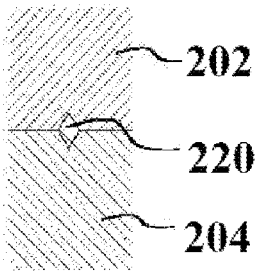
FIG. 20 is a cross-sectional view at the line 20-20 in FIG. 19.
Figure 21:
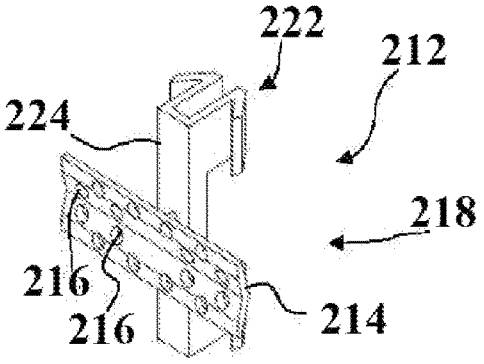
FIG. 21 is a schematic front view of a clip of the support structure assembly of FIG. 16.
Figure 22:
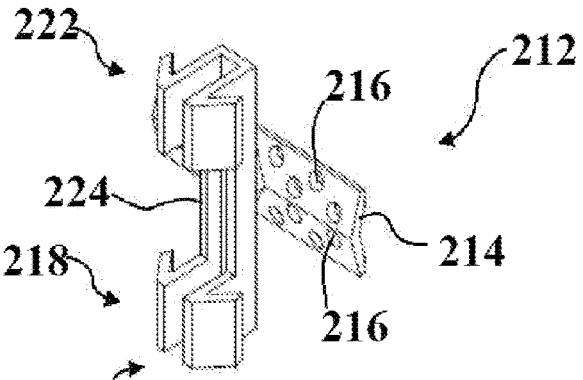
FIG. 22 is a schematic rear view of the clip of FIG. 21.

FIGS. 13 to 15 show an embodiment support structure assembly 180 including a wall panel 182 with a channel 184. The wall panel 182 and channel 184 are similar to the wall panel 12 and channel 14 of FIG. 1. In this embodiment the support structure assembly 180 includes a wall sheet material 186, for example timber. The wall sheet material 186 defines a cross-shaped slot 188 adapted to receive a complemental rail 190 of a bracket 192. The bracket 192 includes attachment plates 194 which abut the wall panel 182. The bracket 192 is secured in position by two actuator bolts 196 coupled to respective locking member nuts 198 secured within the channel 184.

A further embodiment support structure assembly 200 is illustrated in FIGS. 16 to 22. In this embodiment gypsum panels 202, 204 are secured to a wall panel assembly 206. The wall panel assembly 206 includes a single skin wall panel 208 and a channel 210. The wall panel 208 and channel 210 are similar to the wall panel 12 and the channel 14 of FIG. 1. The support structure assembly 200 includes a support member 212, shown in FIGS. 21 and 22. The support member 212 includes a support plate 214 having a plurality of holes 216. The holes 216 are provided to key in plaster seam infill. The support member 212 further includes a channel coupling member 218 connected to the support plate 214 with a substantially diamond shaped connector 220.

The channel coupling member 218 comprises two pairs of resilient protrusions 222. The protrusion pairs 222 are spaced apart and connected to a spine 224. In use the protrusions 222 are adapted to snap-engage inwardly extending lips 226 of the channel 210. The diamond shaped connector 220 operatively serves to connect the coupling member 218 to the support plate 214. Its diamond shape allows the connector 220 to cut into gypsum sheet edges and allow the rest of such sheet edges to abut over the length.

As with the support structure assembly 10, the channel 210 includes a brace coupling formation 228 with two opposing protrusions 230 with inwardly facing flanges 232. The support structure assembly 200 includes an elongate brace 234. The brace 234 includes two resilient brace protrusions 236 operatively adapted to be secured in position by the flanges 232. The brace 234 further includes two outer flanged protrusions 238 which abut an outer surface 240 of the channel 210.

Figure 23:
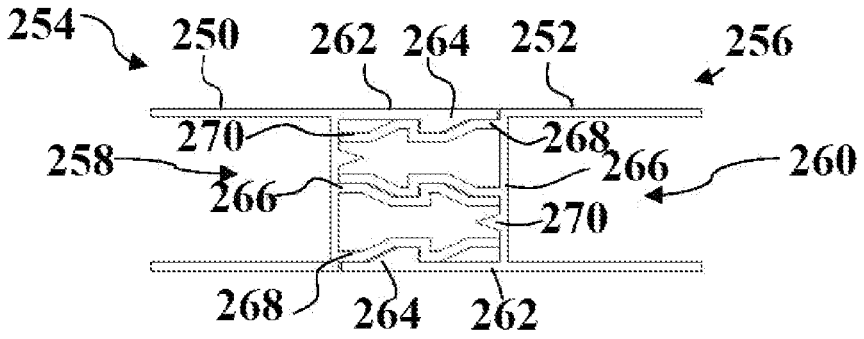
FIG. 23 is a schematic top view of a portion of an eleventh embodiment support structure assembly.

FIG. 23 depicts two double skin wall panels 250, 252 of adjacent embodiment support structure assemblies 254, 256 which are coupled via hermaphrodite panel coupling formations 258, 260. Each hermaphrodite panel coupling formation 258, 260 includes (i) an outwardly extending protrusion 262 having a ramp surface 264, and (ii) a first and second outwardly extending leg 266, 268 each leg 266, 268 having a leg coupling formation 270. The outwardly extending protrusion 262 of the first wall panel 250 is adapted to engage the leg coupling formation 270 of the second leg 268 of the adjacent wall 252. The leg coupling formation 270 of the first leg 266 of the first wall panel 250 is adapted to engage the leg coupling formation 270 of the first leg 266 of the adjacent wall panel 252. Finally, the leg coupling formation 270 of the second leg 268 of the first wall panel 250 is adapted to engage the outwardly extending protrusion 262 of the adjacent wall panel 252.

The hermaphrodite coupling formations 258, 260 enable universal joining of adjacent wall panels in that only a left-hand (LH)/right-hand (RH) orientation of the same support structure assembly 254, 256 is required. That feature simplifies variation of coupling formation shapes and consequentially minimising parts required.

Figure 24:
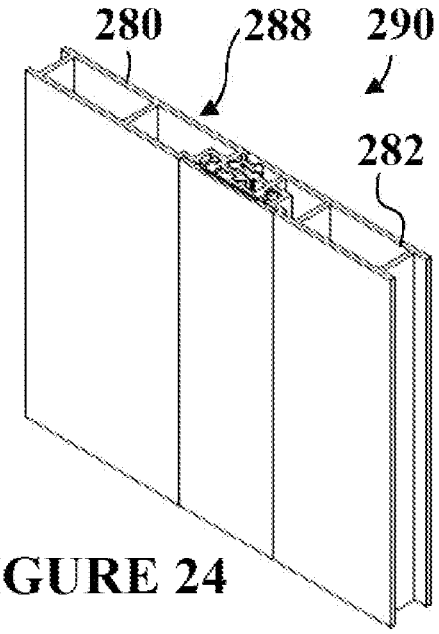
FIG. 24 is a schematic perspective view of a portion of a twelfth embodiment support structure assembly.
Figure 25:
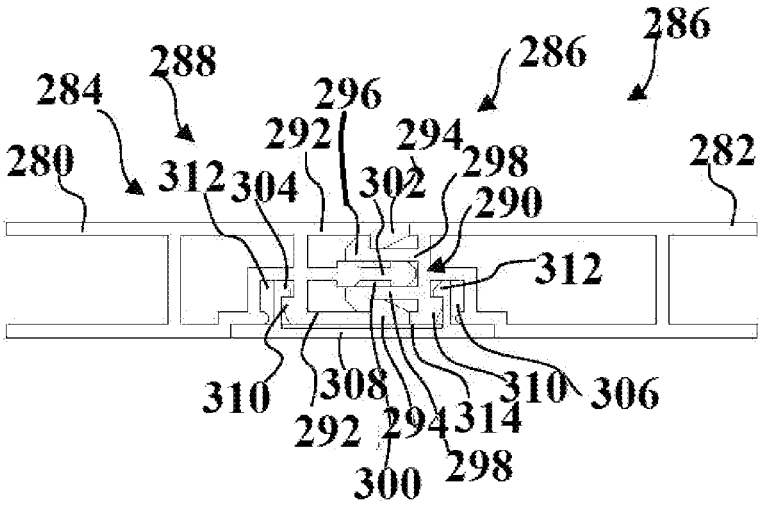
FIG. 25 is a schematic top view of a portion of the support structure assembly of FIG. 24.

FIGS. 24 and 25 depict two double skin wall panels 280, 282 of adjacent embodiment support structure assemblies 284, 286. The wall panels 280, 282 are coupled via a first and second panel coupling formation 288, 290. The first panel coupling formation 288 includes two outwardly extending protrusions 292 having catch heads 294. The catch heads 294 are adapted for snap-engagement with two catch heads 296 on outwardly extending protrusions 298 of the second panel coupling formation 290. The protrusions 298 define a slot 300 operatively adapted to receive and hold a complemental central protrusion 302. The first panel coupling formation 288 defines a first cover surface 304 and the second panel formation 290 a second cover surface 306. A cover 308 is provided having resilient protrusions 310 having catches 312 adapted respectively for snap-engagement with the first and second cover surfaces 304, 306. The cover 308 includes a seal 314, here provided in the form of a layer of a double face adhesive foam tape.

Figure 26:
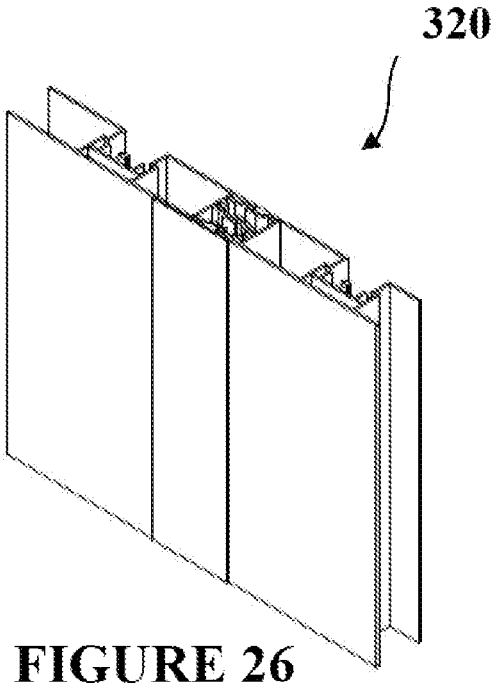
FIG. 26 is a schematic perspective view of a portion of a thirteenth embodiment support structure assembly.
Figure 27:
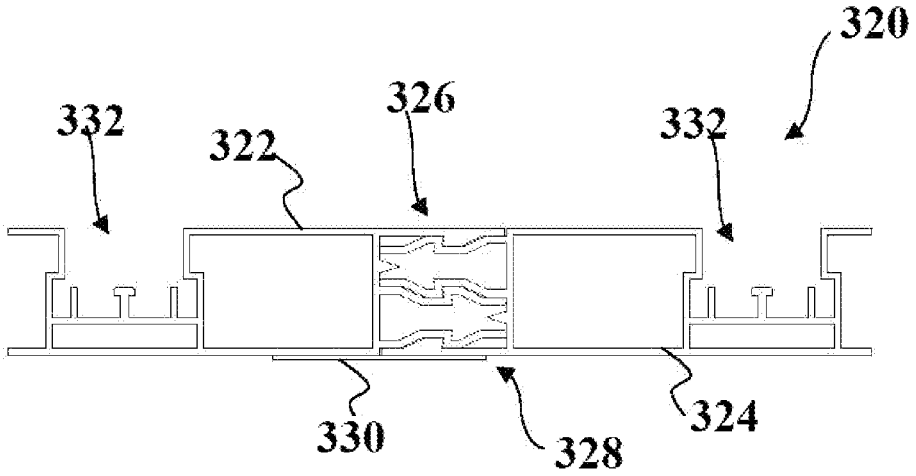
FIG. 27 is a schematic top view of a portion of the support structure assembly of FIG. 26.

FIGS. 26 and 27 show an embodiment support structure assembly 320 having double skin wall panels 322 and 324 which are coupled via hermaphrodite panel coupling formations 326, 328 similar to those discussed for FIG. 25. A seal 330, here fibreglass self-adhesive tape, serves to prevent the ingress of moisture. At their ends each wall panel 322, 324 includes a brace coupling formation 332 similar to that described in FIG. 10.

Figure 28:
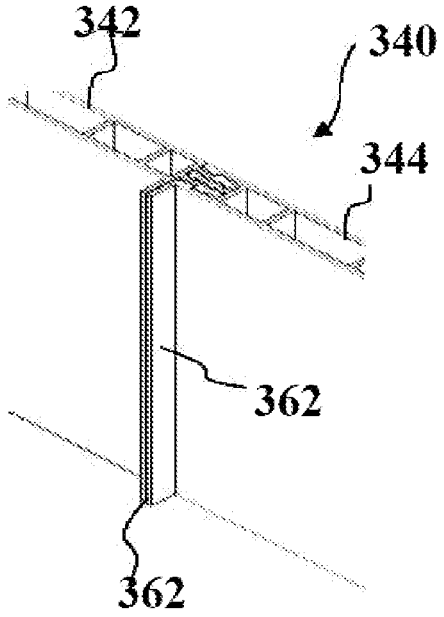
FIG. 28 is a schematic perspective view of a portion of a fourteenth embodiment support structure assembly.
Figure 29:
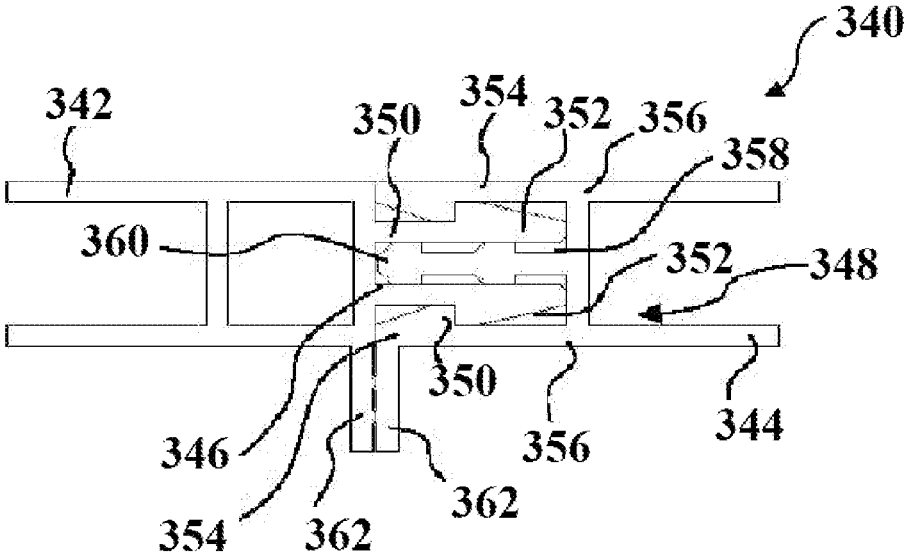
FIG. 29 is a schematic top view of a portion of the support structure assembly of FIG. 28.

FIGS. 28 and 29 show an embodiment support structure assembly 340 having double skin wall panels 342, 344 which are coupled via first and second hermaphrodite panel coupling formations 346, 348 similar to those discussed for FIG. 23. Specifically, the first panel coupling formation 346 includes two outwardly extending protrusions 350 having catch heads 352. The catch heads 352 are adapted for snap-engagement with two catch heads 354 on outwardly extending protrusions 356 of the second panel coupling formation 348. The protrusions 350 define a slot 358 operatively adapted to receive and hold a complemental central protrusion 360. Each of the wall panels 342, 344 include a weld flange 362 which is operatively adapted to be attached with a slide down plastics welder.

Figure 30:
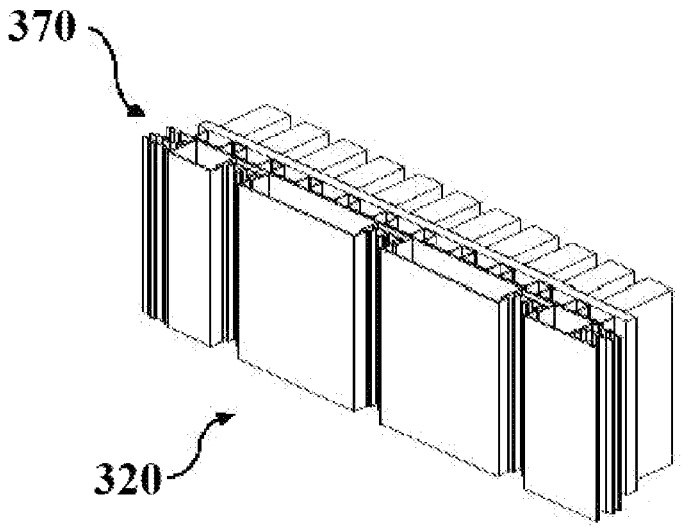
FIG. 30 is a schematic perspective view of a portion of a fifteenth embodiment support structure assembly.
Figure 31:
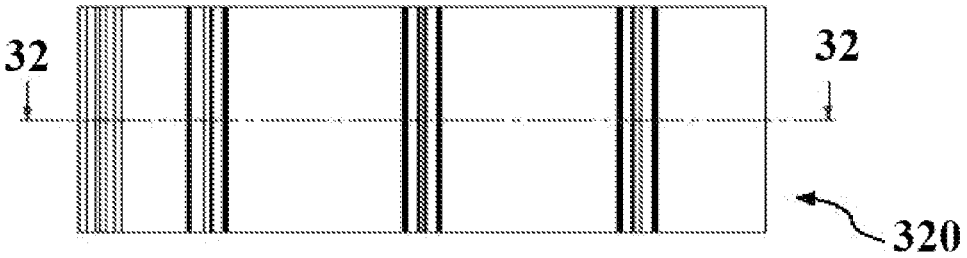
FIG. 31 is a schematic front view of the support structure assembly of FIG. 30.
Figure 32:
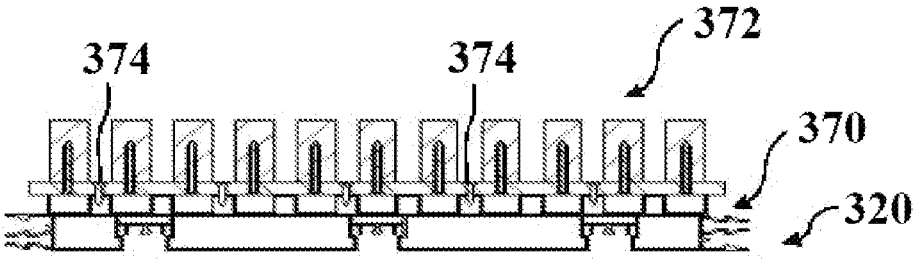
FIG. 32 is a cross-sectional view at the line 32-32 in FIG. 31.

FIGS. 30 to 32 show the embodiment support structure assembly 320 (described in FIGS. 26 and 27) having a roll-formed sheet metal corrugated square through profile 370 adhered thereto. The sheet metal profile 370, in turn, has a pre-made timber slat profile 372 secured thereto with fastener screws 374. Although the illustrated sheet metal profile 370 is adhered to the support structure assembly 320 with a suitable adhesive, it will be appreciated that the sheet metal profile could also be secured in position with suitable non-illustrated fasteners. Preferred features of having the support structure assembly 320 support a pre-made timber slat profile 372 includes a reduction in labour and installation costs as well the time required for providing a timber aesthetic.

Figure 33:
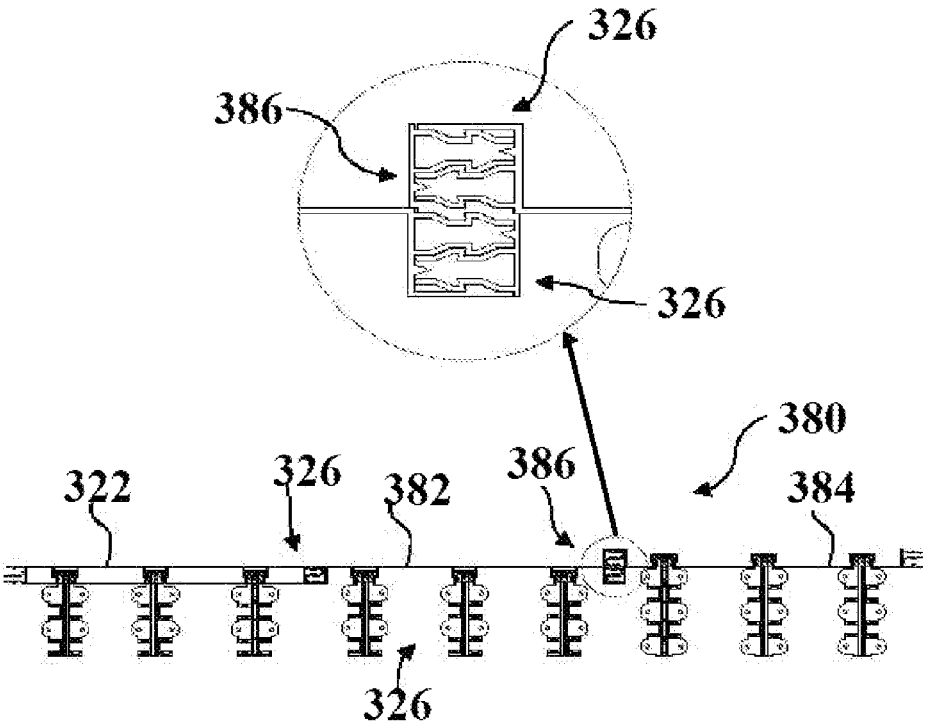
FIG. 33 is a schematic top view of a portion of a sixteenth embodiment support structure assembly.

FIG. 33 shows a support structure assembly 380 wherein an interior double skin wall panel 322 (described in FIG. 27) is attached to an interior single skin wall panel 382 which, in turn, is attached to a strippable single skin wall panel 384. Both the double skin wall panel 322 and the single skin wall panel 382 includes a hermaphrodite panel coupling formation 326 (described in FIG. 27) which operates as described above. To facilitate the transition between the interior single skin wall panel 382 and the strippable wall panel 384 an interior-exterior skin adapter 386 is required. The embodiment interior-exterior skin adapter 386 includes two sets of hermaphrodite panel coupling formations 326 adapted for coupling respectively with the hermaphrodite panel coupling formations 326 of the single skin wall panel 382 and that of the strippable single skin wall panel 384.

Figure 34:
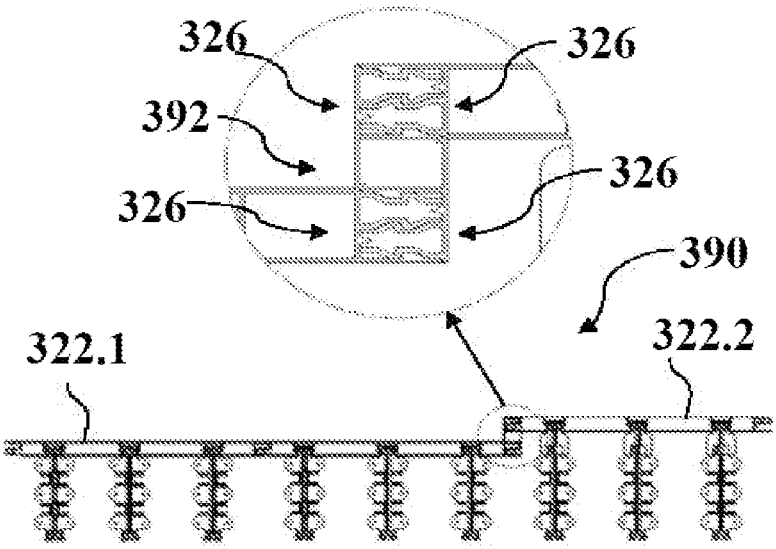
FIG. 34 is a schematic top view of a portion of a seventeenth embodiment support structure assembly.
Figure 35:
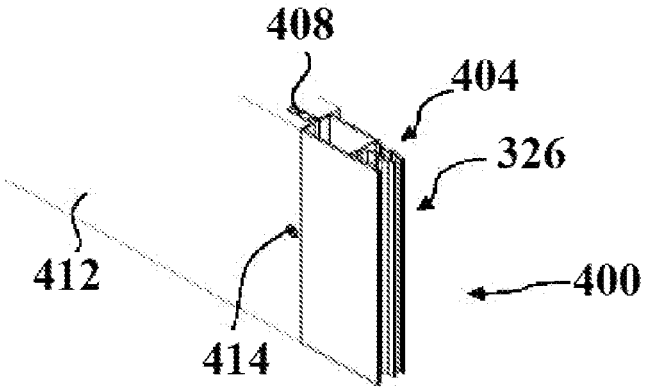
FIG. 35 is a schematic perspective view of a portion of an eighteenth embodiment support structure assembly.
Figure 36:
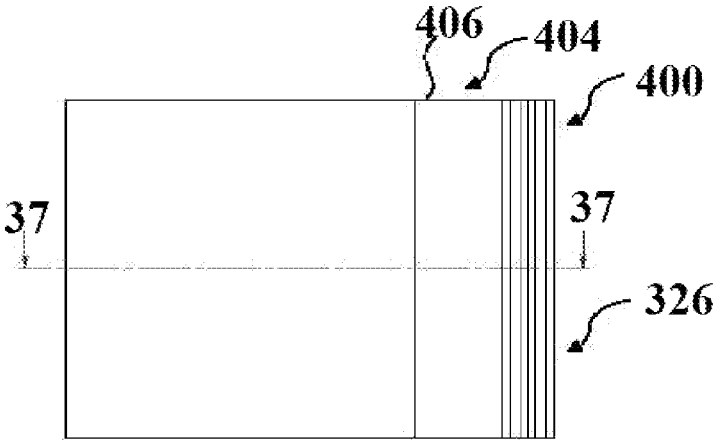
FIG. 36 is a schematic front view of the support structure assembly of FIG. 35.
Figure 37:
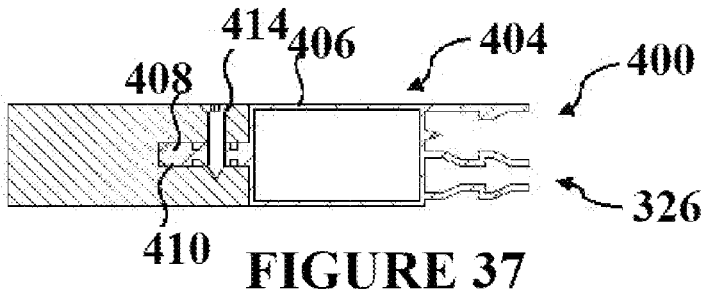
FIG. 37 is a cross-sectional view at the line 37-37 in FIG. 36.
Figure 38:
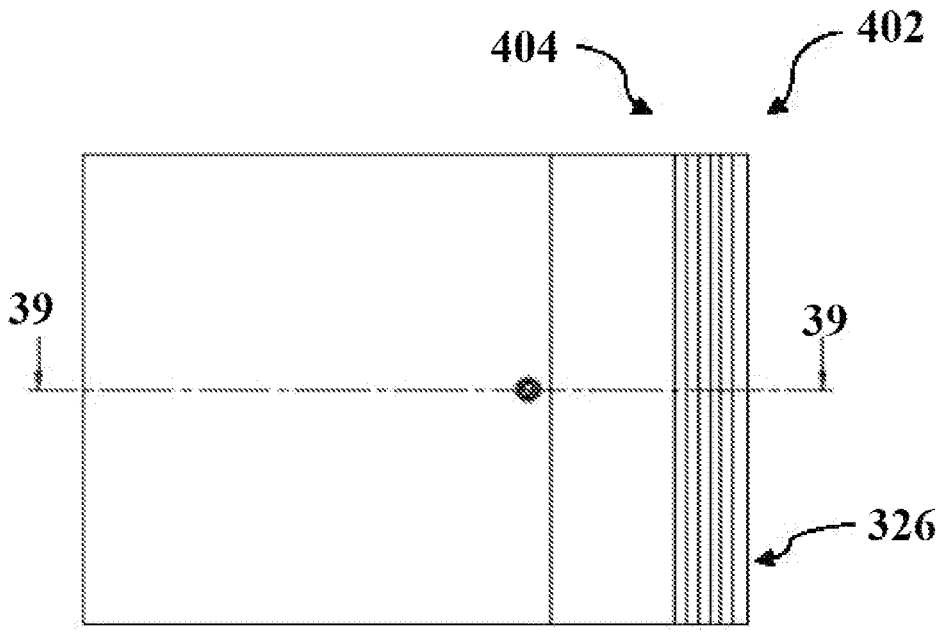
FIG. 38 is a schematic front view of a nineteenth embodiment support structure assembly.
Figure 39:
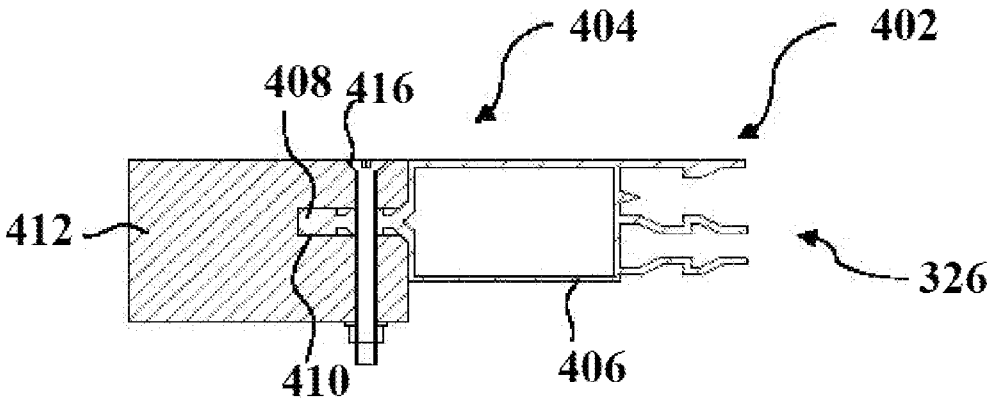
FIG. 39 is a cross-sectional view at the line 39-39 in FIG. 38.
Figure 40:
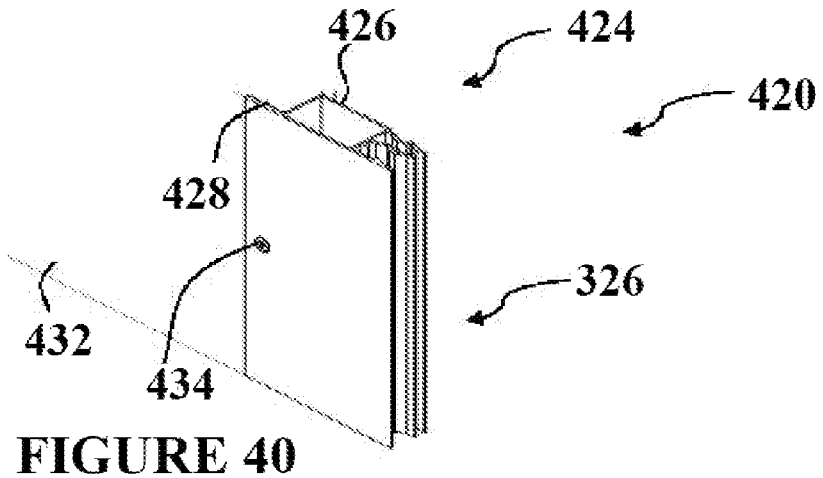
FIG. 40 is a schematic perspective view of a portion of a twentieth embodiment support structure assembly.
Figure 41:
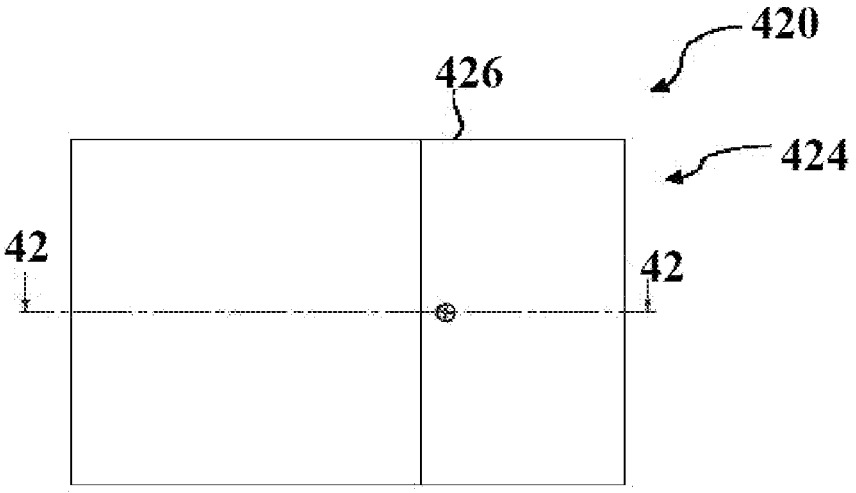
FIG. 41 is a schematic front view of the support structure assembly of FIG. 40.
Figure 42:
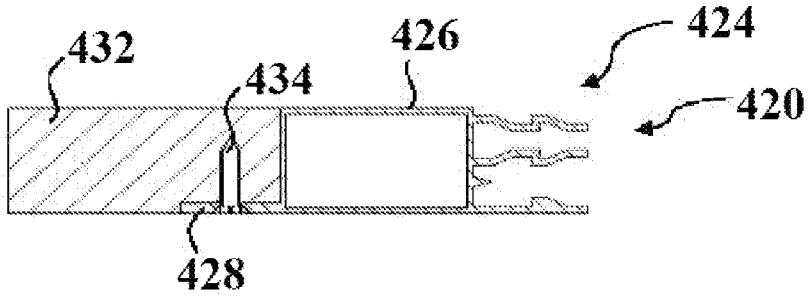
FIG. 42 is a cross-sectional view at the line 42-42 in FIG. 41.
Figure 43:
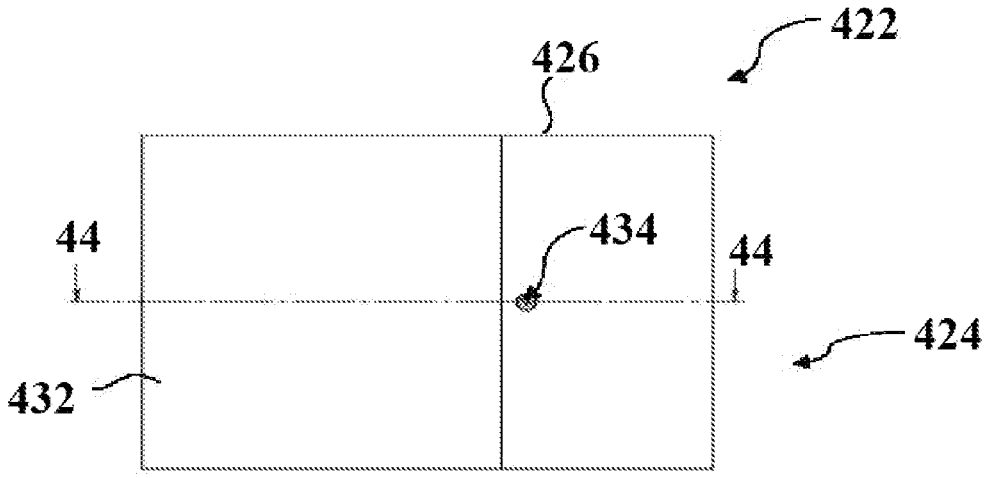
FIG. 43 is a schematic front view of a twenty-first embodiment support structure assembly.
Figure 44:
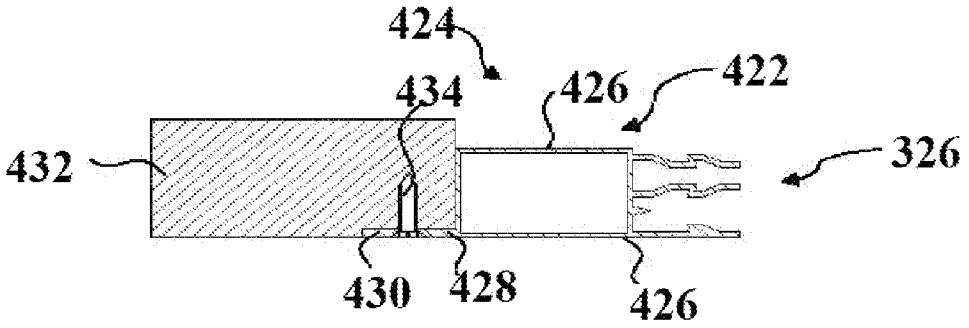
FIG. 44 is a cross-sectional view at the line 44-44 in FIG. 43.

FIG. 34 shows an embodiment support structure assembly 390 wherein double skin wall panels 322.1 and 322.2 of differing thickness are coupled via a thickness adapter 392. In this embodiment the wall panel 322.1 has a thickness of 150 mm and the wall panel 322.2 a wall thickness of 200 mm. The thickness adapter 392 is a 50 mm adapter and includes two sets of hermaphrodite panel coupling formations 326 which are configured for coupling with complemental hermaphrodite panel coupling formations 326 of the wall panels 322.1 and 322.2.

FIGS. 35 to 37 and FIGS. 38 and 39 respectively show two embodiment support structure assemblies 400 and 402. Each support structure assembly 400, 402 respectively includes a material adapter 404 having a material adapter body 406. Each material adapter body 406 includes a hermaphrodite panel coupling formation 326 (as described above) on one side, for attachment to a non-illustrated wall panel, and on another side a protruding adapter tongue 408 for location within an adapter groove 410 of an adjacent planar sheet wall material panel 412. In the support structure assembly 400 the tongue 408 is secured in position with a screw fastener 414 while the tongue 408 of the support structure assembly 402 is secured with a bolt fastener 416.

FIGS. 40 to 42 and FIGS. 43 and 44 respectively show two embodiment support structure assemblies 420 and 422. Each support structure assembly 420, 422 respectively includes a material adapter 424 having a material adapter body 426. Each material adapter body 426 includes a hermaphrodite panel coupling formation 326 (as described above) on one side, for attachment to a non-illustrated wall panel, and on another side a protruding adapter tongue 428 for location within an adapter rebate 430 of an adjacent planar sheet wall material panel 432. In the support structure assemblies 420, 422 the tongue 428 is secured in position with a screw fastener 434.

Figure 45:
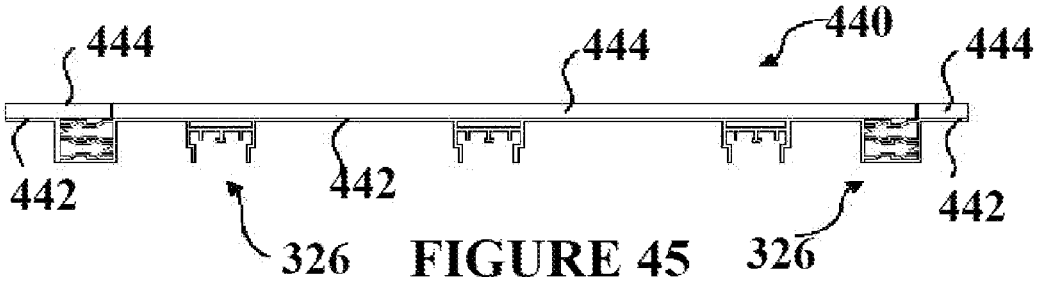
FIG. 45 is a schematic top view of a portion of a twenty-second embodiment support structure assembly.

FIG. 45 shows a support structure assembly 440 including a number of single skin wall panels 442 which are coupled via hermaphrodite panel coupling formations 326 (discussed above). The support structure assembly 440 further includes surface finishing sheets 444 which are adhered to the wall panels 442. It will of course be appreciated that the surface finishing sheets 444 could also be secured by mechanical fixing.

Figure 46:
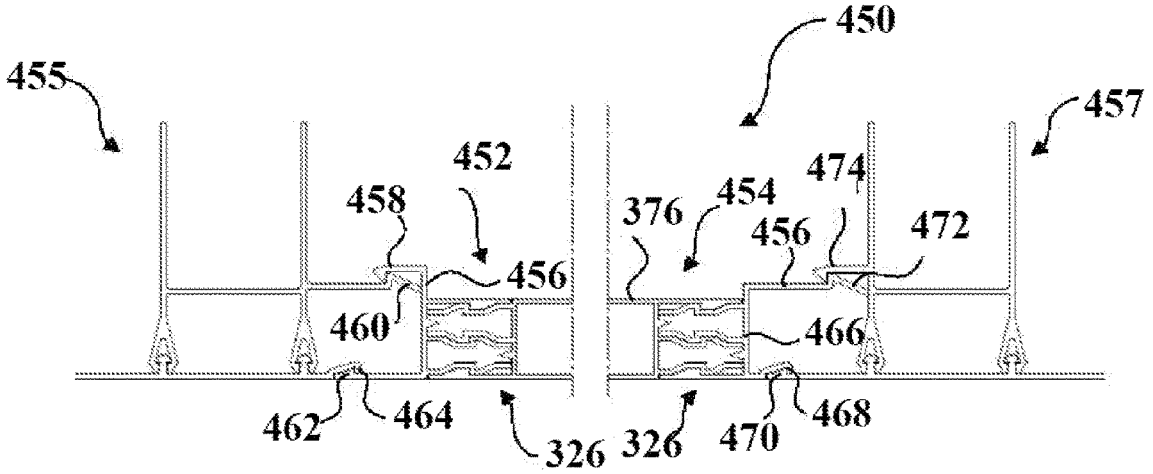
FIG. 46 is a schematic top view of a portion of a twenty-third embodiment support structure assembly.

Reference is above made to the Permaform formwork system. FIG. 46 illustrates a support structure assembly 450 with left-hand (LH) and right-hand (RH) adapters 452, 454 connected to Permaform formwork components 455, 457. The left-hand adapter 452 includes a connector 456 which includes a resilient catch member 458 adapted to snap-engage a corresponding catch member 460 of the Permaform component 455. The left-hand (LH) adapter 454 also includes a catch member 462 adapted to be snap-engaged by a resilient catch member 464 of the Permaform component 455.

The right-hand adapter 454 includes a connector 466 which includes a resilient catch member 468 adapted to snap-engage a corresponding catch member 470 of the Permaform component 457. The right-hand (RH) adapter 454 further includes a catch member 472 adapted to be snap-engaged by a resilient catch member 474 of the Permaform component 457. The adapters 452, 454 each include hermaphrodite panel coupling formations 326 (as described above) for coupling with corresponding hermaphrodite panel coupling formations 326 of double skin wall panels 376.

Figure 47:
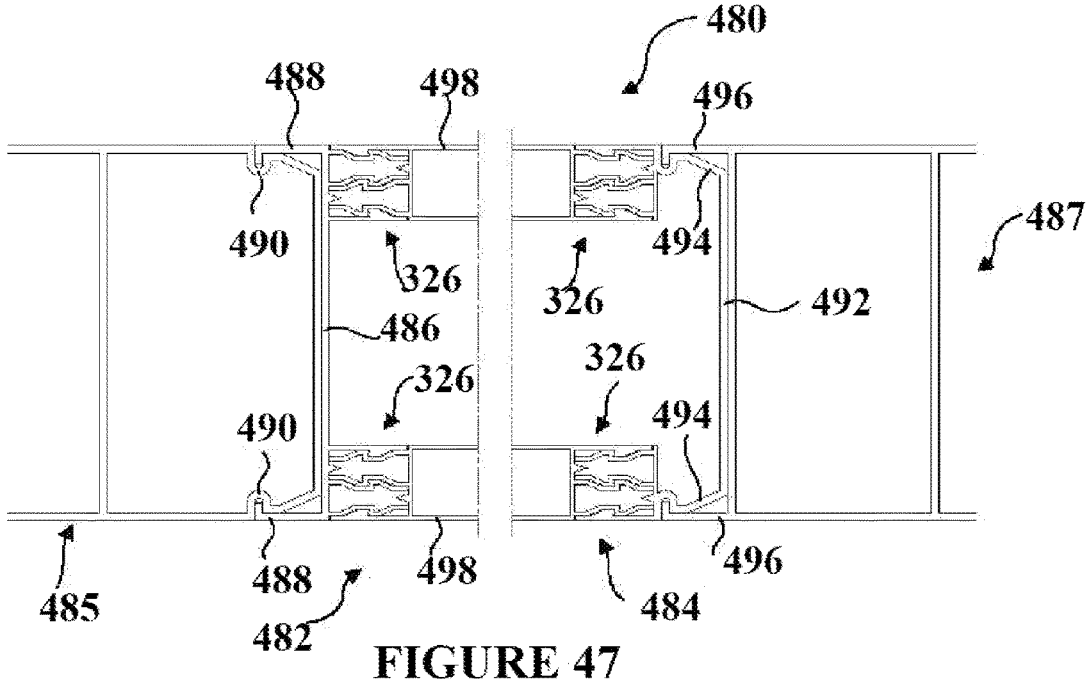
FIG. 47 is a schematic top view of a portion of a twenty-fourth embodiment support structure assembly.

Mention is above made to the Dincel formwork system. FIG. 47 illustrates a support structure assembly 480 with left-hand (LH) and right-hand (RH) adapters 482, 484 connected to Dincel formwork components 485, 487. The left-hand (LH) adapter 482 includes a connector 486 which includes resilient catch members 488 adapted to snap-engage corresponding catch members 490 of the Dincel component 485. The right-hand (RH) adapter 484, in turn, includes a connector 492 having catch members 494 adapted to be snap-engaged by resilient catch members 496 of the Dincel component 487. The adapters 482, 484 each include hermaphrodite panel coupling formations 326 (as described above) for coupling with corresponding hermaphrodite panel coupling formations 326 of double skin wall panels 498.

Figure 48:
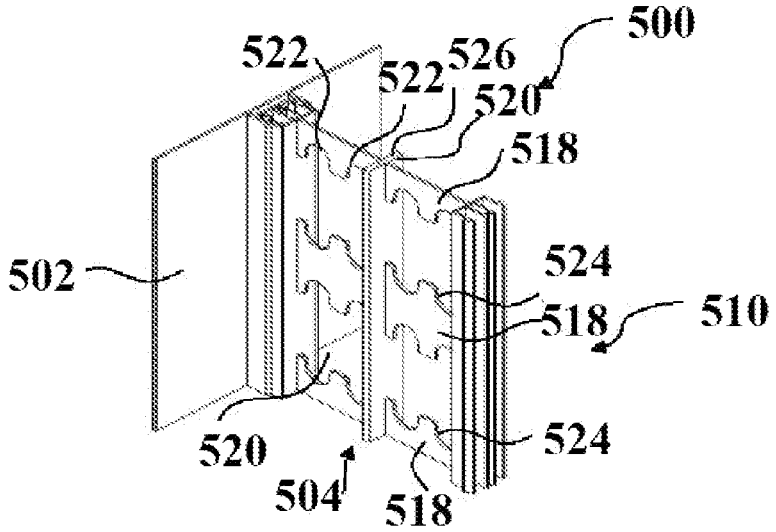
FIG. 48 is a schematic perspective view of a portion of a twenty-fifth embodiment support structure assembly.
Figure 49:
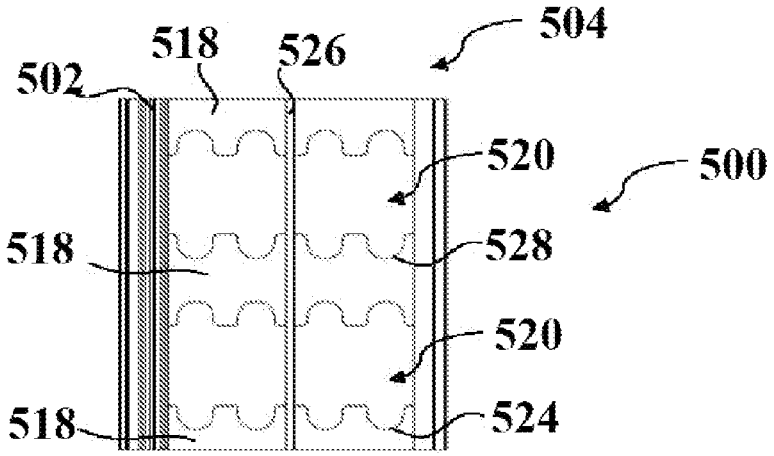
FIG. 49 is a schematic side view of the support structure assembly of FIG. 48.
Figure 50:
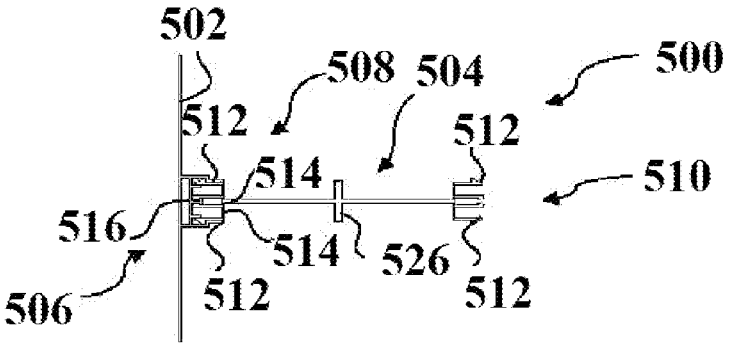
FIG. 50 is a schematic top view of the support structure assembly of FIG. 48.

FIGS. 48 to 50 show an embodiment support structure assembly 500. The support structure assembly 500 includes a single skin first wall panel 502 operatively associated with an opposing, spaced apart non-illustrated second wall panel. The support structure assembly 500 includes an extruded brace 504 operatively adapted to couple the first wall panel 502 to the non-illustrated second wall panel. The first wall panel 502 includes a brace coupling formation 506 operatively adapted to couple with a first wall panel coupling formation 508 of the brace 504. The second wall panel includes a non-illustrated brace coupling formation operatively adapted to couple with a second wall panel coupling formation 510 of the brace 504.

The first wall coupling formation 508 of the brace 504 includes (i) two outer protrusions 512, adapted to snap-engage the brace coupling formation 506 of the first wall panel 502, and (ii) two internal protrusions 514 operatively adapted to snap-engage a central protrusion 516 of the brace coupling formation 506 of the first wall panel 502. The embodiment brace 504 includes three elongate, substantially longitudinally co-extensive brace members 518. The brace members 518 are spaced apart to provide flow openings 520 to facilitate concrete flow during concrete pouring. The brace members 518 are pre-punched with holes 522 to facilitate concrete flow therethrough.

The brace members 518 include notched/undulating surfaces 524 operatively adapted to support non-illustrated reinforcing members, typically steel reinforcement bars, in desired positions. As shown, the brace 504 includes a transverse strengthening rib 526 for providing lateral strength/support.

Figure 51:
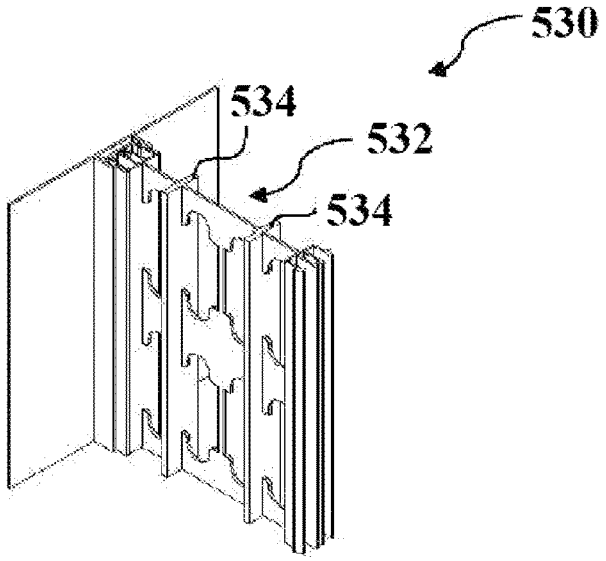
FIG. 51 is a schematic perspective view of a portion of a twenty-sixth embodiment support structure assembly.
Figure 52:
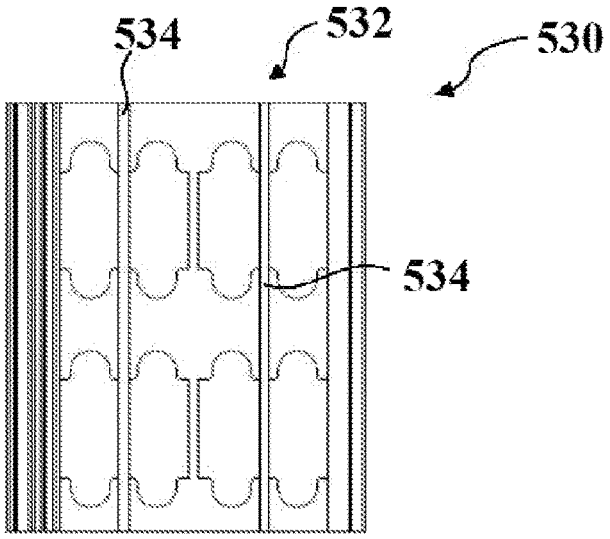
FIG. 52 is a schematic side view of the support structure assembly of FIG. 51.
Figure 53:
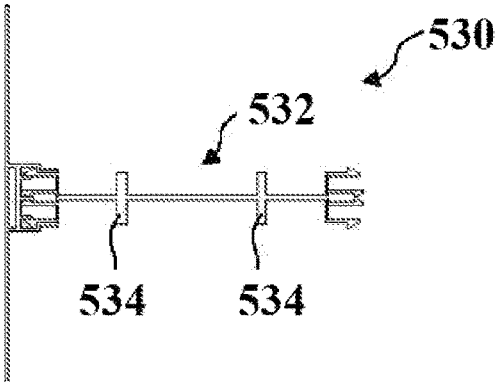
FIG. 53 is a schematic top view of the support structure assembly of FIG. 51.

FIGS. 51 to 53 show an embodiment support structure assembly 530. The support structure assembly 530 differs from the support structure assembly 500 of FIGS. 48 to 50 in that its brace 532 includes two spaced apart transverse strengthening ribs 534 for providing lateral strength/support.

Figure 54:
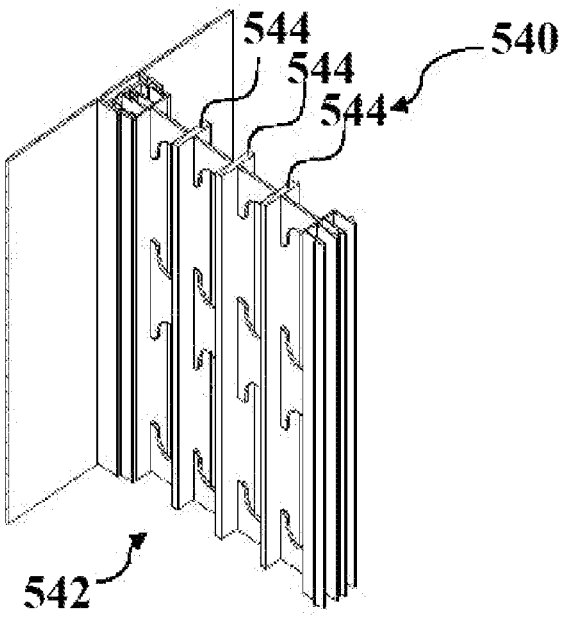
FIG. 54 is a schematic perspective view of a portion of a twenty-seventh embodiment support structure assembly.
Figure 55:
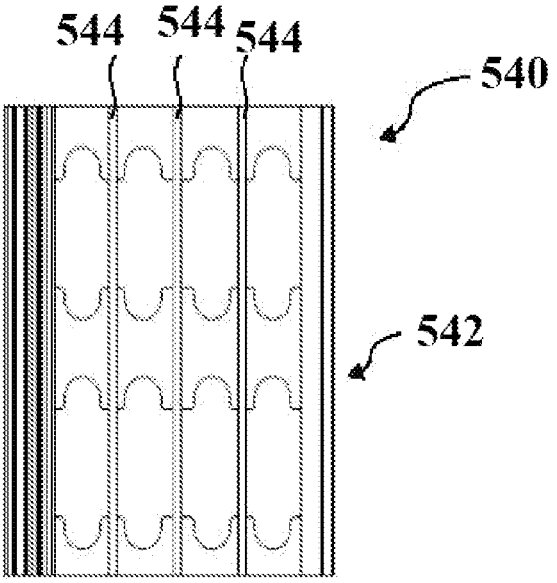
FIG. 55 is a schematic side view of the support structure assembly of FIG. 54.
Figure 56:
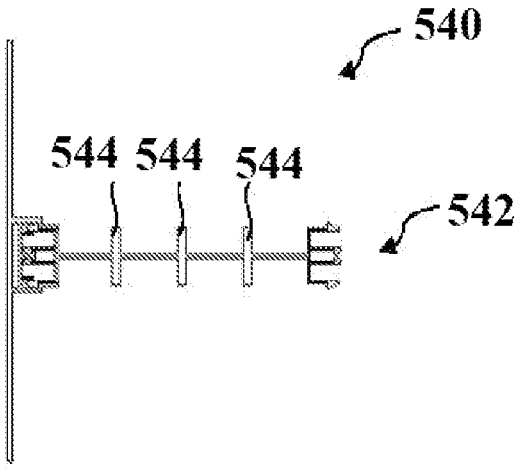
FIG. 56 is a schematic top view of the support structure assembly of FIG. 54.
Figure 57:
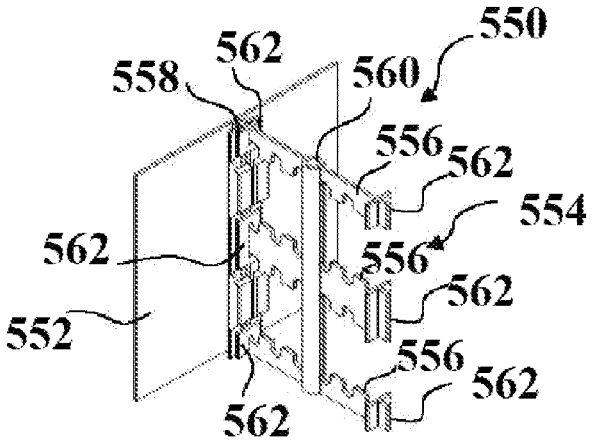
FIG. 57 is a schematic perspective view of a portion of a twenty-eighth embodiment support structure assembly.
Figure 58:
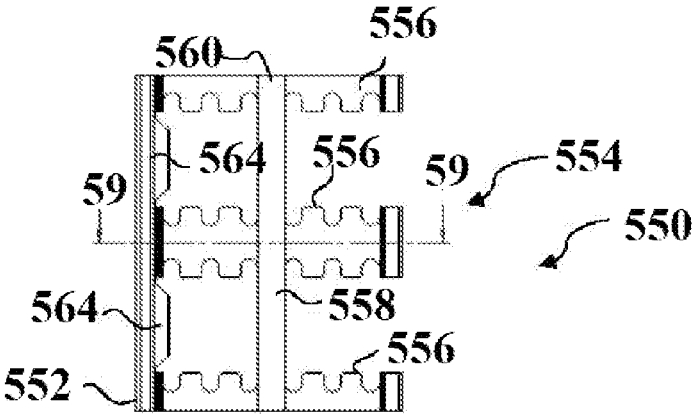
FIG. 58 is a schematic side view of the support structure assembly of FIG. 57.
Figure 59:
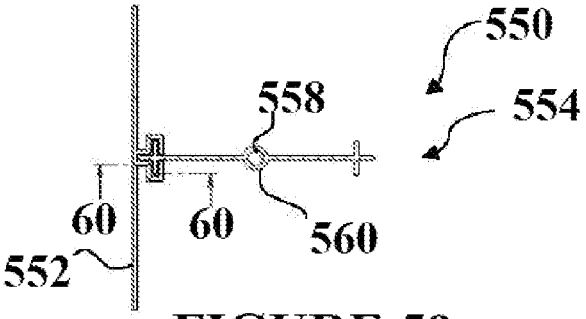
FIG. 59 is a cross-sectional view at the line 59-59 in FIG. 58.
Figure 60:
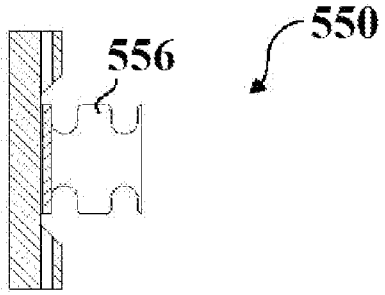
FIG. 60 is a cross-sectional view at the line 60-60 in FIG. 59.

FIGS. 54 to 56 show an embodiment support structure assembly 540. The support structure assembly 540 differs from the support structure assembly 530 in that its brace 542 includes three spaced apart transverse strengthening ribs 544.

FIGS. 57 to 60 show an embodiment support structure assembly 550 having a single skin first wall panel 552 operatively associated with an opposing, spaced apart non-illustrated second wall panel. The support structure assembly 550 includes an extruded brace 554 operatively adapted to couple the first wall panel 552 to the non-illustrated second wall panel. The embodiment brace 554 includes three elongate, substantially longitudinally co-extensive brace members 556. The brace members 556 support a co-extruded vertical cross-brace member 558 including a reinforcing body 560, here in the form of a steel reinforcing bar, to provide vertical strength. The brace members 556 include slide members 562, in the form of high strength T-junctions, operatively adapted to be slidably received within slidable housings 564 to enable assembly with short vertical travel movement to facilitate relative quick assembly.

Figure 61:
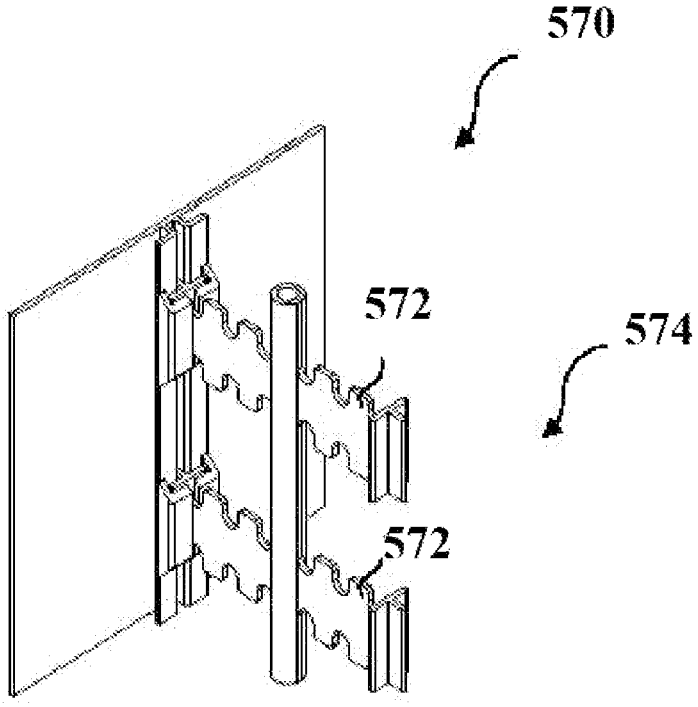
FIG. 61 is a schematic perspective view of a portion of a twenty-ninth embodiment support structure assembly.
Figure 62:
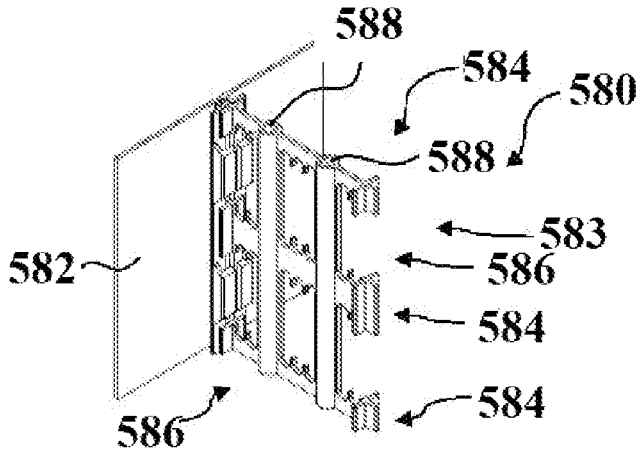
FIG. 62 is a schematic perspective view of a portion of a thirtieth embodiment support structure assembly.
Figure 63:
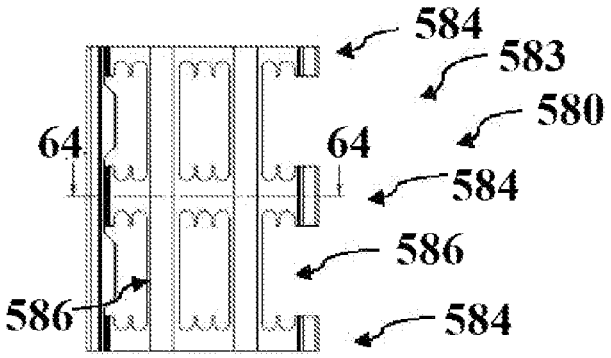
FIG. 63 is a schematic side view of the support structure assembly of FIG. 62.
Figure 64:
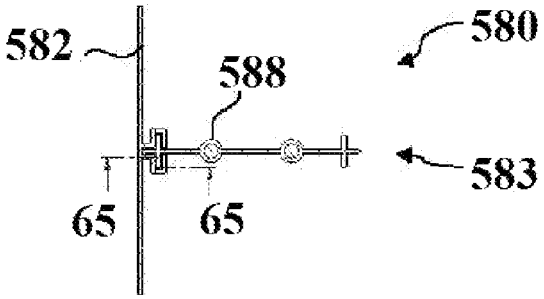
FIG. 64 is a cross-sectional view at the line 64-64 in FIG. 63.
Figure 65:
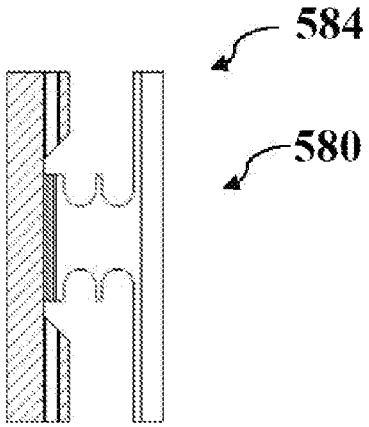
FIG. 65 is a cross-sectional view at the line 65-65 in FIG. 64.
Figure 66:
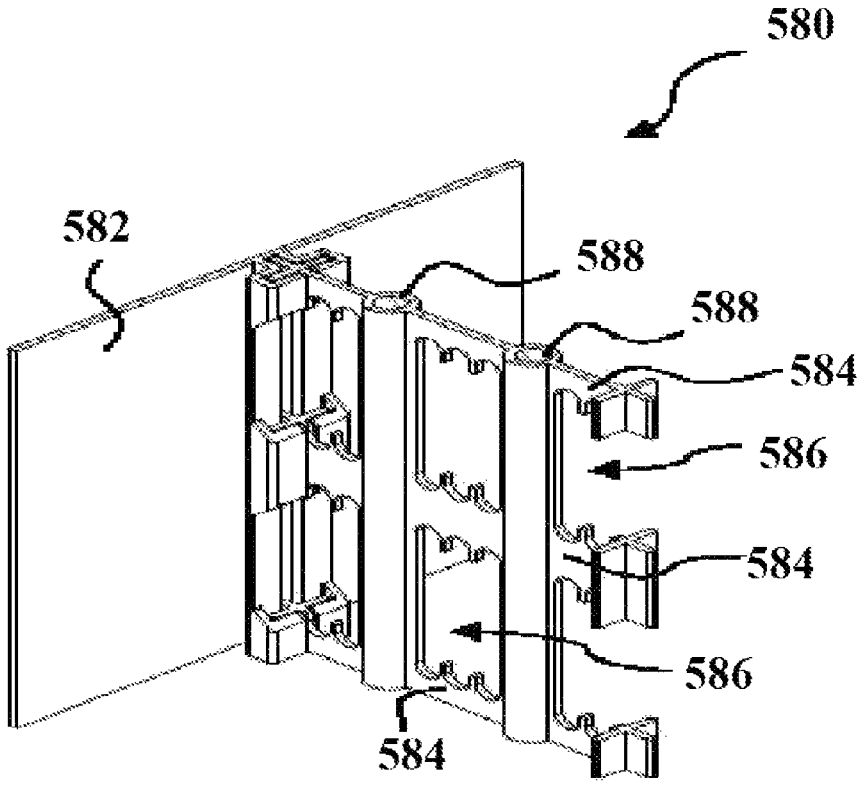
FIG. 66 is a schematic perspective view of a portion of a thirty-first embodiment support structure assembly.
Figure 67:
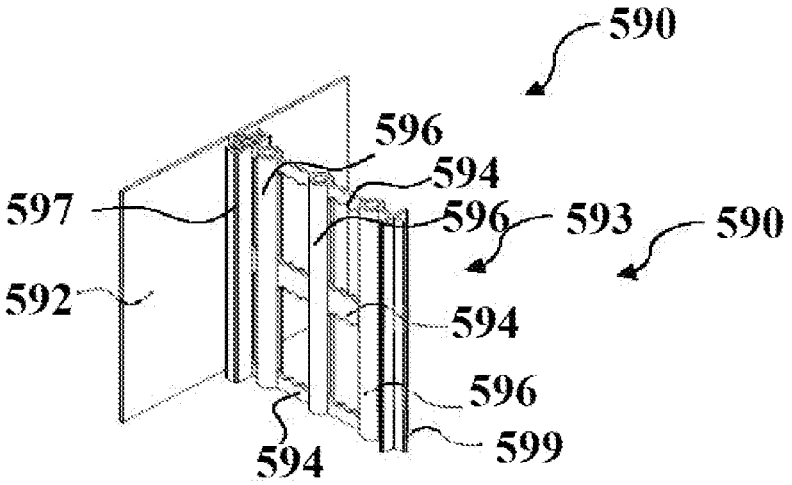
FIG. 67 is a schematic perspective view of a portion of a thirty-second embodiment support structure assembly.
Figure 68:
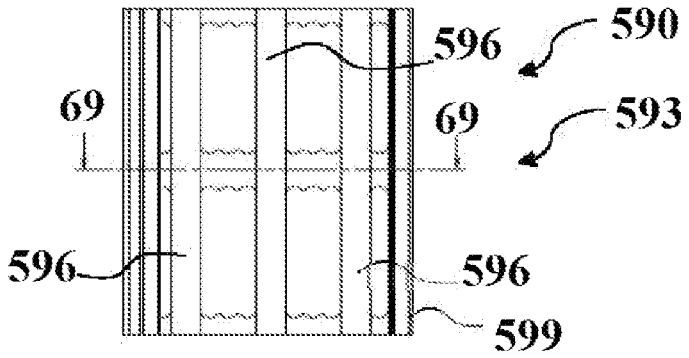
FIG. 68 is a schematic side view of the support structure assembly of FIG. 67.
Figure 69:
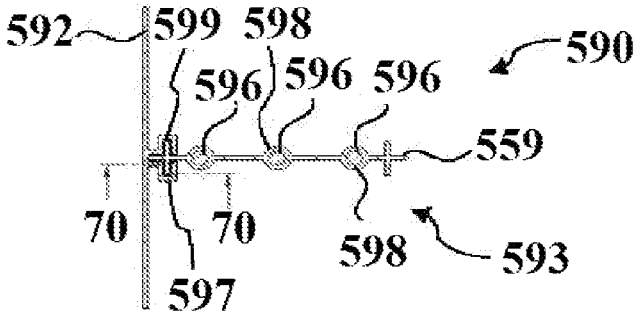
FIG. 69 is a cross-sectional view at the line 69-69 in FIG. 68.
Figure 70:
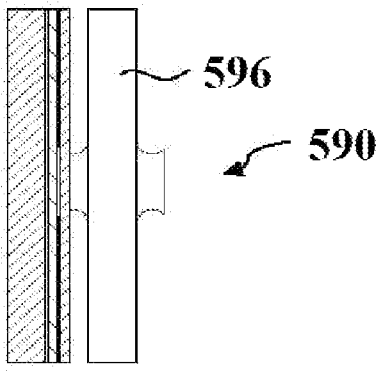
FIG. 70 is a cross-sectional view at the line 70-70 in FIG. 69.
Figure 71:
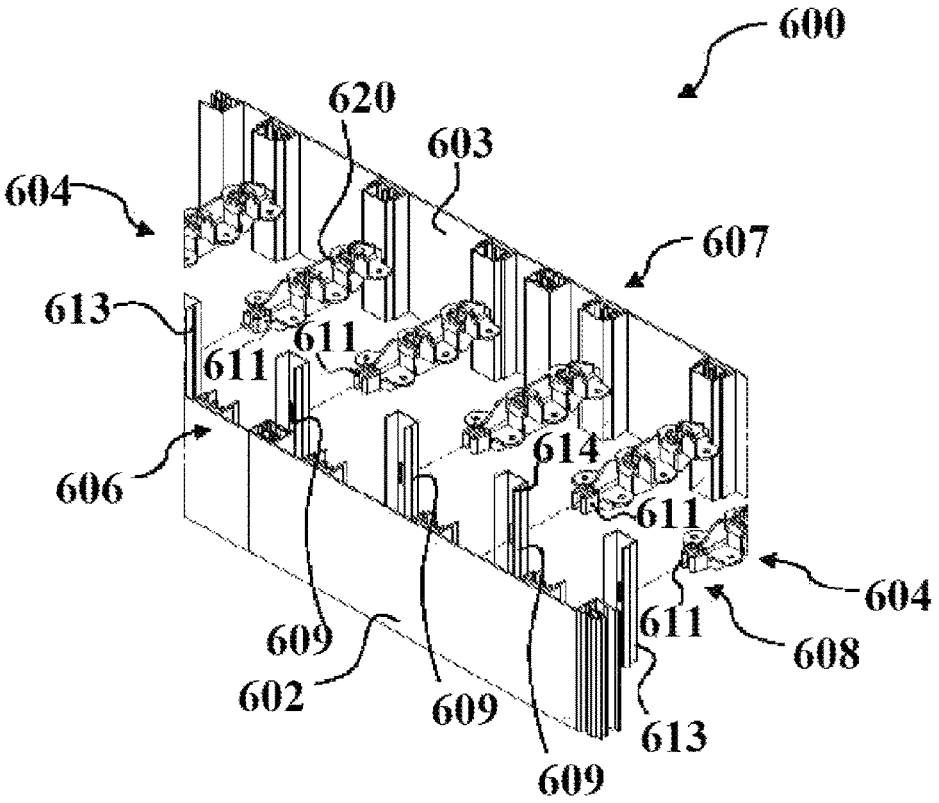
FIG. 71 is a schematic perspective view of a portion of a thirty-third embodiment support structure assembly.
Figure 72:
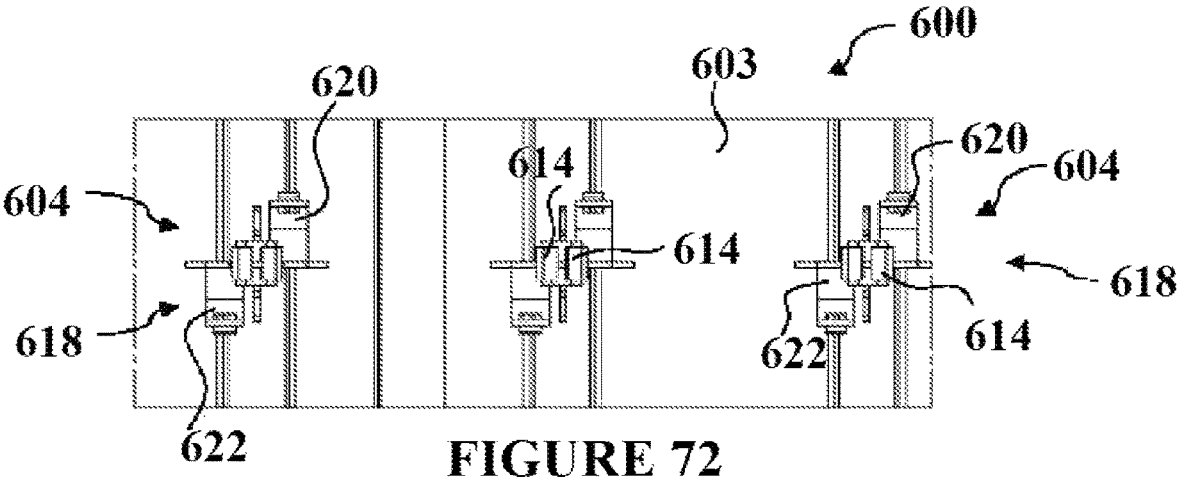
FIG. 72 is a schematic front view of the support structure assembly of FIG. 71.
Figure 73:
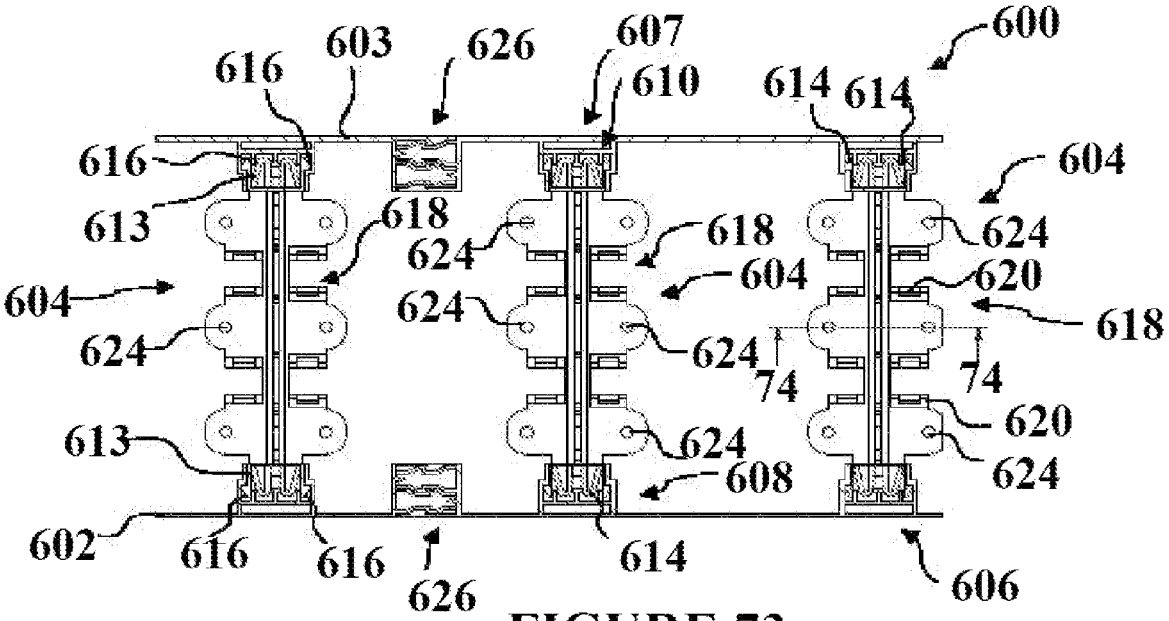
FIG. 73 is a schematic top view of a portion of a thirty-fourth embodiment support structure assembly.
Figure 74:
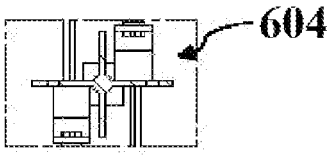
FIG. 74 is a cross-sectional view at the line 74-74 in FIG. 73.
Figure 75:
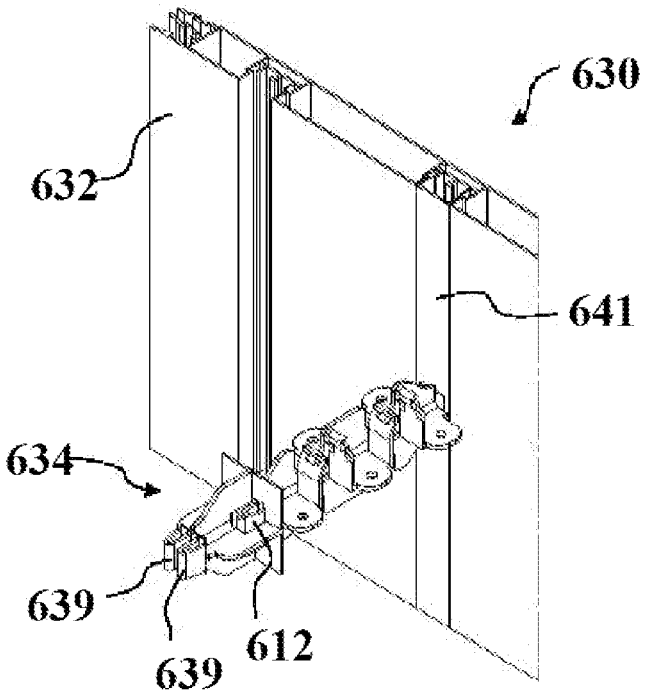
FIG. 75 is a schematic perspective view of a portion of a thirty-fifth embodiment support structure assembly.
Figure 76:
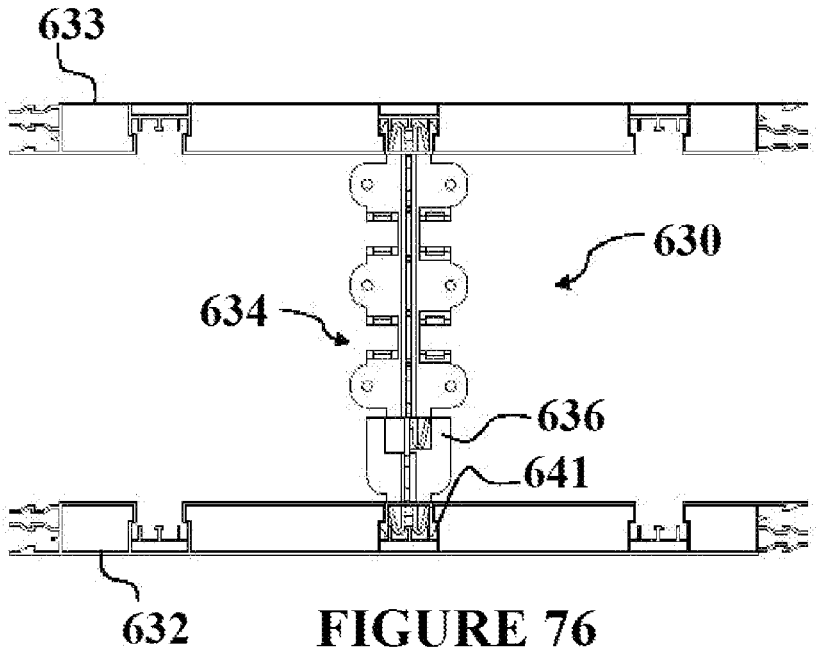
FIG. 76 is a further schematic top view of another portion of the thirty-fifth embodiment support structure assembly.
Figure 77:
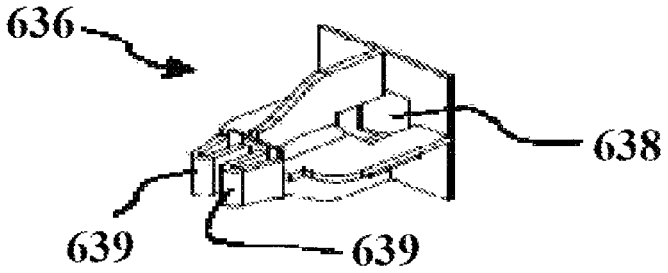
FIG. 77 is a schematic perspective view of an extension member for use with a brace shown in FIG. 76.
Figure 78:
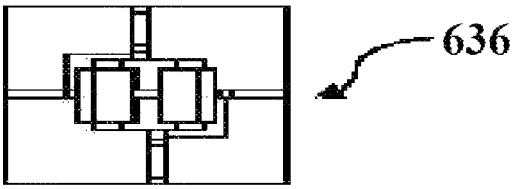
FIG. 78 is a schematic front view of the extension member of FIG. 77.
Figure 79:
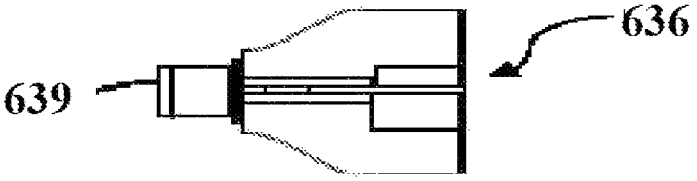
FIG. 79 is a schematic side view of the extension member of FIG. 77.
Figure 80:
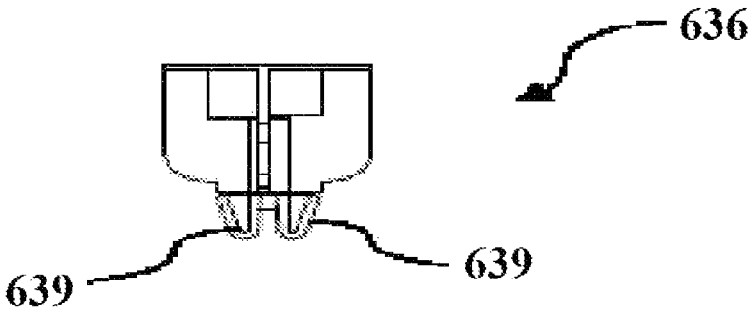
FIG. 80 is a schematic top view of the extension member of FIG. 77.

FIG. 61 shows a support structure assembly 570 similar to the support structure 560 of FIGS. 57 to 60, but with two brace members 572, rather than three forming a brace 574.

FIGS. 62 to 66 show another support structure assembly 580, which operates in a manner similar to the support structure assembly 550 of FIGS. 57 to 60. In particular, the support structure assembly 580 includes a single skin first wall panel 582 operatively associated with an opposing, spaced apart non-illustrated second wall panel. The support structure assembly 580 includes a brace 583 having three extruded brace members 584 operatively adapted to couple the first wall panel 582 to the non-illustrated second wall panel. The support structure assembly 580 includes two vertical cross-braces members 586, each with a steel reinforcing bar 588. This is different to the single vertical cross brace member 560 of the support structure assembly 550.

FIGS. 67 to 70 show a support structure assembly 590 including a single skin first wall panel 592 operatively associated with an opposing, spaced apart non-illustrated second wall panel. The support structure assembly 590 includes a brace 593 having three extruded braces members 594 operatively adapted to couple the first wall panel 592 to the non-illustrated second wall panel. The support structure assembly 590 includes three vertical cross-brace members 596, each with a steel reinforcing bar 598. The brace members 594 are attached to a slider member 599 operatively adapted to be slidably received by a housing 597.

FIGS. 71 to 74 show an embodiment support structure assembly 600. The support structure assembly 600 includes a single skin first wall panel 602 operatively associated with an opposing, spaced apart single skin second wall panel 603. The support structure assembly 600 includes moulded braces 604 operatively adapted to couple the first wall panel 602 to the second wall panel 603. The first wall panel 602 includes a brace coupling formation 606 operatively adapted to couple with a first wall panel coupling formation 608 of a corresponding brace 604. The second wall panel 603 includes a brace coupling formation 607 operatively adapted to couple with a second wall panel coupling formation 610 of the brace 604.

The first and second panel wall coupling formations 608, 610 of each brace 604 include two resilient protrusions 611. The protrusions 611 are adapted to pass through punched protrusion slots 609 of a brace holding member 613 of the first and second brace coupling formations 606, 607. As the protrusions 611 are resilient they will snap-engage a respective brace holding member 613 after passing through the protrusion slot 609. The brace holding members 613, in turn, each include protrusions 614 operatively adapted to be slid into position along outer sides 616 of the first and second brace coupling formations 606, 607. In this embodiment the brace holding member 613 is provided in the form of an elongate channel.

The braces 604 include reinforcement bar holding formations 618. Each reinforcement bar holding formation 618 comprises two upper opposing resilient holding members 620 as well as two lower opposing resilient retainer members 622 to snap-engage non-illustrated reinforcement bars. It will be noted that each brace 604 includes three sets of bar holding formations 618. With the three sets of reinforcement bar holding formations 618 of the braces 604 in register, six non-illustrated reinforcement bars can be held securely in a laterally spaced apart orientation between the first and second wall panels 602, 603 during installation and concrete pour.

It is pointed out that in conventional formwork systems reinforcement bars can easily jump out of position during fill and vibration agitation for air removal. The embodiment reinforcement bar holding formations 618 seek to ameliorate this problem. The braces 604 further include stabiliser holder holes 624 for accepting non-illustrated side stabilisers which serve to provide the braces 604 with side stabilisation. In this embodiment the side stabilisers will typically be provided in the form of bent U-rods produced from steel.

It is further pointed out that the support structure assembly 600 facilitates factory selection of brace spacing and factory or on-site brace sub-assembly. It is also pointed out that the first and second wall panels 602, 603 are connected to adjacent wall panels via hermaphrodite coupling formations 626 which operate as described above.

FIGS. 75 to 80 show an embodiment support structure assembly 630. The support structure assembly 630 includes a double skin first wall panel 632 operatively associated with an opposing, spaced apart double skin second wall panel 633. The support structure assembly 630 includes moulded braces 634 operatively adapted to couple the first wall panel 632 to the second wall panel 633 in manner similar to that discussed for the support structure assembly 600 of FIGS. 71 to 74. The brace 634 of the support structure assembly 630 includes the brace 604 of the support structure 600 as well as an extension adapter 636 attached thereto. The extension adapter 636 includes holes 638 (FIG. 77) through which the protrusions 611 of the brace 634 pass to snap-engage the extension adapter 636. The extension adapter 636 in turn, includes protrusions 639 that are adapted to pass through non-illustrated punched protrusion slots of a brace holding member 641 to be held in a snap-fit in a manner similar to that described above in relation to the brace member 613 of the support structure assembly 600.

The support structure assembly 630 enables construction of a thicker wall than that of the support structure assembly 600. For even thicker walls further extension adapters 636 can be employed to connect multiple braces 634.

Figure 81:
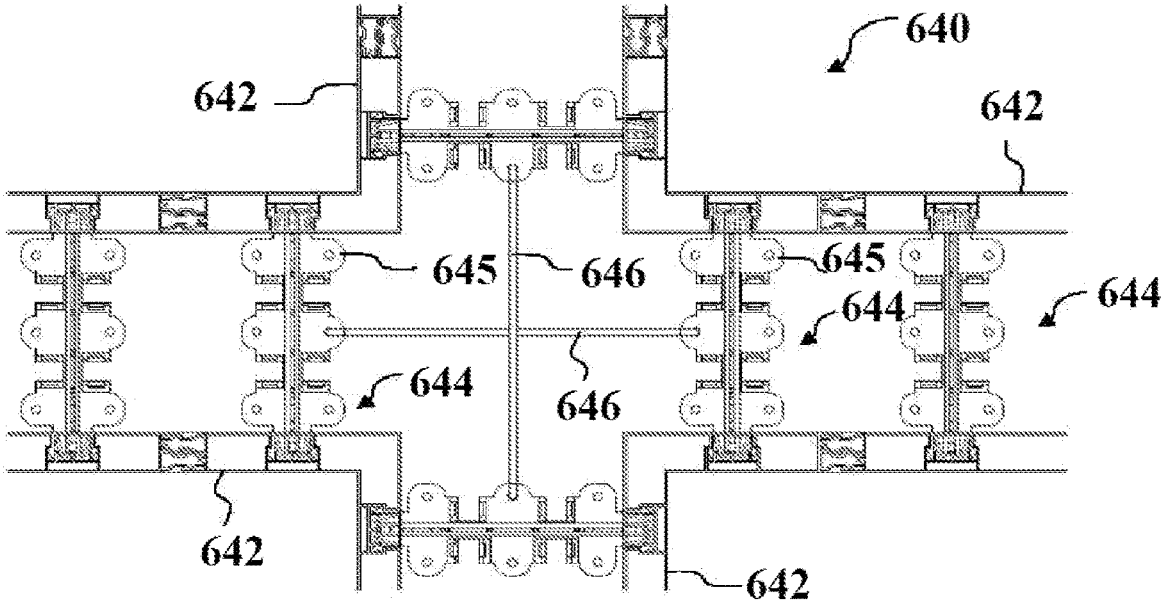
FIG. 81 is a schematic top view of a thirty-sixth embodiment support structure assembly.
Figure 82:
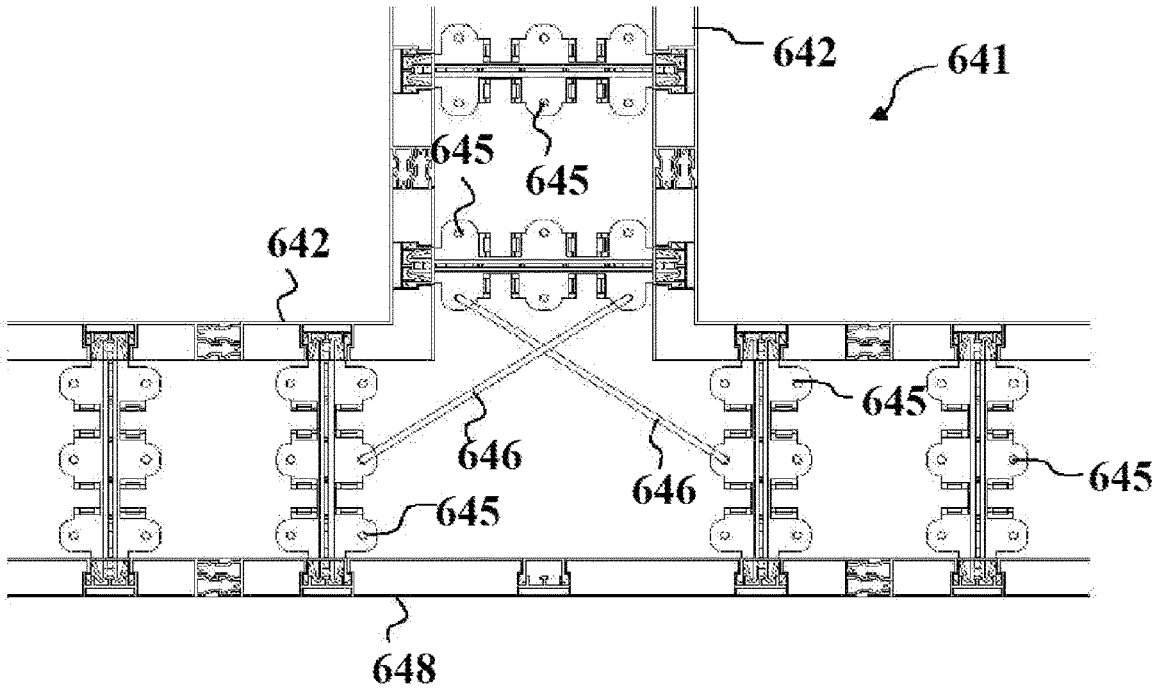
FIG. 82 is a schematic top view of a thirty-seventh embodiment support structure assembly.

FIGS. 81 and 82 show embodiment support structure assemblies 640, 641 including a plurality of embodiment double skin internal corner wall panels 642 coupled with braces 644. The braces 644 include stabiliser holder holes 645 for accepting side stabilisers 646 in the form of bent U-rods. In FIG. 81 the side stabilisers 646 are oriented at rights angles in a four-way corner to support the wall panels 642. FIG. 82 shows the side stabilisers 646 configured at a different orientation so that they are located in alternative stabiliser holder holes 645 to support a three-way corner having internal corner wall panels 642 and a straight wall panel 648. The support structure assemblies 640, 641 can also be provided in the form of non-illustrated single skin wall panels or strippable skin wall panels.

Figure 83:
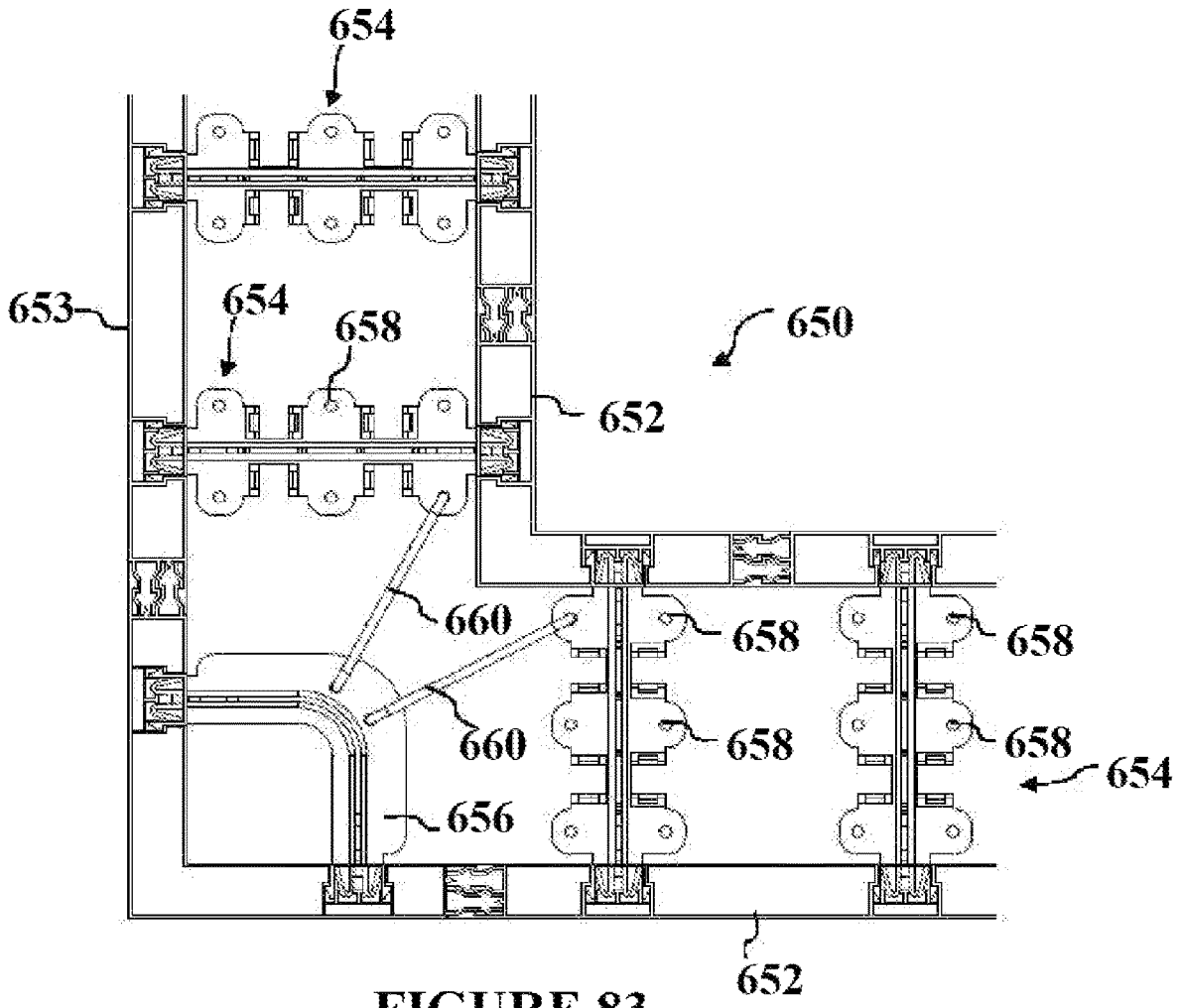
FIG. 83 is a schematic top view of a thirty-eighth embodiment support structure assembly.

FIG. 83 shows an embodiment support structure assembly 650 including a double skin internal corner wall panel 652 and a double skin outer corner panel 653 coupled with longitudinally extending braces 654 and a curved corner brace 656. The braces 654, 656 include stabiliser holder holes 658 for accepting side stabilisers 660 in the form of bent U-rods. Having a curved corner brace 656 enables the wall panels 652 to be connected at 90 degrees as shown to facilitate support of the wall panels 652, 653. The support structure assembly 650 can also be provided in the form of non-illustrated single skin wall panels or strippable skin wall panels.

Figure 84:
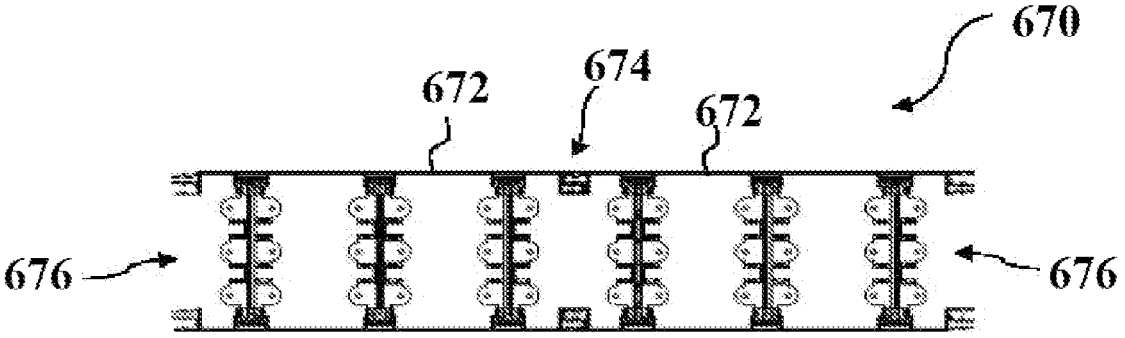
FIG. 84 is a schematic top view of a thirty-ninth embodiment support structure assembly.
Figure 85:
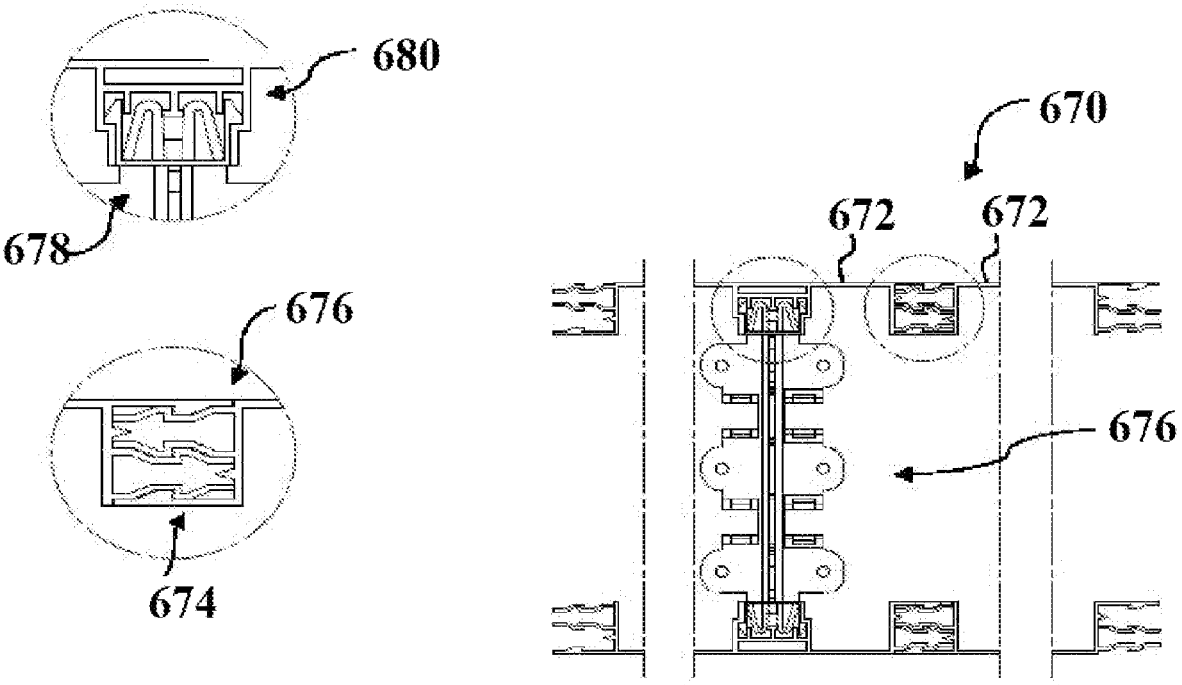
FIG. 85 is a schematic enlarged top view of a portion of the support structure assembly of FIG. 84.

FIGS. 84 and 85 show an embodiment support structure assembly 670 having single skin wall panels 672 which are coupled via internal hermaphrodite panel coupling formations 674. The support structure assembly 670 further includes transverse braces 676 for connecting opposing wall panels 672. The braces 676 include wall coupling formations 678 adapted to snap-engage corresponding brace coupling formations 680 of the wall panels 672. It is pointed out that the hermaphrodite panel coupling formations 674, wall coupling formations 678 and brace coupling formations 680 are configured to prevent the ingress of poured concrete.

Figure 86:
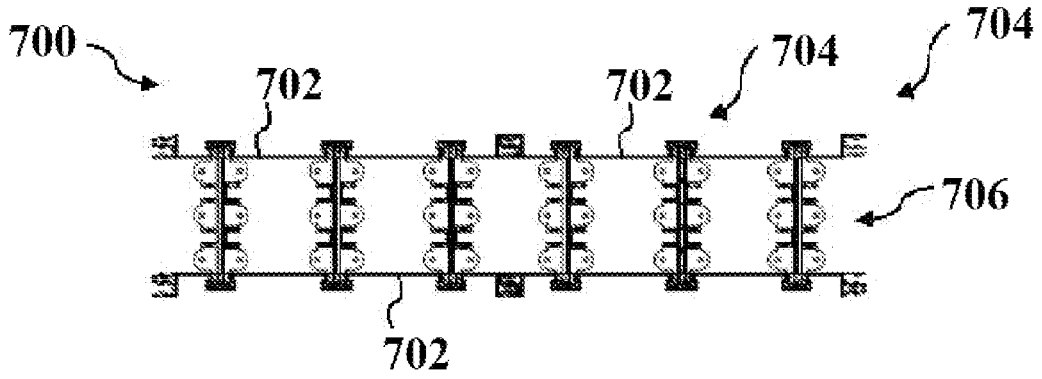
FIG. 86 is a schematic top view of a thirty-ninth embodiment support structure assembly.
Figure 87:
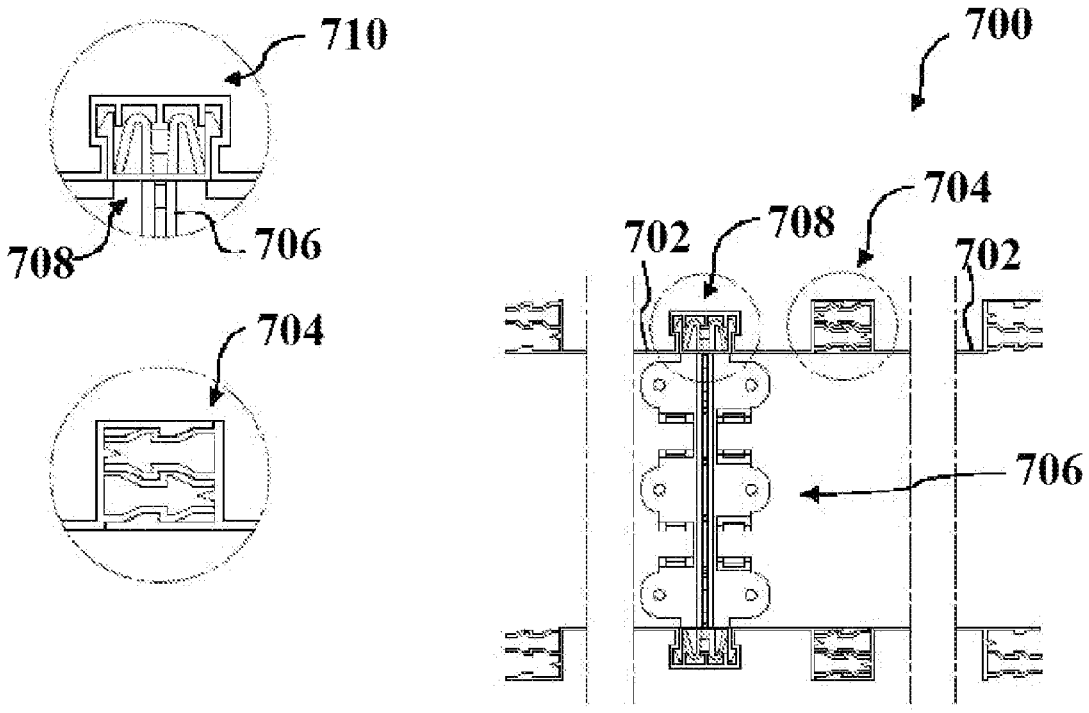
FIG. 87 is a schematic enlarged top view of a portion of the support structure assembly of FIG. 86.
Figure 88:
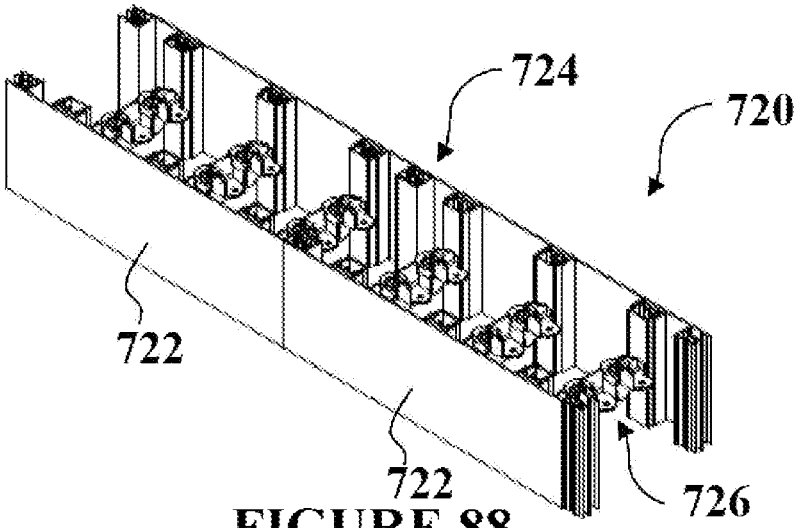
FIG. 88 is a schematic perspective view of a fortieth embodiment support structure assembly.
Figure 89:
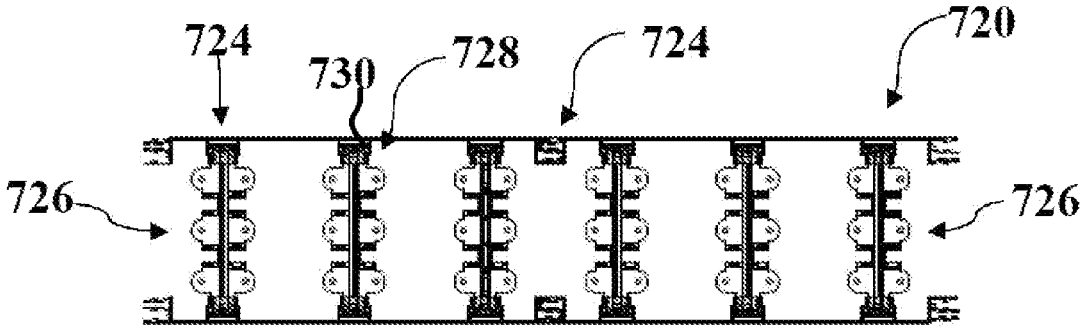
FIG. 89 is a schematic top view of the support structure assembly of FIG. 88.
Figure 90:
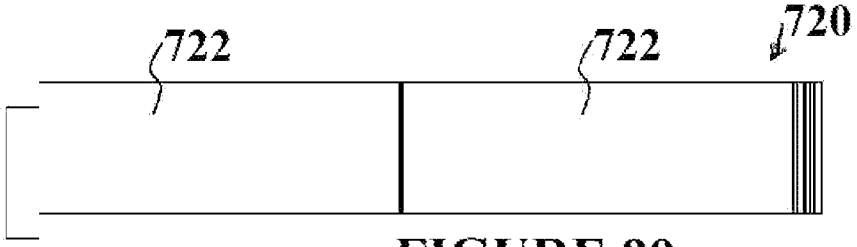
FIG. 90 is a schematic front view of the support structure assembly of FIG. 88.
Figure 91:
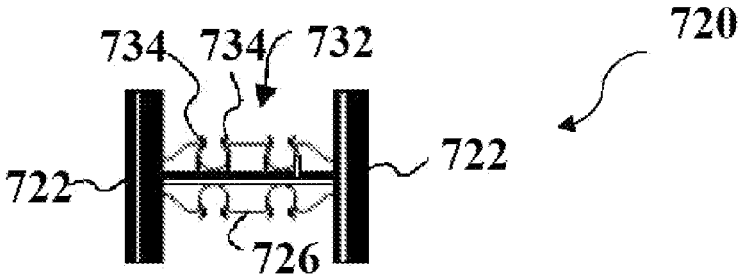
FIG. 91 is a schematic side view of the support structure assembly of FIG. 88.

FIGS. 86 and 87 show an embodiment support structure assembly 700 having single skin strippable wall panels 702 which are coupled via external hermaphrodite panel coupling formations 704. The support structure assembly 700 further includes transverse braces 706 for connecting opposing wall panels. The braces 706 include wall coupling formations 708 adapted to snap-engage corresponding brace coupling formations 710 of the wall panels 702. It is pointed out that the hermaphrodite panel coupling formations 704, wall coupling formations 708 and brace coupling formations 710 are configured to prevent the ingress of poured concrete. This feature enables ease of removal of the strippable wall panels 702 so as to create a flat surface without concrete protrusions. It is further pointed out that during the stripping process, portions of the braces 706 will be cut away to leave a small series of visible cross-shaped portions from the braces on the wall concrete wall surface.

FIGS. 88 to 91 show an embodiment support structure assembly 720 having single skin wall panels 722 which are coupled via internal hermaphrodite panel coupling formations 724. The support structure assembly 720 further includes transverse braces 726 for connecting opposing wall panels 722. The braces 726 include wall coupling formations 728 adapted to snap-engage corresponding brace coupling formations 730 of the wall panels 722 in the manner described above. The braces 726 include reinforcement bar holding formations 732. Each reinforcement bar holding formation 732 includes two opposing resilient holding members/clips 734 to snap-engage non-illustrated reinforcement bars. The reinforcement bar holding formations 732 serve for holding the reinforcement bars in position during wall construction and concrete pour. It is pointed out that the reinforcement bar holding formations 732 are shaped in such a manner that the braces 726 have no "up" or "down" side.

Figure 92:
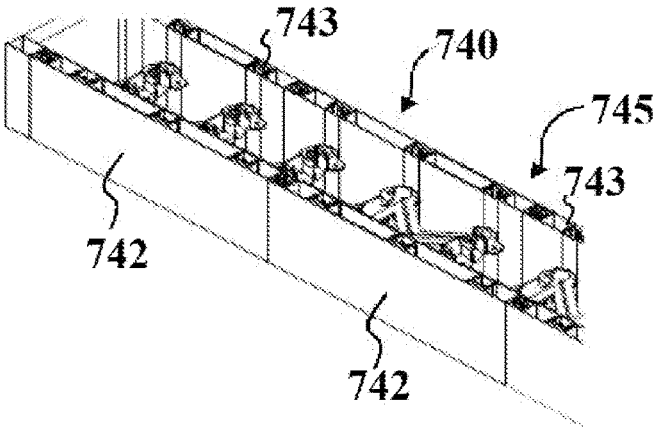
FIG. 92 is a schematic perspective view of a forty-first embodiment support structure assembly.
Figure 93:
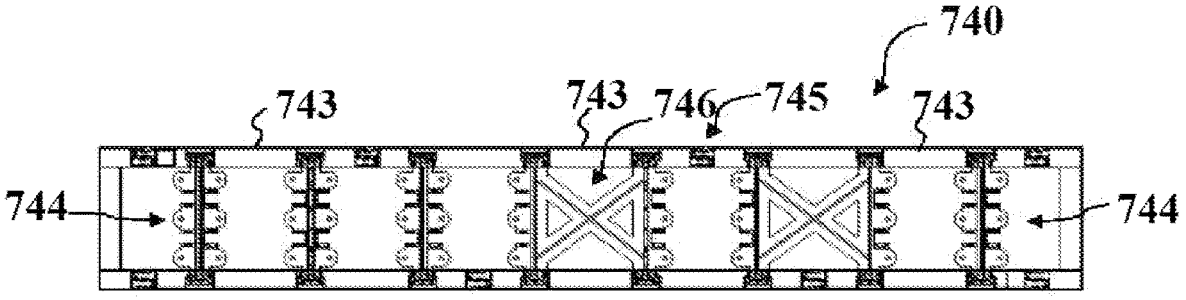
FIG. 93 is a schematic top view of the support structure assembly of FIG. 92.
Figure 94:
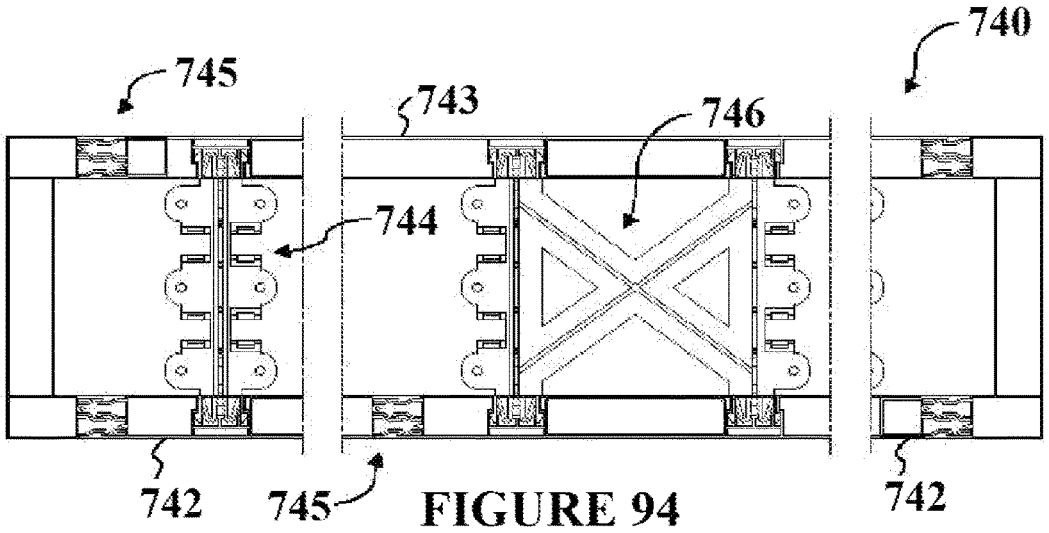
FIG. 94 is a schematic enlarged top view of a portion of the support structure assembly of FIG. 92.

FIGS. 92 to 94 show an embodiment support structure assembly 740. The support structure assembly 740 includes double skin first wall panels 742 operatively associated with opposing, spaced apart double skin second wall panels 743.

Adjacent wall panels 742, 743 are coupled via hermaphrodite panel coupling formations 745 in the manner described above.

The support structure assembly 740 further includes braces 744 operatively adapted to couple the first wall panels 742 to corresponding opposing second wall panels 743 in manner as described above. The support structure assembly 740, unlike previous embodiments, includes a X-shaped double brace 746. The double brace 746 serves to enhance longitudinal wall panel stability during concrete pour and cure, without compromising wet concrete flow.

Figure 95:
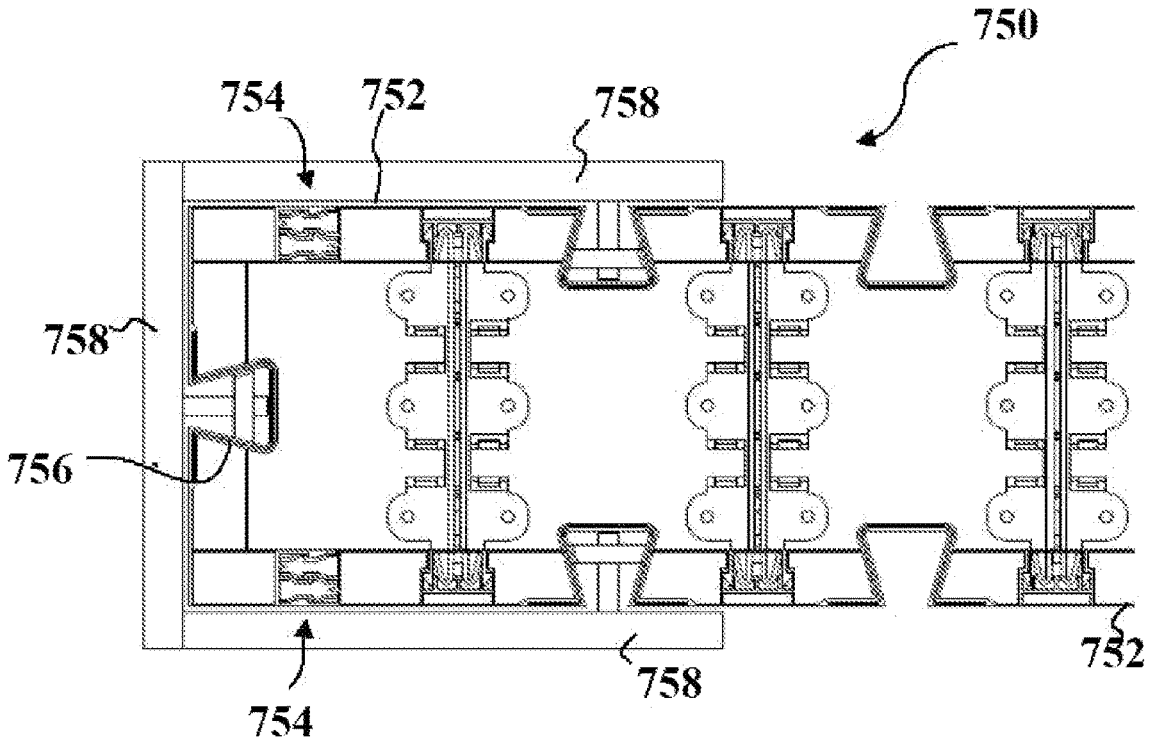
FIG. 95 is a schematic top view of a forty-second embodiment support structure assembly.

FIG. 95 shows an embodiment support structure assembly 750. In this embodiment the support structure assembly 750 is employed for constructing formwork to receive poured concrete. The support structure assembly 750 includes substantially planar, double skin polymer wall panels 752 which are connected to adjacent wall panels 752 via hermaphrodite panel coupling formations 754 in the manner previously described. The wall panels 752 include substantially C-shaped channels 756. The channels 756 are employed to attach external sheet material 758, such as stone, to the support structure assembly 750.

Figure 96:
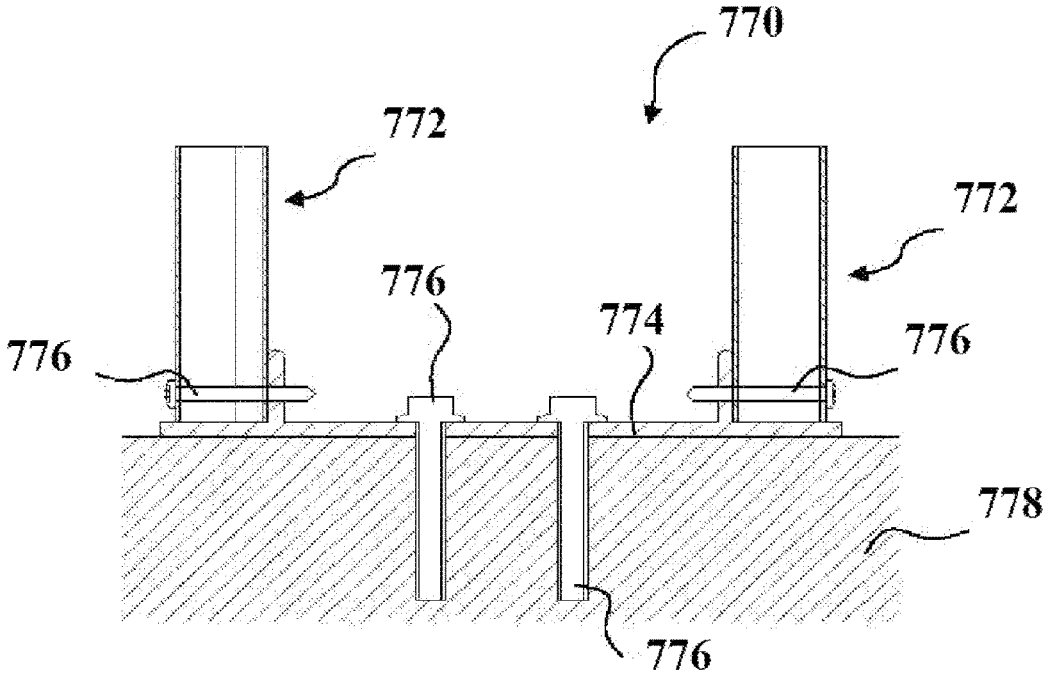
FIG. 96 is a schematic top view of a forty-third embodiment support structure assembly.

FIG. 96 shows an embodiment support structure assembly 770 having two opposing double skin polymer wall panels 772. The wall panels 772 are seated on and fastened to a wall bottom channel 774 with fasteners 776. The channel 774, in turn, is fastened to an under slab or previously cast concrete wall 778.

Figure 97:
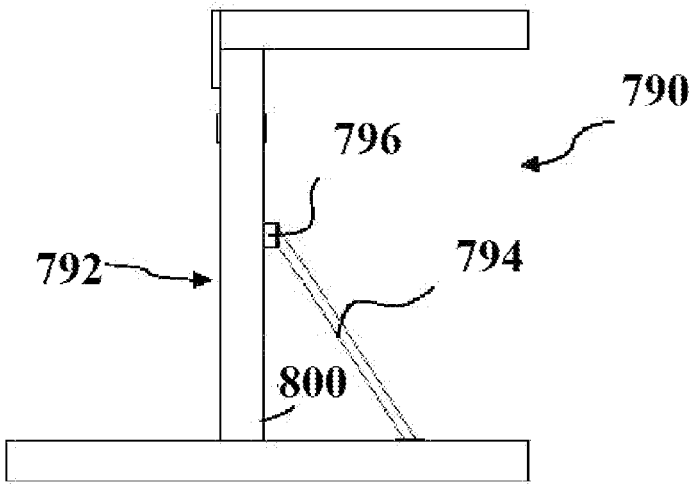
FIG. 97 is a schematic front view of a forty-fourth embodiment support structure assembly.
Figure 98:
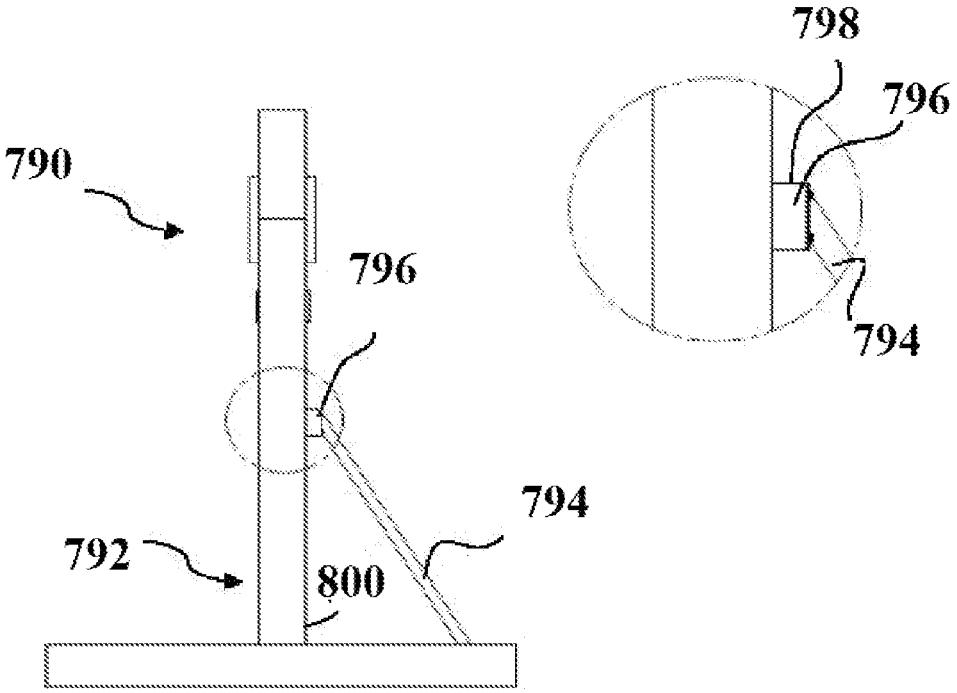
FIG. 98 is a schematic side view of the support structure assembly of FIG. 97.
Figure 99:
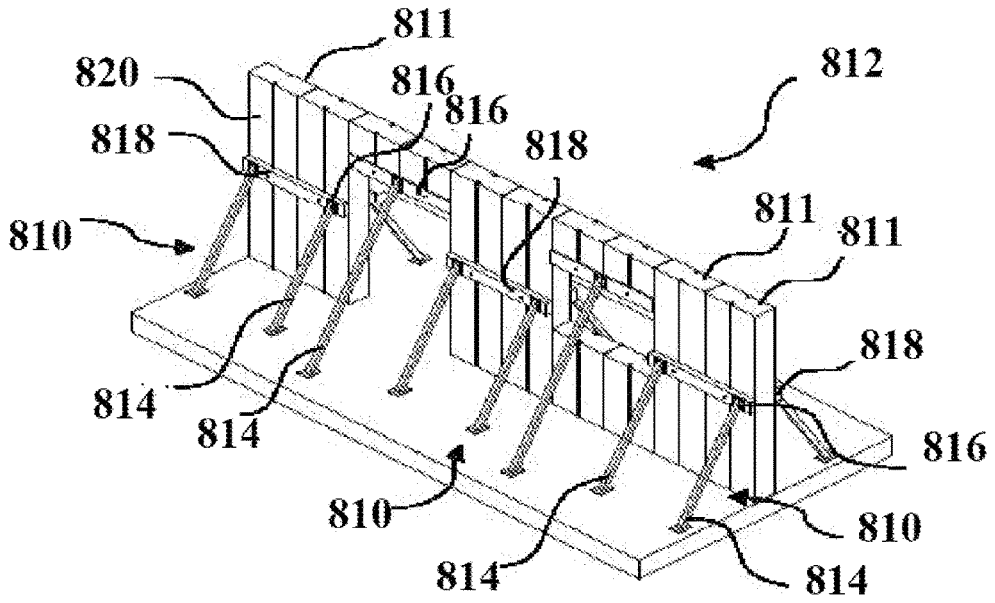
FIG. 99 is a schematic perspective side view of a forty-fifth embodiment support structure assembly.
Figure 100:
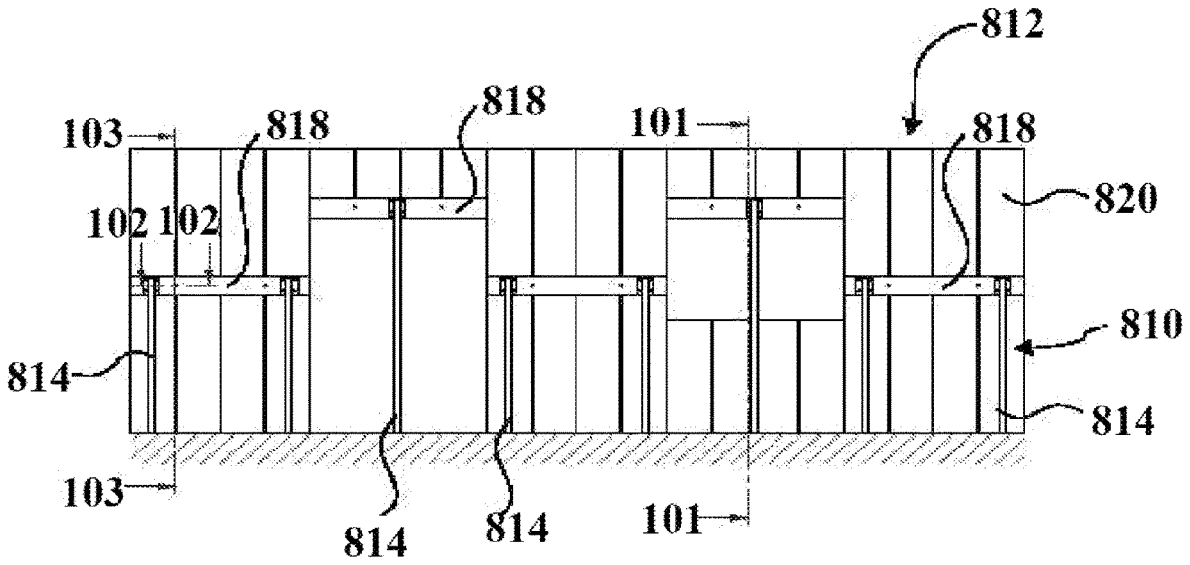
FIG. 100 is a schematic front view of the support structure assembly of FIG. 99.
Figure 101:
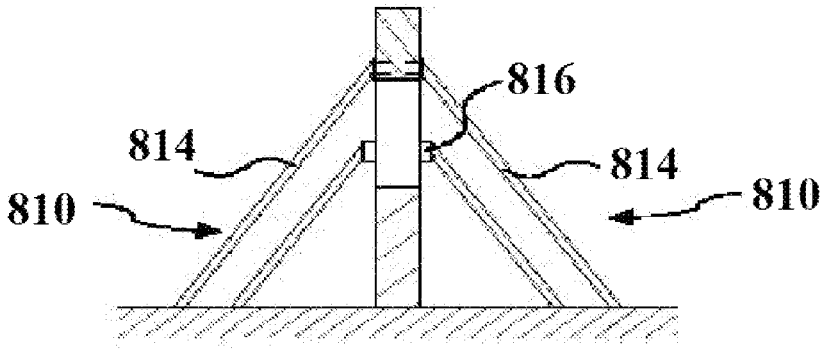
FIG. 101 is a cross-sectional view at the line 101-101 in FIG. 100.
Figure 102:
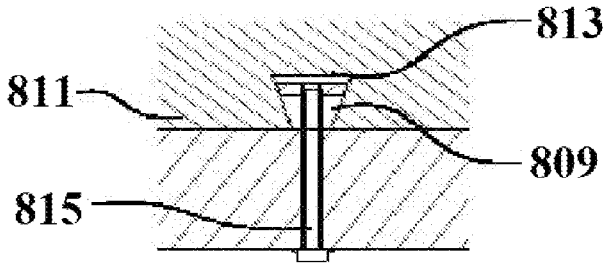
FIG. 102 is a cross-sectional view at the line 102-102 in FIG. 100.
Figure 103:
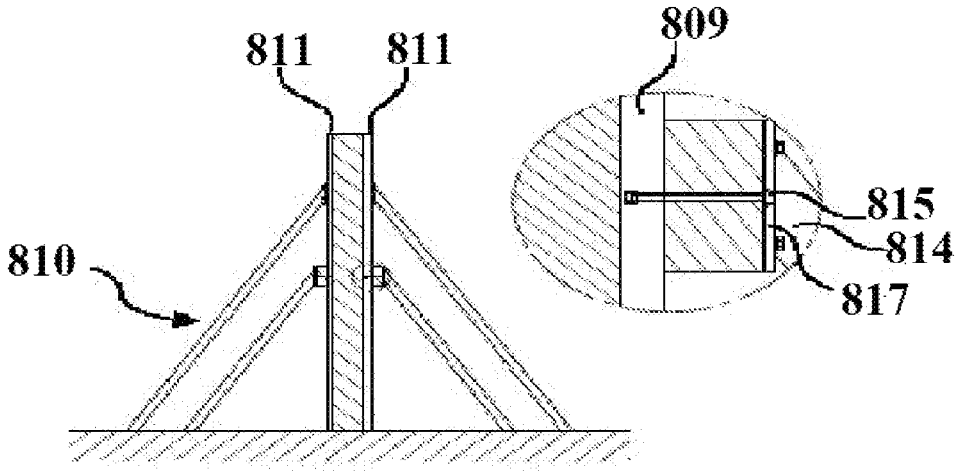
FIG. 103 is a cross-sectional view at the line 103-103 in FIG. 100.
Figure 104:
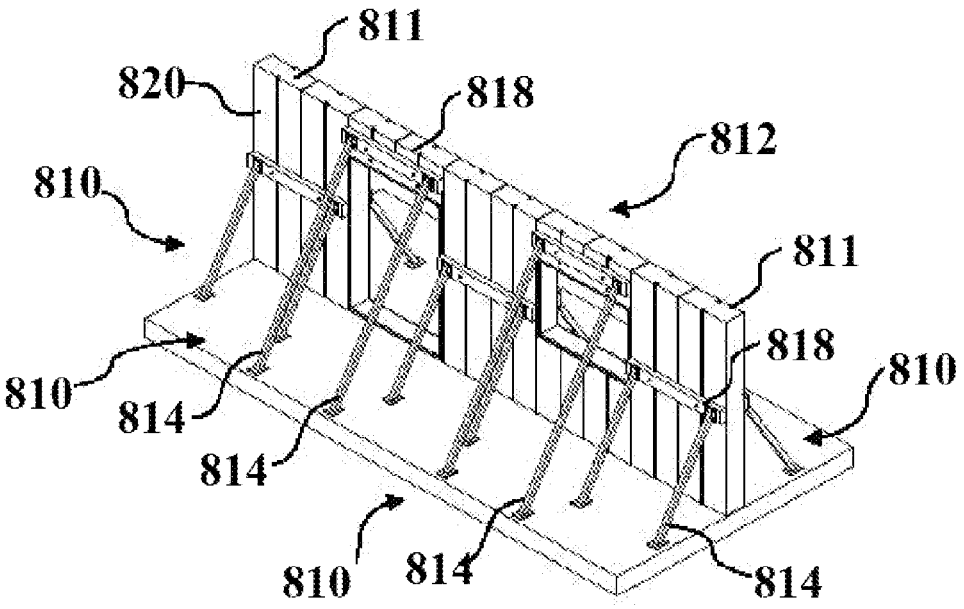
FIG. 104 is a schematic perspective side view of a forty-sixth embodiment support structure assembly.
Figure 105:
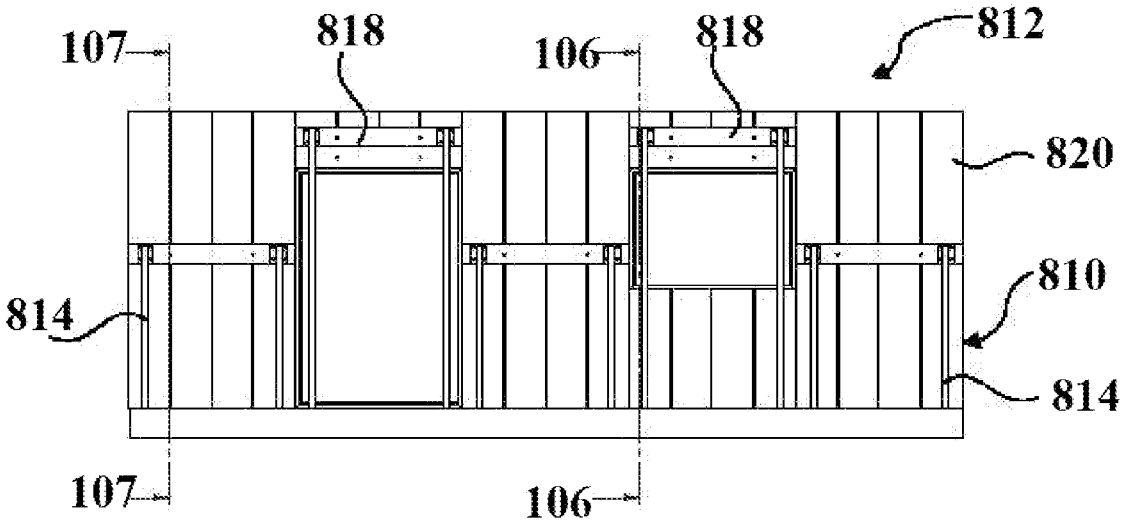
FIG. 105 is a schematic front view of the support structure assembly of FIG. 104.
Figure 106:
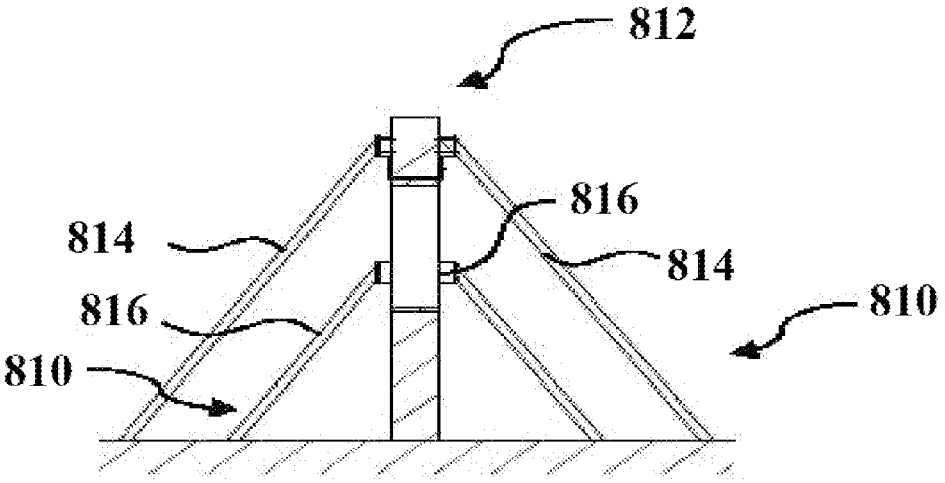
FIG. 106 is a cross-sectional view at the line 106-106 in FIG. 105.
Figure 107:
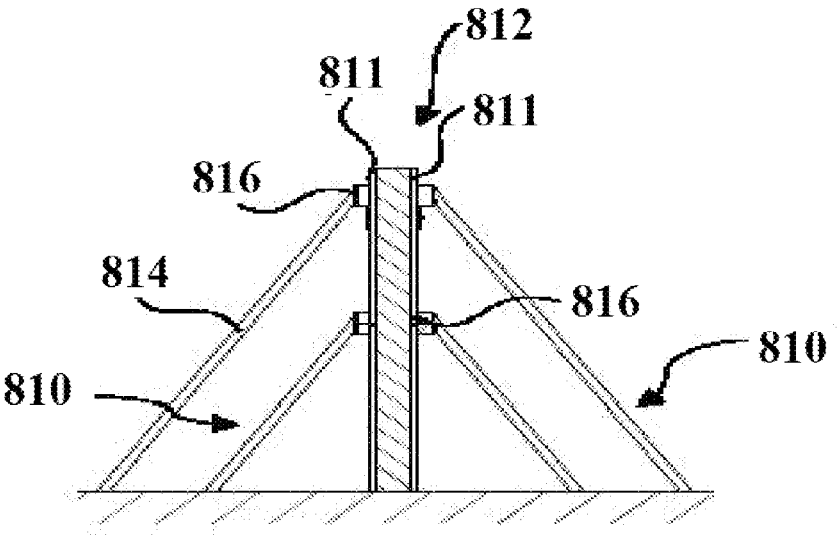
FIG. 107 is a cross-sectional view at the line 107-107 in FIG. 106.

FIGS. 97 and 98 show an embodiment support structure assembly 790 providing a wall external bracing to reinforce a wall 792 while concrete is poured and until the concrete is cured. The support structure assembly 790 includes a re-usable steel brace 794 which includes welded end plates 796 for fastening to timber 798 mounted horizontally across a face 800 of the wall 792.

FIGS. 99 to 107 show a plurality of embodiment support structure assemblies 810 providing wall external bracing to reinforce a wall 812 while concrete is poured and until the concrete is cured. Each support structure assembly 810 includes two re-usable steel braces 814 which include welded end plates 816 for fastening to timber 818 mounted horizontally across a face 820 of the wall 812. Each wall 812 includes wall panels 811 with C-shaped channels 809. The C-shaped channels 809 each include a locking member 813 which is attached to an actuator 815, here in the form of a bolt. Each actuator 815, in turn, is attached to a steel brace 814 via a steel sheet 817. The steel braces 814 are thus secured to the wall 812 via a C-channel 809 and corresponding locking member 813 and actuator 815. The operation of the C-channel 809 in combination with the locking member 813 and actuator 815 is similar to that described with reference to the operation of the channel 14 and its locking member 40 and actuator 42 in FIG. 1.

Figure 108:
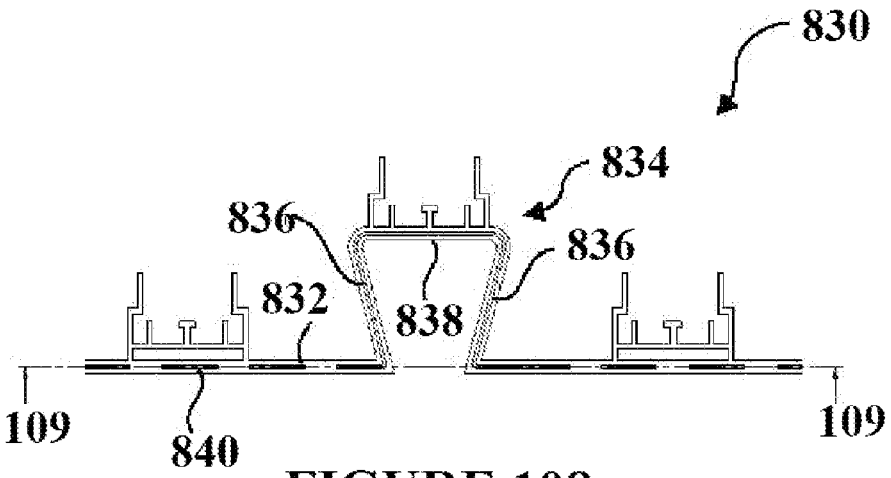
FIG. 108 is a schematic top view of a forty-seventh embodiment support structure assembly.
Figure 109:
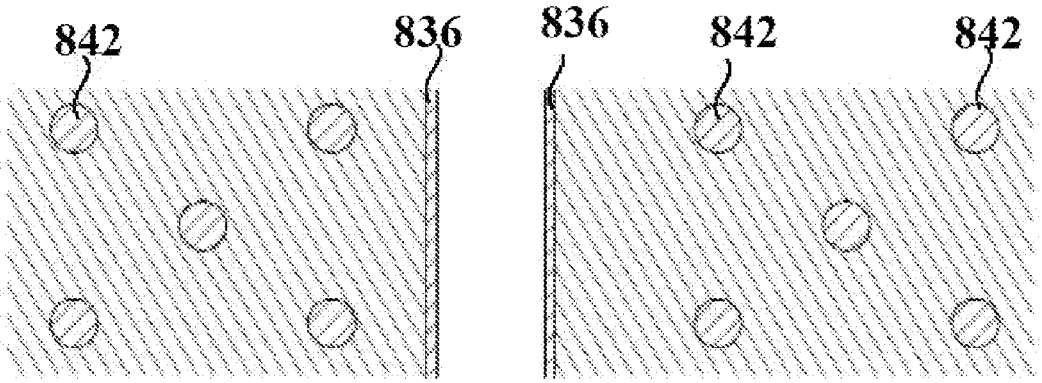
FIG. 109 is a schematic cross-sectional view at the line 109-109 in FIG. 108.

FIGS. 108 and 109 show a portion of an embodiment support structure assembly, generally indicated with the reference numeral 830. The support structure assembly 830 includes a substantially planar, single skin wall panel 832. In use the first wall panel 832 is associated with a non-illustrated opposing, spaced apart second wall panel. The wall panel 832 includes a channel 834 which is substantially C-shaped. The channel 834 has two spaced apart channel walls 836 connected via a transverse channel base 838. The wall panel 832, including the channel 834, is reinforced with a roll-formed steel reinforcing 844. The embodiment wall panel is produced by extruding polyvinylchloride (PVC), or another suitable plastic, over the roll formed steel reinforcing 840. The reinforcing 840 includes perforations 842 to ensure bonding of the PVC from one side of the reinforcing 840 to its other side.

Figure 110:
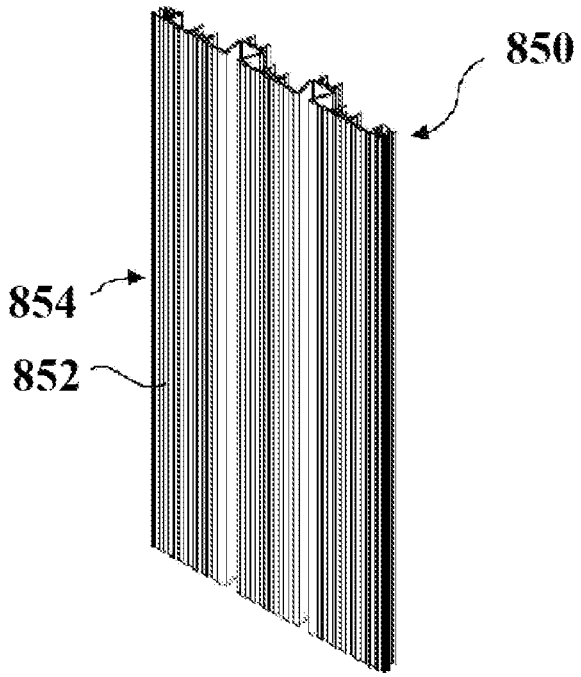
FIG. 110 is a schematic perspective view of a forty-eighth embodiment support structure assembly.
Figure 111:
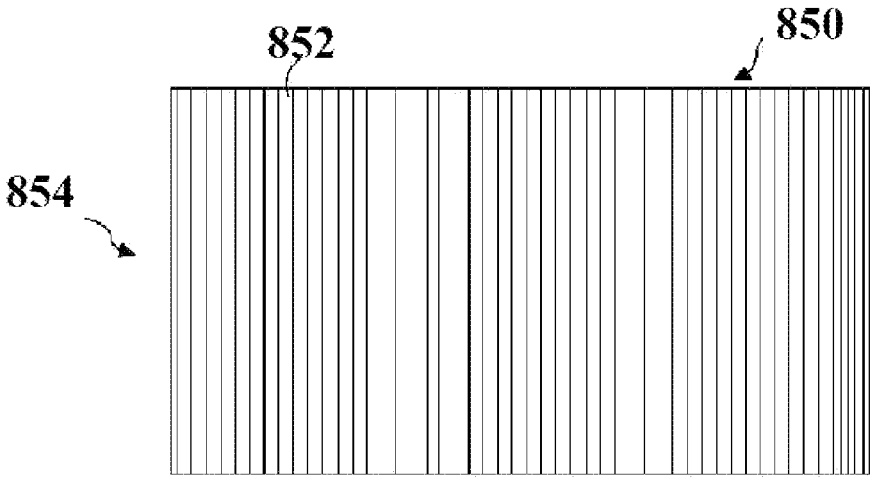
FIG. 111 is a schematic front view of the support structure assembly of FIG. 110.
Figure 112:
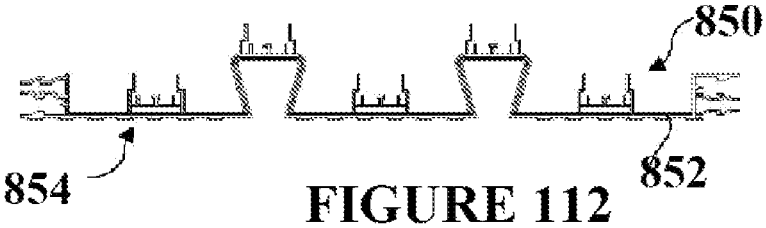
FIG. 112 is a schematic top view of the support structure assembly of FIG. 111.

FIGS. 110, 111 and 112 show a portion of an embodiment support structure assembly, generally indicated with the reference numeral 850. The support structure assembly 850 includes a substantially planar, wall panel 852 having extruded surface detail 854 providing keying detail for allowing for rendering. The keying detail shown provides angle surface returns for either plastic or cement render to adhere thereto. Also, the extruded surface detail provides an aesthetic finish option of itself.

Figure 113:
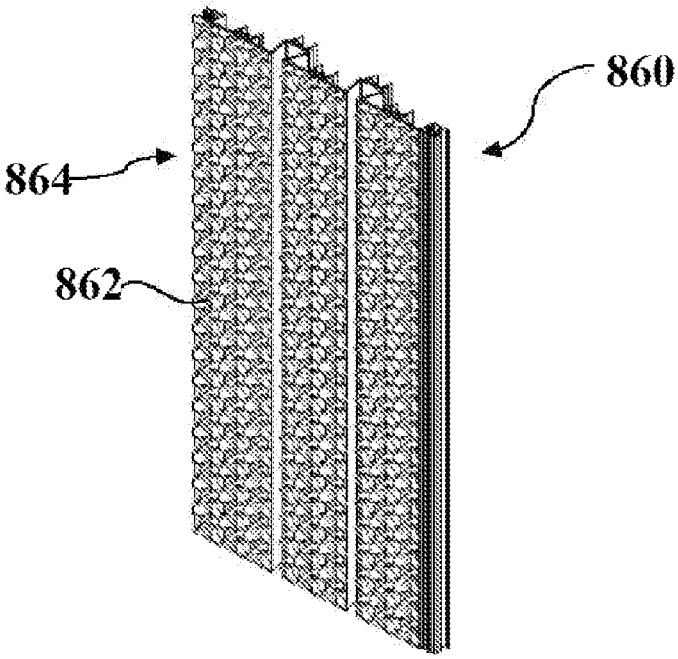
FIG. 113 is a schematic perspective view of a forty-ninth embodiment support structure assembly.
Figure 114:
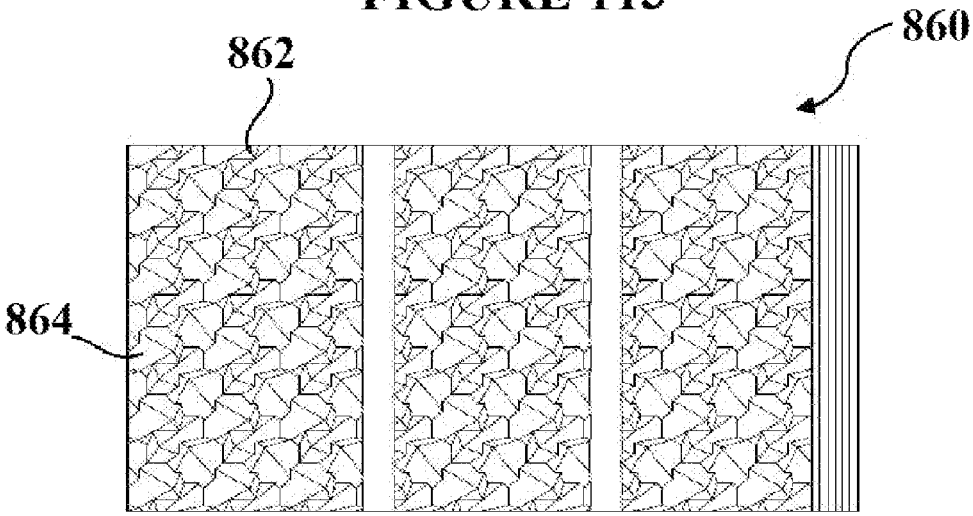
FIG. 114 is a schematic front view of the support structure assembly of FIG. 113.
Figure 115:
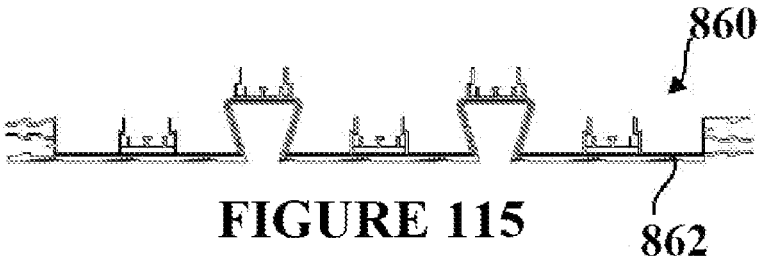
FIG. 115 is a schematic top view of the support structure assembly of FIG. 113.

FIGS. 113, 114 and 115 show a portion of an embodiment support structure assembly, generally indicated with the reference numeral 860. The support structure assembly 860 includes a substantially planar wall panel 862 having a surface relief pattern 864 rolled into the surface when extruded to provide keying in for render or providing an alternative surface finish.

Figure 116:
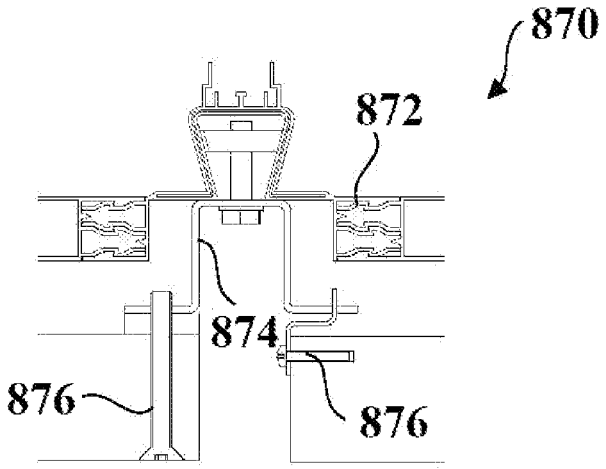
FIG. 116 is a schematic top view of a fiftieth embodiment support structure assembly.

FIG. 116 show a portion of an embodiment support structure assembly, generally indicated with the reference numeral 870. The support structure assembly 870 includes a substantially planar wall panel 872 having a top hat section 874 bolted thereto. Solar panels 876 are secured to the top hat section 874 via screws 876.

Figure 117:
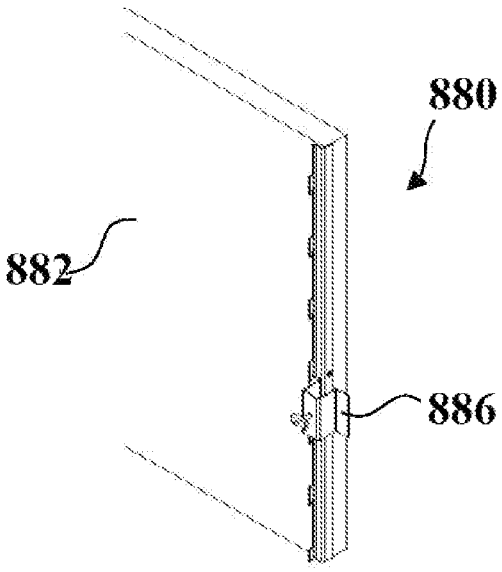
FIG. 117 is a schematic perspective view of a fifty-first embodiment support structure assembly.
Figure 118:
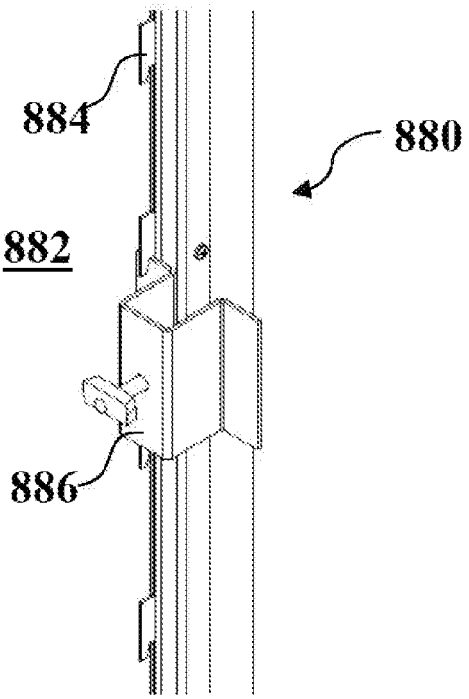
FIG. 118 is an enlarged schematic perspective view of the support structure assembly of FIG. 117.

FIGS. 117 and 118 show a portion of an embodiment support structure assembly, generally indicated with the reference numeral 880. The support structure assembly 880 includes a solar panel 882 having a hook-on bracket 884 screwed thereto. The bracket 884 attaches to a top hat section 886. Security screws, not illustrated, are used to lock the solar panels 882 in position to prevent unauthorised panel removal. FIGS. 117 and 118 show a discrete top hat section (used in multiples) for hook attachment. In a non-illustrated embodiment the top hat section 886 could be of continuous length with slots to accept bracket hook detail.

Figure 119:
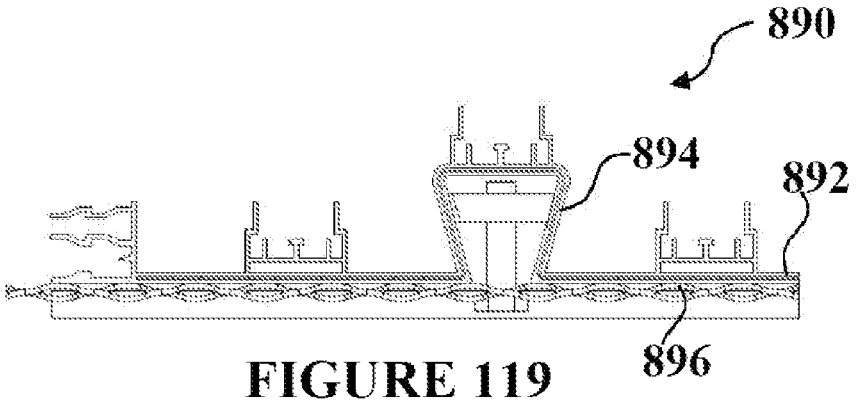

FIG. 119 shows a portion of an embodiment support structure assembly, generally indicated with the reference numeral 890. The support structure assembly 890 includes a substantially planar wall panel 892 having a channel 894. The support structure assembly 890 includes a metal mesh 896 secured to the wall panel 892 via the channel 894. The expended metal mesh provides a high quality key-in for retention of cement render. If will be appreciated that the mesh can be attached to the wall panel 892 by alternative means.

Figure 120:
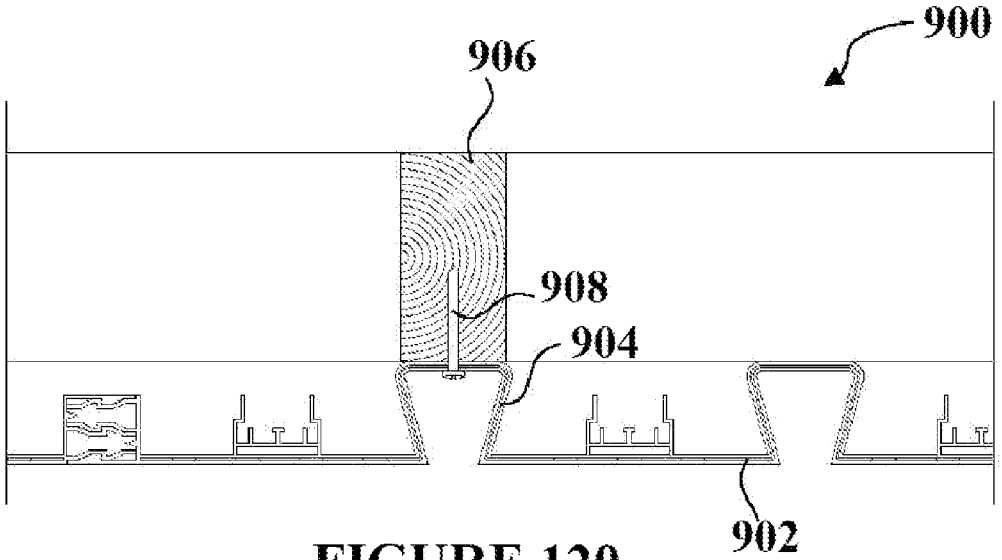

FIG. 120 shows a portion of an embodiment support structure assembly, generally indicated with the reference numeral 900. The support structure assembly 900 includes a substantially planar wall panel 902 having a channel 904. The wall panel 902 is attached to a timber (or metal) stud wall vertical member 906 via a fastener 908 passing through the channel 904.

Figure 121:
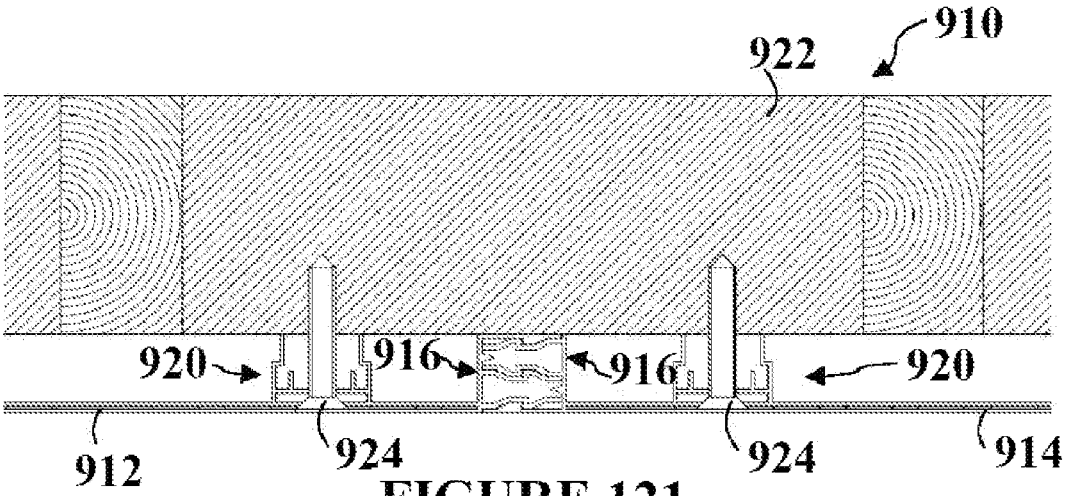

FIG. 121 shows an embodiment support structure assembly 910 having skin wall panels 912, 914 coupled via hermaphrodite panel coupling formations 916, 918. The wall panels 912, 914 each includes a brace coupling formation 920. The wall panels 912, 914 are attached to a stud wall horizontal noggin 922 via fasteners 924 which pass through the brace coupling formations 920.

In non-illustrated embodiments the braces of the above described support structure assemblies are produced from clear or "glow-in-the-dark" materials to provide aesthetically pleasing light features.

The above described embodiment support structure assemblies provide a versatile walling/formwork system which architects can use for a range of buildings types.

Consumers can, for example, opt to strip/remove one side of a wall after concrete curing to leave an exposed concrete finish and have a waterproof PVC membrane on the other side of the wall with a C-channel type element for fixing a façade. Alternatively, consumers can use pre-finished panels which require no additional finishing on site. All that is required is to strip a protective film off the panel skin (once construction is complete) to reveal a prefinished walling material, such as a timber grain hot-stamped onto a PVC extruded panel skin.

The above described support structure assembly can in preferred embodiments be employed as a permanent formwork, a removable/strippable formwork or a pre-finished cast-in-place wall which requires no further finishes or a combination of the aforementioned.

Specific reference has been made above to the support structure assembly including channel walls and a channel base encapsulating a resilient metal body. It will be appreciated that the resilient body could be produced from a range of materials, such as a fibre reinforced polymer.

Although specific reference has been made to a steel C-channel, it will be appreciated that the shape of the channel could vary depending on engineering requirements.

In a non-illustrated embodiment a support structure assembly is provided which includes a first wall panel operatively associated with an opposing spaced apart second wall panel. The first wall panel includes a panel coupling formation operatively adapted to couple via a snap-fit with a complemental panel coupling formation of an adjacent wall panel. In this non-illustrated embodiment the adjacent wall panel is a window frame or a door frame while the panel coupling formation is a hermaphrodite coupling of the type described in FIGS. 9 and 10.

Although the invention is described above in relation to preferred embodiments, it will be appreciated by those skilled in the art that it is not limited to those embodiments, but may be embodied in many other forms.

The invention claimed is:

1. A support structure assembly including a first wall panel operatively associated with an opposing, spaced apart second wall panel, the first wall panel including a channel having two spaced apart channel walls connected via a transverse channel base, wherein a resilient body is produced from a metal or a fibre reinforced polymer and is encapsulated within the channel with the channel having an open entry opposing the transverse channel base with an inside surface of the channel walls and channel base defining a channel enclosure;

wherein the channel includes a brace coupling formation outwardly extending from an outer surface of the channel;

wherein the channel operatively includes a locking member movable between (i) a locked position wherein the locking member engages the channel walls, and (ii) a release position in which the locking member is adapted to be removed from the channel; and wherein the locking member is attached to an actuator adapted to move the locking member between the locked position and the release position, the actuator adapted to support a façade panel.

2. A support structure assembly according to claim 1, wherein the first and second wall panels each include two spaced apart wall panel skins;

wherein the first and second wall panels each include two skins; and wherein the first and second wall panels include brace coupling recesses which hold brace coupling formations adapted to couple with complemental wall panel coupling formations on bracing components operatively extending between the first and second wall panels.

3. A support structure assembly according to claim 1, including external bracing operatively adapted to reinforce the first wall panel during a concrete pour operation.

4. A support structure assembly including a first wall panel operatively associated with an opposing, spaced apart second wall panel, the first wall panel including a channel having two spaced apart channel walls connected via a transverse channel base, wherein the first wall panel includes a panel coupling formation adapted to couple with a complemental panel coupling formation of an adjacent wall panel, the panel coupling formation adapted for snap-engagement with the complemental panel coupling formation of the adjacent wall panel, and wherein the panel coupling formation is a hermaphrodite coupling formation adapted to couple with a complemental hermaphrodite coupling formation of the adjacent wall panel.

5. A support structure assembly according to claim 4, wherein the first and second wall panels each include two spaced apart wall panel skins.

6. A support structure assembly according to claim 4, wherein the first and second wall panels each include two skins, and wherein the first and second wall panels include brace coupling recesses which hold brace coupling formations adapted to couple with complemental wall panel coupling formations on bracing components operatively extending between the first and second wall panels.

7. A support structure assembly including a first wall panel operatively associated with an opposing, spaced apart second wall panel, the first wall panel including a panel coupling formation operatively adapted to couple with a complemental panel coupling formation of an adjacent wall panel, wherein the panel coupling formation is adapted for snap-engagement with the complemental panel coupling formation of the adjacent wall panel, the panel coupling formation being a hermaphrodite coupling formation adapted to couple with a complemental hermaphrodite coupling formation of the adjacent wall panel, and wherein each hermaphrodite coupling formation includes (i) an outwardly extending protrusion having a ramp surface, and (ii) a first and second outwardly extending leg, each leg having a leg coupling formation, wherein (i) the outwardly extending protrusion of the first wall panel is adapted to engage a leg coupling formation of the second leg of the adjacent wall, (ii) a leg coupling formation of the first leg of the first wall panel is adapted to engage a leg coupling formation of the first leg of the adjacent wall panel, and (iii) a leg coupling formation of the second leg of the first wall panel is adapted to engage the outwardly extending protrusion of the adjacent panel.

8. A support structure assembly according to claim 7, wherein the first wall panel includes a panel coupling formation having two outwardly extending protrusions adapted for snap-engagement with two outwardly extending protrusions of a panel coupling formation of the adjacent wall panel, the outwardly extending protrusions of the adjacent panel defining a slot wherein the first wall panel includes a central protrusion adapted to be located within the slot.

9. A support structure assembly according to claim 8, wherein the panel coupling formations have a cover attached thereto, the cover adapted to seal the panel coupling formations against the ingress of moisture.

10. A support structure assembly according to claim 7, wherein the support structure is employed as formwork for concrete and wherein the first wall panel is adapted to be removed from the support structure assembly after curing of the concrete to expose a concrete finish.

11. A support structure assembly including a first wall panel operatively associated with an opposing spaced apart second wall panel, the support structure assembly including a brace operatively adapted to couple the first wall panel to the second wall panel, wherein the first wall panel includes a brace coupling formation operatively adapted to couple with a first wall panel coupling formation of the brace, and wherein the second wall panel includes a brace coupling formation operatively adapted to couple with a second wall panel coupling formation of the brace, and wherein the first wall panel coupling formation includes (i) two outer protrusions adapted to snap-engage the brace coupling formation of the first wall panel, and (ii) two internal protrusions operatively adapted to snap-engage a central protrusion of the brace coupling formation of the first wall panel, and wherein the brace includes a plurality of elongate, longitudinally extending brace members.

12. A support structure assembly according to claim 11, wherein the brace members (i) include undulating surfaces operatively adapted to support reinforcing members thereon, and (ii) support transverse cross-brace members each such cross-brace member holding an elongate reinforcing body.

13. A support structure assembly including a first wall panel operatively associated with an opposing, spaced apart second wall panel, the first wall panel including a channel having two spaced apart channel walls connected via a transverse channel base, wherein a resilient body is encapsulated within the channel; and wherein a support member has a support plate, the support plate including a plurality of holes operatively adapted to receive plaster seam infill, the support member further including a channel coupling member having resilient protrusions operatively adapted to snap-engage the channel.

* * * * *